US007260533B2

(12) United States Patent
Kamanaka

(10) Patent No.: US 7,260,533 B2
(45) Date of Patent: Aug. 21, 2007

(54) TEXT-TO-SPEECH CONVERSION SYSTEM

(75) Inventor: Hiroki Kamanaka, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 879 days.

(21) Appl. No.: 09/907,660

(22) Filed: Jul. 19, 2001

(65) Prior Publication Data

US 2003/0074196 A1 Apr. 17, 2003

(30) Foreign Application Priority Data

Jan. 25, 2001 (JP) ..... 2001-017058

(51) Int. Cl.
*G10L 13/00* (2006.01)

(52) U.S. Cl. ..... 704/260

(58) Field of Classification Search ..... 704/200, 704/244, 258, 260, 267, 270; 700/83
See application file for complete search history.

(56) References Cited

U.S. PATENT DOCUMENTS 4,570,250 A * 2/1986 Gabritsos et al. ..... 704/260
4,692,941 A * 9/1987 Jacks et al. ..... 704/260
4,731,847 A * 3/1988 Lybrook et al. ..... 704/260
5,278,943 A * 1/1994 Gasper et al. ..... 704/200
5,384,893 A * 1/1995 Hutchins ..... 704/267
5,615,300 A * 3/1997 Hara et al. ..... 704/260
5,636,325 A * 6/1997 Farrett ..... 704/258
5,850,629 A * 12/1998 Holm et al. ..... 704/260
5,867,386 A * 2/1999 Hoffberg et al. ..... 700/83
5,933,804 A * 8/1999 Huang et al. ..... 704/244
6,208,968 B1 * 3/2001 Vitale et al. ..... 704/260
6,266,637 B1 * 7/2001 Donovan et al. ..... 704/258
6,308,156 B1 * 10/2001 Barry et al. ..... 704/268
6,334,104 B1 * 12/2001 Hirai ..... 704/258

(Continued)

FOREIGN PATENT DOCUMENTS

JP 53-030313 * 3/1978

(Continued)

*Primary Examiner*—Angela Armstrong
(74) *Attorney, Agent, or Firm*—Rabin & Berdo PC

(57) ABSTRACT

The system according to the invention comprises a text-to-speech conversion processing unit, and a phrase dictionary as well as a waveform dictionary, connected independently from each other to the conversion processing unit. The conversion processing unit is for converting any Japanese text inputted from outside into speech. In the phrase dictionary, voice-related terms representing the reproduced sounds of actually recorded sounds, for example, notations of terms such as onomatopoeic words, background sounds, lyrics, music titles, and so forth, are previously registered. Further, in the waveform dictionary, waveform data obtained from the actually recorded sounds, corresponding to the voice-related terms, are previously registered. Furthermore, the conversion processing unit is constituted such that as for a term in the text matching the voice-related term registered in the phrase dictionary upon correlation of the former with the latter, actually recorded speech waveform data corresponding to the relevant voice-related term matching the term in the text, registered in the waveform dictionary, is outputted as a speech waveform of the term.

49 Claims, 32 Drawing Sheets

U.S. PATENT DOCUMENTS

| | | | | |
|---|---|---|---|---|
| 6,385,581 | B1 * | 5/2002 | Stephenson | 704/270 |
| 6,424,944 | B1 * | 7/2002 | Hikawa | 704/260 |
| 6,446,040 | B1 * | 9/2002 | Socher et al. | 704/260 |
| 6,462,264 | B1 * | 10/2002 | Elam | 704/258 |
| 6,499,014 | B1 * | 12/2002 | Chihara | 704/260 |
| 6,513,007 | B1 * | 1/2003 | Takahashi | 704/258 |
| 2003/0028380 | A1 * | 2/2003 | Freeland et al. | 704/260 |

FOREIGN PATENT DOCUMENTS

| | | | |
|---|---|---|---|
| JP | 61-250771 | * | 11/1986 |
| JP | 03-145698 | * | 6/1991 |
| JP | 08-051379 | * | 2/1996 |
| JP | 2000-081892 | * | 3/2000 |
| JP | 2000-148175 | * | 5/2000 |

* cited by examiner

TEXT-TO-SPEECH CONVERSION SYSTEM

BACKGROUND OF THE INVENTION

1. Field of the Invention

The present invention relates to a text-to-speech conversion system, and in particular, to a Japanese-text to speech conversion system for converting a text in Japanese into a synthesized speech.

2. Description of the Related Art

A Japanese-text to speech conversion system is a system wherein a sentence in both kanji (Chinese character) and kana (Japanese alphabet), which Japanese native speakers routinely write and read, is inputted as an input text, the input text is converted into voices, and the voices as converted are outputted as a synthesized speech. FIG. 1 shows a block diagram of a conventional system by way of example. The conventional system is provided with a conversion processing unit 12 for converting a Japanese text inputted through an input unit 10 into a synthesized speech. The Japanese text is inputted to a text analyzer 14 of the conversion processing unit 12. In the text analyzer 14, a phoneme rhythm symbol string is generated from a sentence in both kanji and kana as inputted. The phoneme rhythm symbol string represents description (intermediate language) of reading, accent, intonation, etc. of the sentence inputted, expressed in the form of a character string. Reading and accent of respective words are previously registered in a phonation dictionary 16, and the phoneme rhythm symbol string is generated by referring to the phonation dictionary 16. When, for example, a text reading "猫がニャ-と鳴いた (a cat mewed)" is inputted, the text analyzer 14 divides the input text into respective words by use of the longest string-matching method as is well known, that is, by use of the longest word with a notation matching the input text while referring to the phonation dictionary 16. In this case, the input text is converted into a word string consisting of ⌈猫 (ne' ko)⌋, ⌈が (ga)⌋, ⌈ニャ--(nya'-)⌋, ⌈と (to)⌋, ⌈鳴い(nai)⌋, and ⌈た(ta)⌋. What is shown in respective round brackets is information on respective words, registered in the dictionary, that is, reading and accent of the respective words.

The text analyzer 14 generates a phoneme rhythm symbol string representing ⌈ne' ko ga, nya' -to, naita⌋ by use of the information on respective words of the word string, registered in the dictionary, that is, the information in the respective round brackets, and on the basis of such information, speech synthesis is executed by a rule-based speech synthesizer 18. In the phoneme rhythm symbol string, ⌈'⌋ indicates an accent position, and ⌈,⌋ indicates a punctuation of respective accented phrases.

The rule-based speech synthesizer 18 generates synthesized waveforms on the basis of the phoneme rhythm symbol string by referring to a memory 20 wherein speech element data are stored. The synthesized waveforms are converted into a synthesized speech via a speaker 22, and outputted. The speech element data are basic units of speech, for forming a synthesized waveform by joining themselves together, and various types of speech element data according to types of sound are stored in the memory 20 such as a ROM, and so forth.

With the Japanese-text to speech conversion system of the conventional type, using such a method of speech synthesis as described above, any text in Japanese can be read in the form of a synthesized speech, however, a problem has been encountered that the synthesized speech as outputted is poor in intonation, thereby giving a listener feeling of monotonousness with the result that the listener gets bored or tired of listening to the same.

SUMMARY OF THE INVENTION

It is therefore an object of the invention to provide a Japanese-text to speech conversion system for outputting a synthesized speech without causing a listener to get bored or tired of listening.

Another object of the invention is to provide a Japanese-text to speech conversion system for replacing a synthesized speech waveform of a voice related term selected among terms in a text with an actually recorded speech waveform, thereby outputting a synthesized speech for the text in whole.

Still another object of the invention is to provide a Japanese-text to speech conversion system for concurrently outputting synthesized speech waveforms of all the terms in the text, and an actually recorded speech waveform related to a voice related term among the terms in the text, thereby outputting a synthesized speech.

To this end, a Japanese-text to speech conversion system according the invention is comprised as follows.

The system according to the invention comprises a text-to-speech conversion processing unit, and a phrase dictionary as well as a waveform dictionary, connected independently from each other to the conversion processing unit. The conversion processing unit is for converting any Japanese text inputted from outside into speech. In the phrase dictionary, voice-related terms representing the reproduced sounds of actually recorded sounds, for example, notations of terms such as onomatopoeic words, background sounds, lyrics, music titles, and so forth, are previously registered. Further, in the waveform dictionary, waveform data obtained from the actually recorded sounds, corresponding to the voice-related terms, are previously registered.

Furthermore, the conversion processing unit is constituted such that as for a term in the text matching the voice-related term registered in the phrase dictionary upon correlation of the former with the latter, actually recorded speech waveform data corresponding to the relevant voice-related term matching the term in the text, registered in the waveform dictionary, is outputted as a speech waveform of the term. The conversion processing unit is preferably constituted such that a synthesized speech waveform of the text in whole and the actually recorded speech waveform data are outputted independently from each other or concurrently.

With the constitution of the system according to the invention as described above, in the case of the voice-related term being an onomatopoeic word, lyrics, so forth, an actually recorded speech is interpolated in the synthesized speech of the text before outputted, thereby adding a sense of realism to the output of the synthesized speech.

Further, with the constitution as described above, in the case of the voice-related term being a background sound, music title, and so forth, the actually recorded sound is outputted like BGM (background music) concurrently with the output of the synthesized speech of the text in whole, thereby rendering the output of the synthesized speech well worth listening to.

DETAILED DESCRIPTION OF THE PREFERRED EMBODIMENTS

First Embodiment

Figure 1:
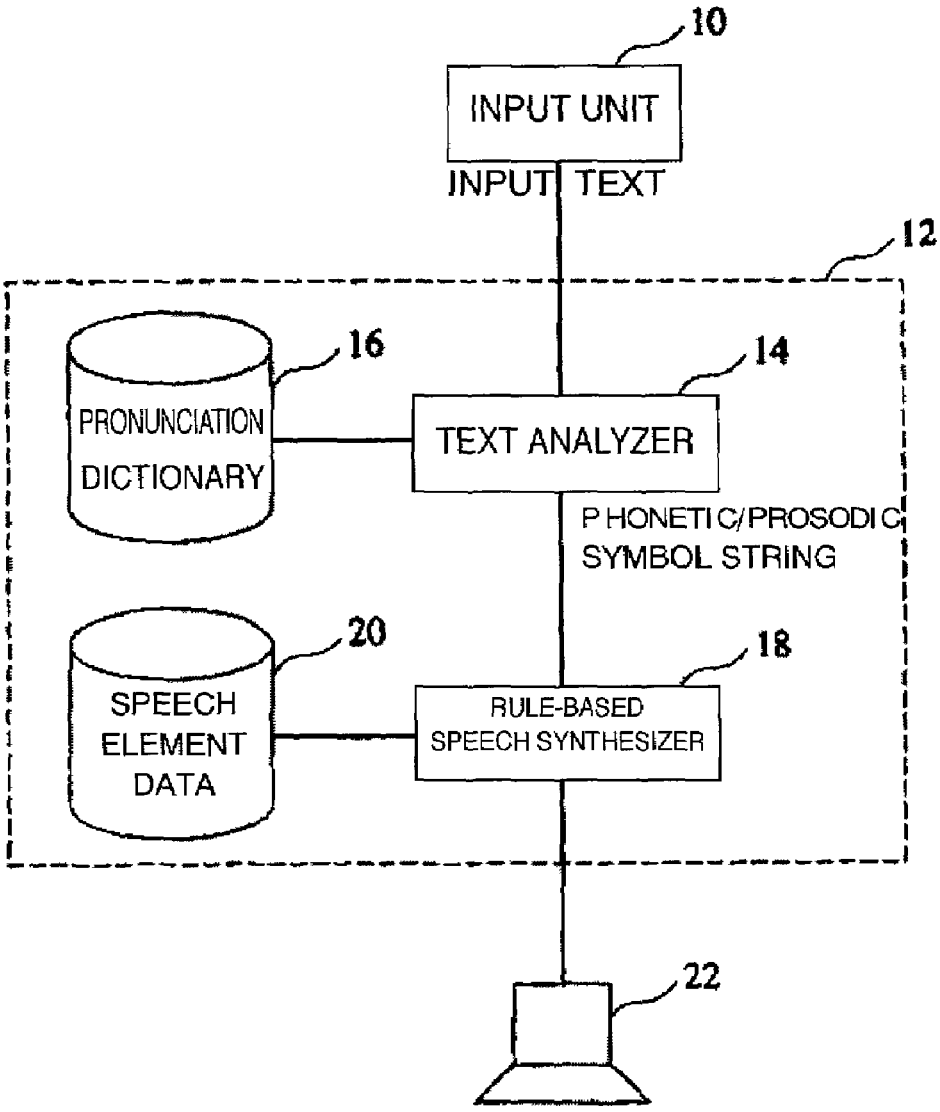
FIG. 1 (PRIOR ART)
FIG. 1 is a block diagram of a conventional Japanese-text to speech conversion system.
Figure 2:
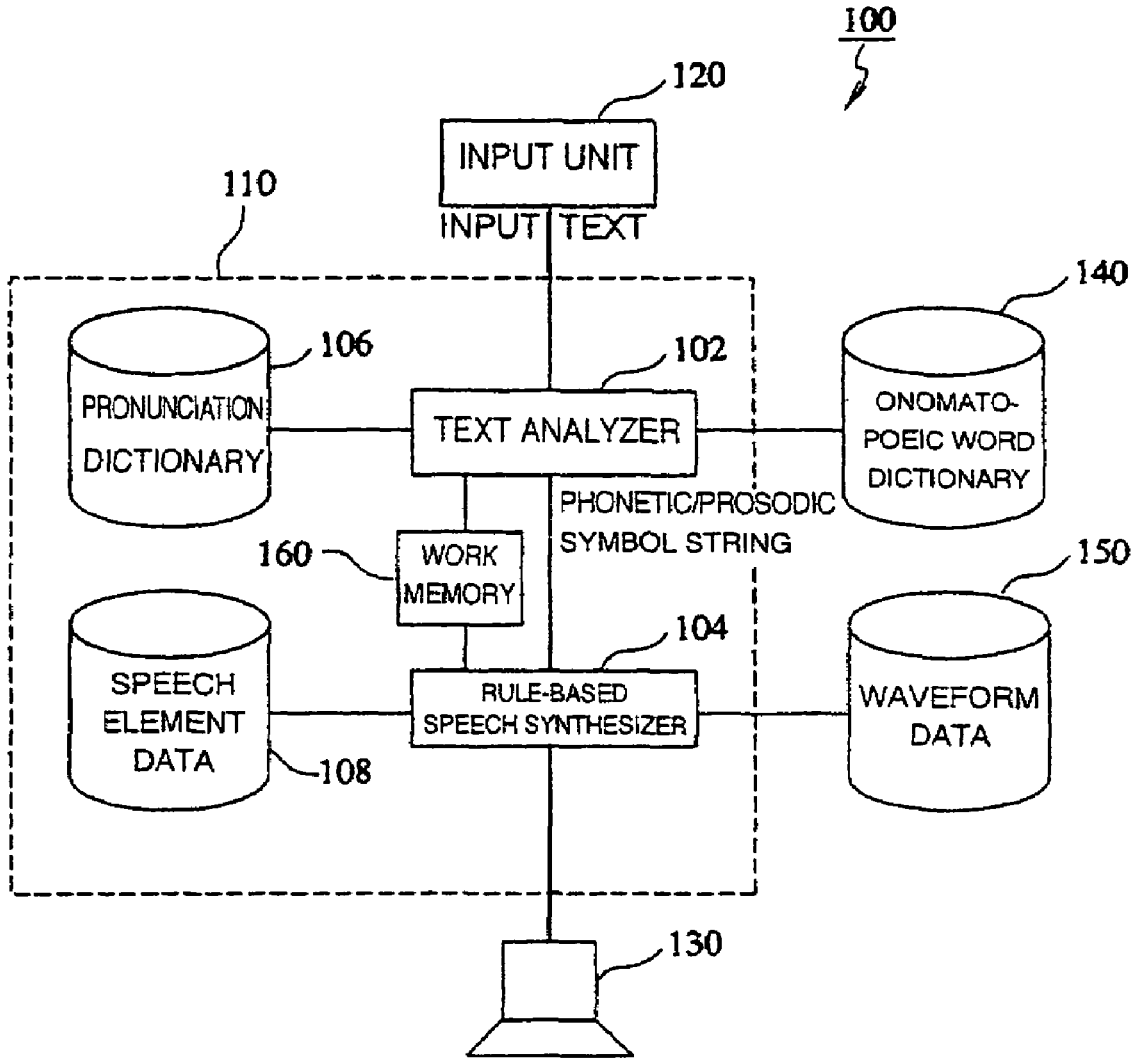
FIG. 2 is a block diagram showing the constitution of a first embodiment of a Japanese-text to speech conversion system according to the invention by way of example.

FIG. 2 is a block diagram showing the constitution example of a first embodiment of a Japanese-text to speech conversion system according to the invention. The system 100 comprises a text-to-speech conversion processing unit 110 provided with an input unit 120 for capturing input data from outside in order to cause an input text in the form of digital electric information to be inputted to the conversion processing unit 110, and a speech conversion unit, for example, a speaker 130, for outputting speech waveforms (synthesized speech waveforms) outputted from the conversion processing unit 110.

Further, the conversion processing unit 110 comprises a text analyzer 102 for converting the input text into a phoneme rhythm symbol string thereof and outputting the same, and a rule-based speech synthesizer 104 for converting the phoneme rhythm symbol string into a synthesized speech waveform and outputting the same to the speaker 130. Further, the conversion processing unit 110 is connected to the text analyzer 102 as well as a phonation dictionary 106 wherein reading and accent of respective words are registered, and to the rule-based speech synthesizer 104, further comprising a speech waveform memory (storage unit) 108 such as a ROM (read only memory), for storing speech element data. The rule-based speech synthesizer 104 converts the phoneme rhythm symbol string outputted from the text analyzer 102 into a synthesized speech waveform on the basis of speech element data.

Table 1 shows an example of the registered contents of the phonation dictionary provided in the constitution of the first embodiment, and other embodiments described later on, respectively. A notation of respective words, class of the respective words, and reading and an accent corresponding to the respective notations are shown in Table 1.

TABLE 1

| NOTATION | PART OF SPEECH | PRONUNCIATION |
|---|---|---|
| 雨 | noun | a'me |
| い | verb | i |
| 犬 | noun | inu' |
| 歌い | verb | utai |
| 唄い | verb | utai |
| 彼女 | pronoun | ka'nojo |
| 彼 | pronoun | ka're |
| が | postposition | ga |
| 君が代 | noun | kimigayo |
| さくら | noun | sakura |
| しとしと | adverb | shito' shito |
| た | auxiliary verb | ta |
| て | postposition | te |
| と | postposition | to |
| 鳴い | verb | nai |
| ニャー | interjection | nya'- |
| 猫 | noun | ne' ko |
| 始め | verb | hajime |
| は | postposition | wa |
| 降っ | verb | fu' t |
| 吠え | verb | ho' e |
| まし | auxiliary verb | ma' shi |
| ワンワン | interjection | wa' n wan |
| . . . | . . . | . . . |

The input unit 120 is provided in the constitution of the first embodiment, and other embodiments described later on, respectively, and as is well known, may be comprised as an optical reader, an input unit such as a keyboard, a unit made up of the above-described suitably combined, or any other suitable input means.

In addition, the system 100 is provided with a phrase dictionary 140 connected to the text analyzer 102 and a waveform dictionary 150 connected to the rule-based speech synthesizer 104. In the phrase dictionary 140, voice-related terms representing reproduced sounds of actually recorded sounds are previously registered. In this embodiment, the voice-related terms are onomatopoeic words, and accordingly, the phrase dictionary 140 is referred to as an onomatopoeic word dictionary 140. A notation for respective onomatopoeic words, and a waveform file name corresponding to the respective onomatopoeic words are listed in the onomatopoeic word dictionary 140.

Table 2 shows the registered contents of the onomatopoeic word dictionary by way of example. In Table 2, a notation of 「ニャ--」 (the onomatopoeic word for mewing by a cat), 「ワンワン」 (the onomatopoeic word for barking by a dog), 「ピンポン」 (the onomatopoeic word for the sound of a chime), 「カキ-ン」 (the onomatopoeic word for the sound of a hard ball hitting a baseball bat), and so forth, respectively, and a waveform file name corresponding to the respective notations are listed by way of example.

TABLE 2

| NOTATION | WAVEFORM FILE NAME |
|---|---|
| ニャ- | CAT. WAV |
| ワンワン | DOG. WAV |
| ピンポン | BELL. WAV |
| カキ-ン | BAT. WAV |
| . . . | . . . |

In the waveform dictionary 150, waveform data obtained from actually recorded sounds, corresponding to the voice-related terms listed in the onomatopoeic word dictionary 140, are stored as waveform files. The waveform files represent original sound data obtained by actually recording sounds and voices. For example, in a waveform file "CAT. WAV" corresponding to the notation 「ニャ--」, a speech waveform of recorded mewing is stored. In this connection, a speech waveform obtained by recording is also referred to as an actually recorded speech waveform or natural speech waveform.

The conversion processing unit 110 has a function such that if there is found a term matching one of the voice-related terms registered in the phrase dictionary 140 among terms of an input text, the actually recorded speech waveform data of the relevant term is substituted for a synthesized speech waveform obtained by synthesizing speech element data, and is outputted as waveform data of the relevant term.

Further, the conversion processing unit 110 comprises a first memory 160. The first memory 160 is a memory for temporarily retaining information and data, necessary for processing in the text analyzer 102 and the rule-based speech synthesizer 104, or generated by such processing. The first memory 160 is installed as a memory for common use between the text analyzer 102 and the rule-based speech synthesizer 104. However, the first memory 160 may be installed inside or outside of the text analyzer 102 and the rule-based speech synthesizer 104, individually.

Figure 3:
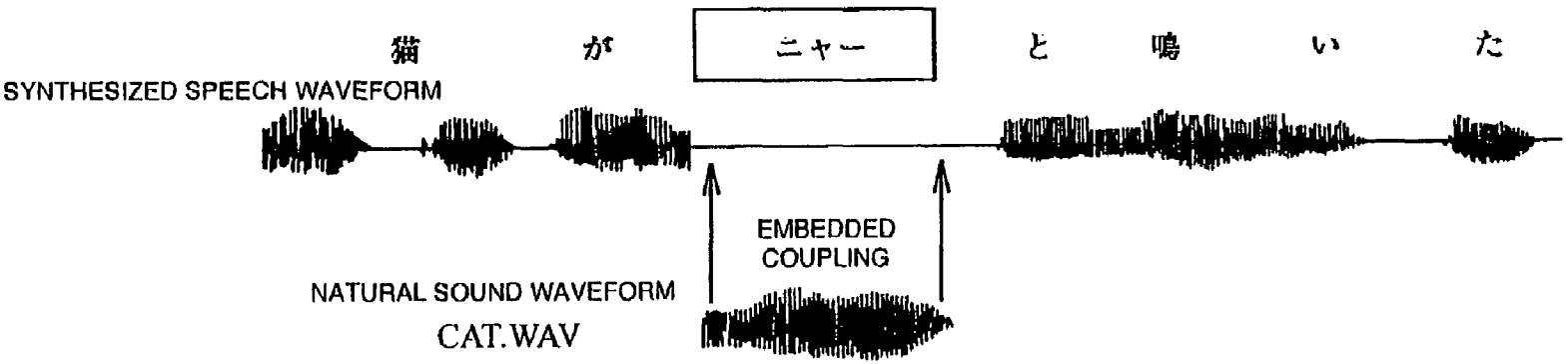
FIG. 3 is a schematic illustration of an example of coupling a synthesized speech waveform with the actually recorded speech waveform of an onomatopoeic word according to the first embodiment.
Figure 4A:
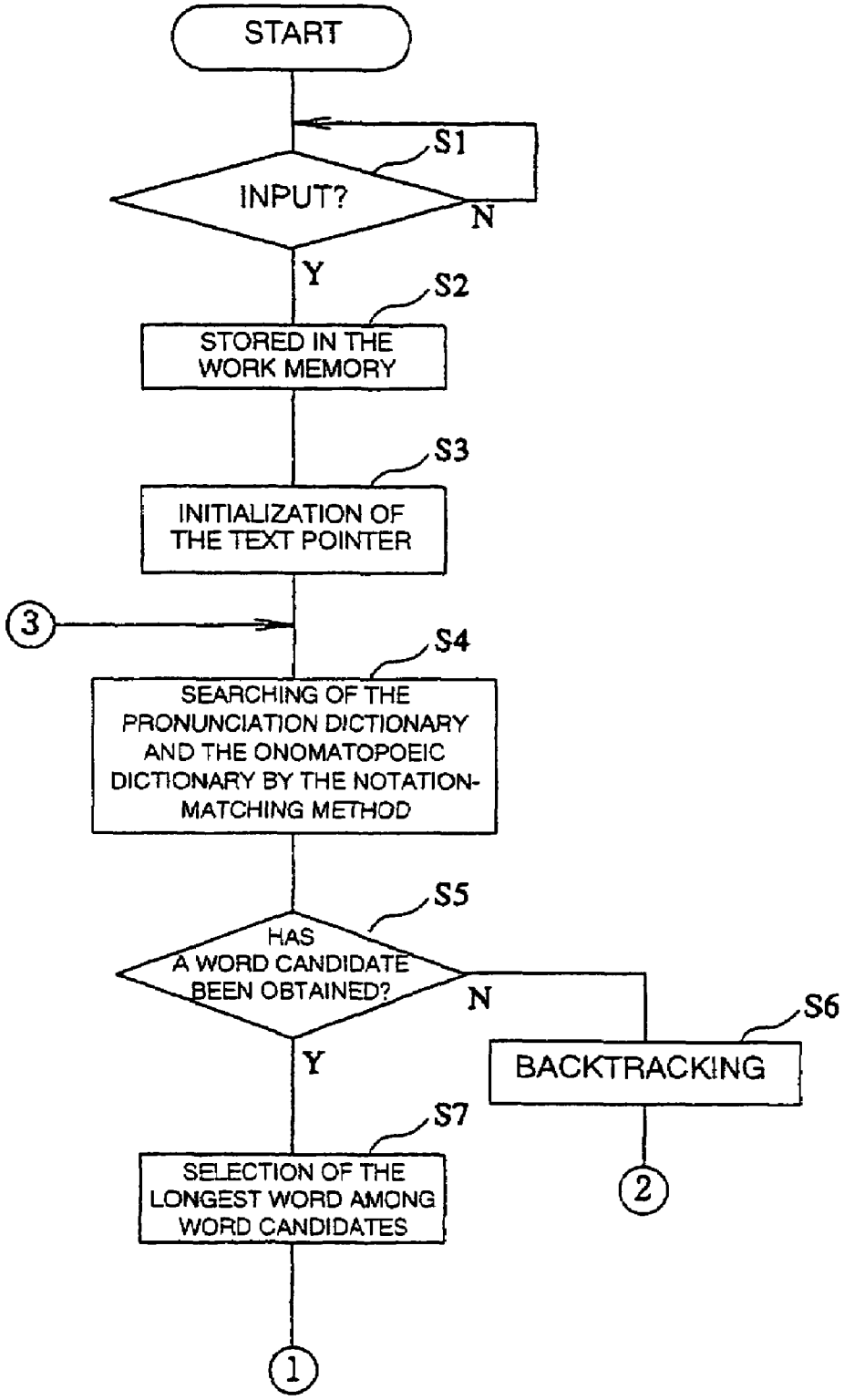
FIGS. 4A and 4B are operation flow charts of a text analyzer according to the first embodiment.
Figure 4B:
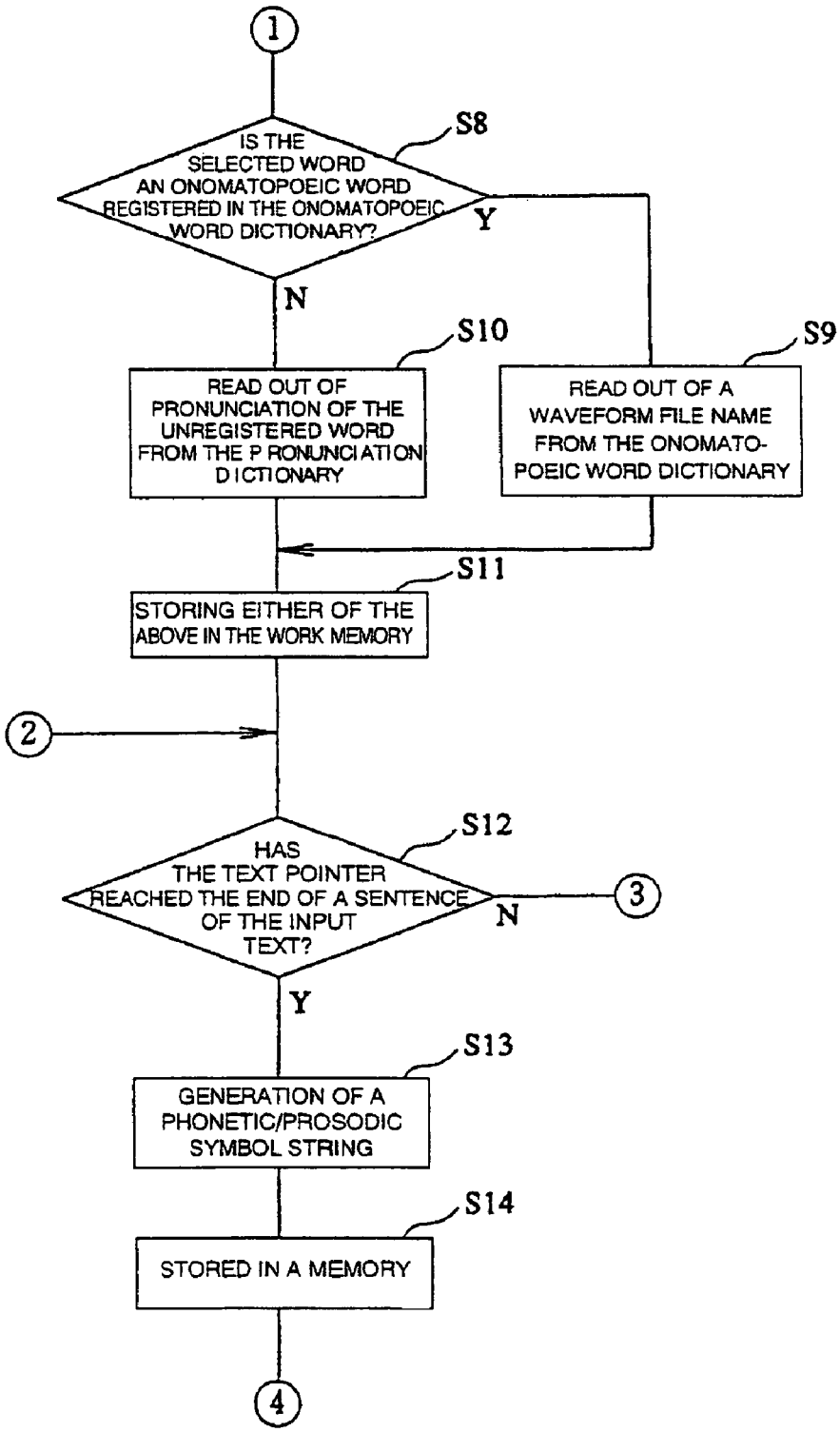
Figure 5A:
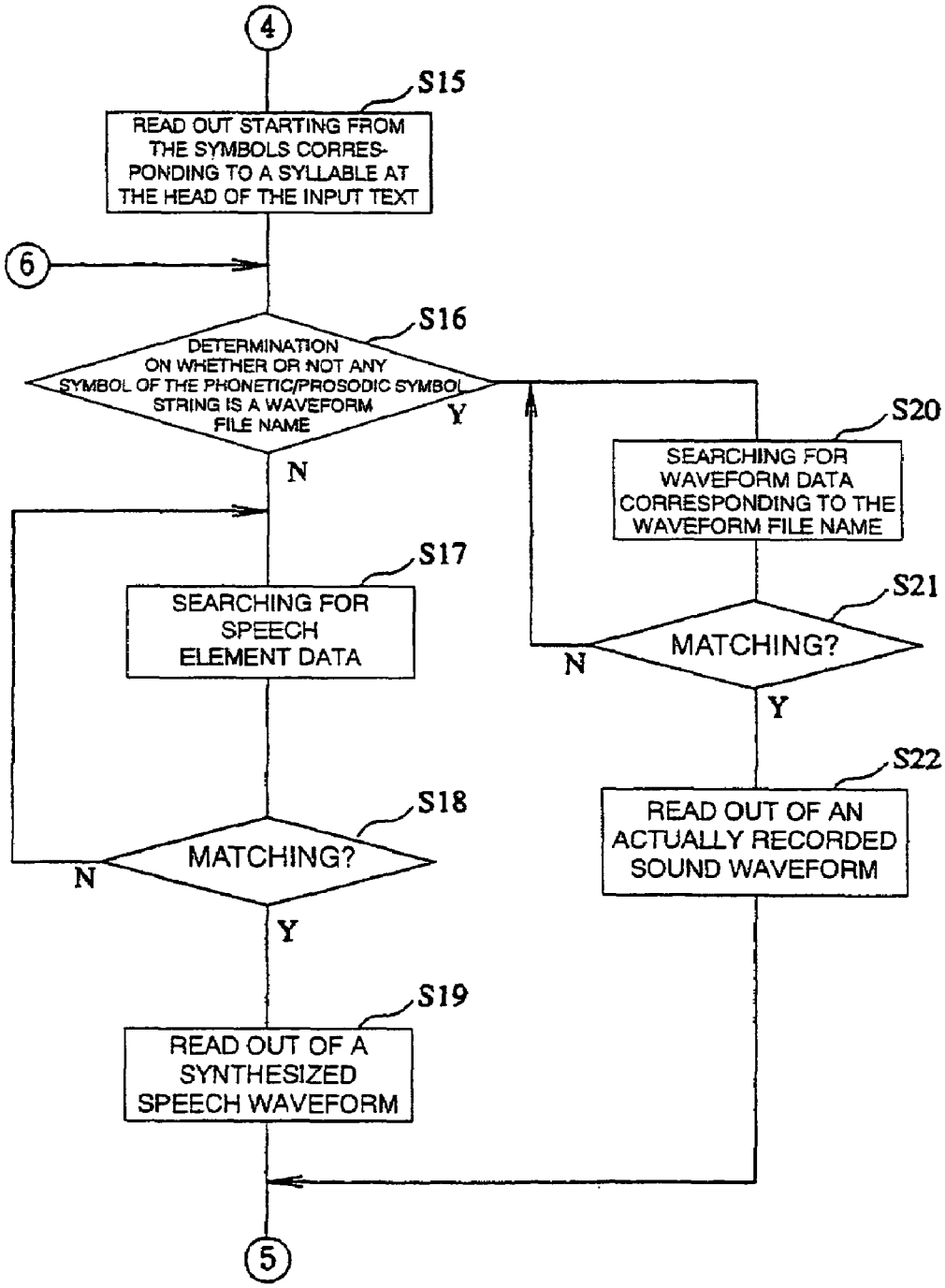
FIGS. 5A and 5B are operation flow charts of a rule-based speech synthesizer according to the first embodiment and a fifth embodiment.
Figure 5B:
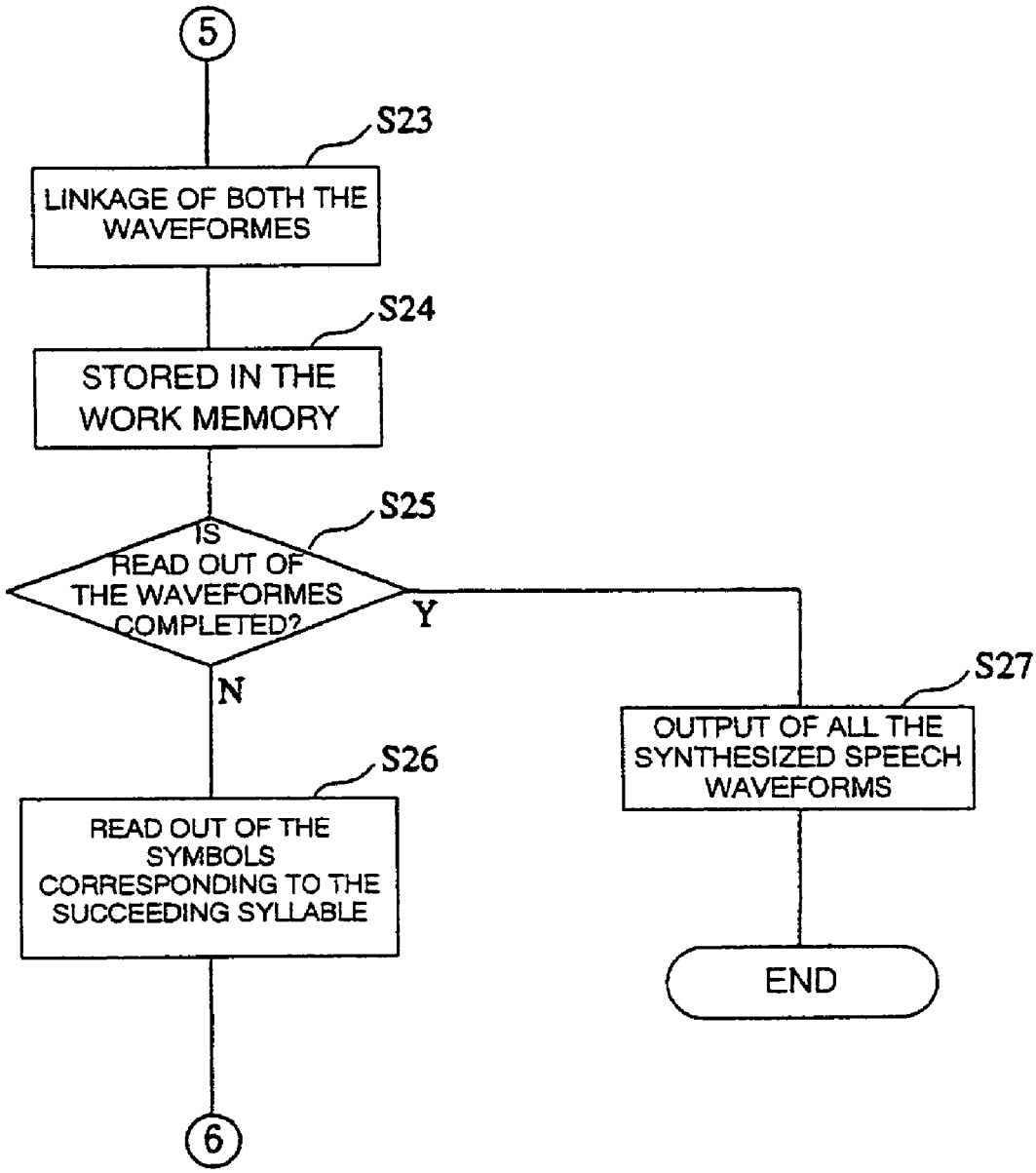

Now, operation of the Japanese-text to speech conversion system constituted as shown in FIG. 2 is described by giving a specific example. FIG. 3 is a schematic view illustrating an example of coupling a synthesized speech waveform with the actually recorded speech waveform of an onomatopoeic word. FIGS. 4A and 4B are operation flow charts of the text analyzer for explaining such an operation, and FIGS. 5A and 5B are operation flow charts of the rule-based speech synthesizer for explaining such an operation. In these operation flow charts, respective steps of processing are denoted by a symbol S with a number attached thereto.

For example, an input text in Japanese is assumed to read 「猫がニャ-と鳴いた」. The input text is read by the input unit 120 and is inputted to the text analyzer 102.

The text analyzer 102 determines whether or not the input text is inputted (refer to a step S1 in FIG. 4A). Upon verification of input, the input text is stored in the first memory 160 (refer to a step S2 in FIG. 4A).

Subsequently, the input text is divided into respective words by use of the longest string-matching method, that is, by use of the longest word with a notation matching the input text. Processing by the longest string-matching method is executed as follows:

A text pointer p is initialized by setting the text pointer p at the head of the input text to be analyzed (refer to a step S3 in FIG. 4A).

Subsequently, the phonation dictionary 106 and the onomatopoeic word dictionary 140 are searched by the text analyzer 102 with the text pointer p set at the head of the input text in order to examine whether or not there exists a word with a notation (heading) matching the input text (the notation-matching method), and satisfying connection conditions (refer to a step S4 in FIG. 4A). The connection conditions refer to conditions such as whether or not a word can exist at the head of a sentence if the word is at the head, whether or not a word can be grammatically connected to a preceding word if the word is in the middle of a sentence, and so forth.

Whether or not there exists a word satisfying the connection conditions in the phonation dictionary or the onomatopoeic word dictionary, that is, whether or not a word candidate can be obtained is searched (refer to a step S5 in FIG. 4A). In case that the word candidate can not be found by such searching, the processing backtracks (refer to a step S6 in FIG. 4A), and proceeds to a step S12 as described later on. Backtracking in this case means to move the text pointer p back to the head of the preceding word, and to attempt an analysis using a next candidate for the word.

Next, in case that the word candidates are obtained, the longest word, that is, term (the term includes various expressions such as word, locution, and so on) is selected among the word candidates (refer to a step S7 in FIG. 4A). In this case, auxiliary words are preferably selected among word candidates of the same length, taking precedence over independent words. Further, in case that there is only one word candidate, such a word is selected as it is.

Subsequently, the onomatopoeic word dictionary 140 is searched in order to examine whether or not a selected word is among the voice-related terms registered in the onomatopoeic word dictionary 140 (refer to a step S8 in FIG. 4B). Such searching as well is executed against the onomatopoeic word dictionary 140 by the notation-matching method.

In the case where a word, that is, a term, with the same notation, is registered in both the phonation dictionary 106 and the onomatopoeic word dictionary 140, use is to be made of the word registered in the onomatopoeic word dictionary 140, that is, the voice-related term.

In the case where the selected word is registered in the onomatopoeic word dictionary 140, a waveform file name is read out from the onomatopoeic word dictionary 140, and stored in the first memory 160 together with a notation for the selected word (refer to steps S9 and S11 in FIG. 4B).

On the other hand, in the case where the selected word is an unregistered word which is not registered in the onomatopoeic word dictionary 140, reading and an accent corresponding to the unregistered word are read out from the phonation dictionary 106, and stored in the first memory 160 (refer to steps S10 and S11 in FIG. 4B).

The text pointer p is advanced by a length of the selected word, and analysis described above is repeated until the text pointer p comes to the end of a sentence of the input text, thereby dividing the input text from the head to the end of the sentence into respective words, that is, respective terms (refer to a step S12 in FIG. 4B).

In case that analysis processing up to the end of the input text is not completed, the processing reverts to the step S4 whereas in case that the analysis processing is completed, reading and an accent of the respective words are read out from the first memory 160, and the input text is rendered into a word-string punctuated by every word, simultaneously reading out waveform file names. In this case, the sentence reading ⌈猫がニャーと鳴いた⌋ is punctuated by respective words consisting of ⌈猫|が|ニャー|と|⌋. Herein, a symbol ⌈|⌋ is a symbol denoting punctuation of respective words, used merely in expression of a writing, and accordingly, it is not meant that such notation is actually provided as punctuation information.

Subsequently, in the text analyzer 102, a phoneme rhythm symbol string is generated from the word-string by replacing an onomatopoeic word in the word-string with a waveform file name while basing other words therein on reading and an accent thereof (refer to a step S13 in FIG. 4B).

If the respective words of the input text are expressed in relation to reading and an accent of every word, the input text is turned into a word string of ⌈猫 (ne' ko)⌋, ⌈が (ga)⌋, ⌈ニャ--("CAT. WAV")⌋, ⌈と (to)⌋, ⌈鳴い (nai)⌋, and ⌈た (ta)⌋. What is shown in round brackets is information on the respective words, registered in the phonation dictionary 106 and the onomatopoeic word dictionary 140, respectively, indicating reading and an accent in the case of respective registered words of the phonation dictionary 106, and a waveform file name in the case of respective registered words of the onomatopoeic word dictionary 140 as previously described.

By use of the information on the respective words of the word string, registered in the dictionaries, that is, the information in the round brackets, the text analyzer 102 generates the phoneme rhythm symbol string of ne' ko ga, "CAT. WAV" to, nai ta⌋, and registers the same in a memory (not shown) (refer to a step S14 in FIG. 4B).

The phoneme rhythm symbol string is generated based on the word-string, starting from the head of the word-string. The phoneme rhythm symbol string is generated basically by joining together the information on the respective words, registered in the dictionaries, head to head, and a symbol ⌈,⌋ is inserted at positions of a pause for an accent.

Subsequently, the phoneme rhythm symbol is read out in sequence from the memory and is sent out to the rule-based speech synthesizer 104.

On the basis of the phoneme rhythm symbol string of ⌈ne' ko ga, "CAT. WAV" to, nai ta⌋ as received, the rule-based speech synthesizer 104 reads out relevant speech element data from the speech waveform memory 108 storing speech element data, thereby generating a synthesized speech waveform. The steps of processing in this case are described hereinafter.

First, read out is executed starting from the phoneme rhythm symbol string corresponding to a syllable at the head of the input text (refer to a step S15 in FIG. 5A). The rule-based speech synthesizer 104 determines in sequence whether or not any symbol of the phoneme rhythm symbol string as read out is a waveform file name (refer to a step S16 in FIG. 5A).

In the case where any symbol of the phoneme rhythm symbol string is not a waveform file name, access to the speech waveform memory 108 is made, and speech element data corresponding to the phoneme rhythm symbol string are searched for (refer to steps S17 and 18 in FIG. 5A).

In the case where there exists the speech element data corresponding to the phoneme rhythm symbol string, synthesized speech waveforms corresponding thereto are read out and are stored in the first memory 160 (refer to a step S19 in FIG. 5A).

On the other hand, in the case where there exists a waveform file name in the phoneme rhythm symbol string, access to the waveform dictionary 150 is made, and waveform data corresponding to the waveform file name are searched for (refer to steps S20 and 21 in FIG. 5A).

The waveform data (that is, an actually recorded speech waveform or natural speech waveform) are read out from the waveform dictionary 150, and are stored in the first memory 160 (refer to a step S22 in FIG. 5A).

In this example, as "CAT. WAV" is interpolated in the phoneme rhythm symbol string, a synthesized speech waveform for "ne' ko ga," is first generated, and subsequently, the actually recorded speech waveform of the waveform file name "CAT. WAV" is read out from the waveform dictionary 150. Accordingly, the synthesized speech waveform as already generated and the actually recorded speech waveform are retrieved from the first memory 160, and both the waveforms are linked (coupled) together in the order of an arrangement, thereby generating a synthesized speech waveform, and storing the same in the first memory 160 (refer to steps S23 and S24 in FIG. 5B).

In the case where read out of the waveforms corresponding to the phoneme rhythm symbol string is incomplete, read out of a symbol string corresponding to a succeeding syllable is executed (refer to steps S25 and S26 in FIG. 5B), and the processing reverts to the step S16, reading a waveform in the same manner as described in the foregoing.

As a result, since synthesized speech waveforms of "to, nai ta" are generated from the speech element data of the speech waveform memory 108 thereafter, such waveforms are coupled with the synthesized speech waveform of ⌈ne' ko ga, "CAT. WAV" (refer to steps S16 to s25⌋ as already generated. Finally, all synthesized speech waveforms corresponding to the input text are outputted (refer to a step S27 in FIG. 5B).

FIG. 3 is a synthesized speech waveform chart for illustrating the results of conversion processing of the input text.

With the synthesized speech waveform in the figure, there is shown a state wherein a portion of the synthesized speech waveform, corresponding to a voice-related term ⌈ニャ--⌋ which is an onomatopoeic word, is replaced with a natural speech waveform. That is, the natural speech waveform is interpolated in a position of the term corresponding to ⌈ニャ--⌋, and is coupled with the rest of the synthesized speech waveform, thereby forming a synthesized speech waveform for the input text in whole.

In the case where a plurality of waveform file names are interpolated in the phoneme rhythm symbol string, the same processing, that is, retrieval of a waveform from the respective waveform files and coupling of such a waveform with other waveforms already generated, is executed in a position of every interpolation. In the case where none of the waveform file names is interpolated in the phoneme rhythm symbol string, the operation of the rule-based speech synthesizer 104 is the same as that in the case of the conventional system.

The synthesized speech waveform for the input text in whole, completed as described above, is outputted as a synthesized speech from the speaker 130.

With the system 100 according to the invention, portions of the input text, corresponding to onomatopoeic words, can be outputted in an actually recorded sound, respectively, so that a synthesized speech outputted can be a synthesized sound creating a greater sense of realism as compared with a case where the input text in whole is outputted in a synthesized sound, thereby preventing a listener from getting bored or tired of listening.

Second Embodiment

Figure 6:
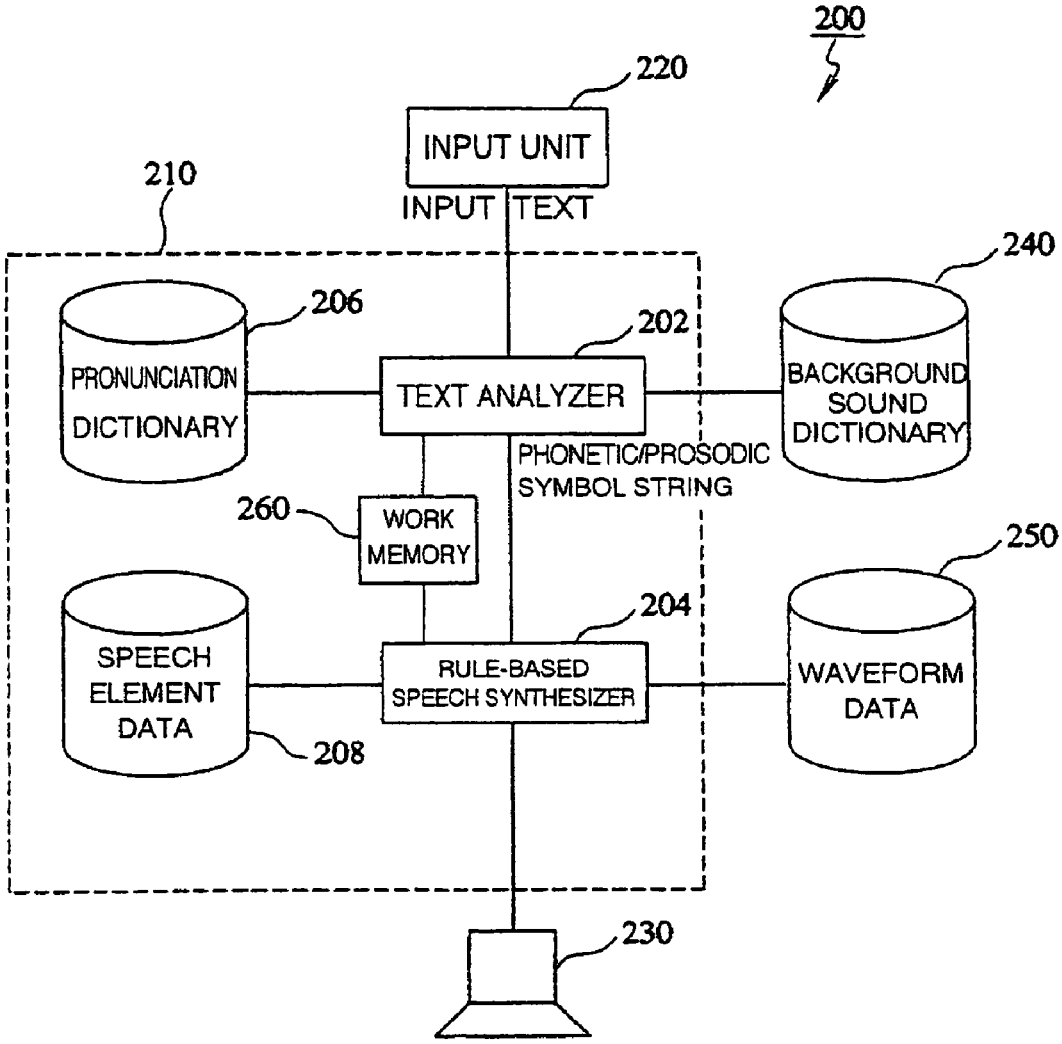
FIG. 6 is a block diagram showing the constitution of a second embodiment of a Japanese-text to speech conversion system according to the invention by way of example.

A second embodiment of a Japanese-text to speech conversion system according to the invention is described hereinafter with reference to FIGS. 6 to 9C. FIG. 6 is a block diagram showing the constitution, similar to that as shown in FIG. 2, of the system according to the second embodiment of the invention. The system 200 as well comprises a conversion processing unit 210, an input unit 220, a phrase dictionary 240, a waveform dictionary 250, and a speaker 230 that are connected in the same way as in the constitution shown in FIG. 2. Further, the conversion processing unit 210 comprises a text analyzer 202, a rule-based speech synthesizer 204, a phonation dictionary 206, a speech waveform memory 208 for storing speech element data, and a first memory 260 for fulfilling the same function as that for the first memory 160 that are connected in the same way as in the constitution shown in FIG. 2.

However, the registered contents of the phrase dictionary 240 and the waveform dictionary 250, respectively, differ from that of parts in the first embodiment, corresponding thereto, and further, the function of the text analyzer 202, and the rule-based speech synthesizer 204, composing the conversion processing unit 210, differs from that of those parts in the first embodiment, corresponding thereto, respectively. More specifically, the conversion processing unit 210 has a function such that, in the case where correlation of a term in a text with a voice-related term registered in the phrase dictionary 140 shows matching therebetween, waveform data corresponding to a relevant voice-related term, registered in the waveform dictionary 250, is superimposed on a speech waveform of the text before outputted.

With the text-to-speech conversion system 200, voice-related terms for expressing background sound conditions are registered in the phrase dictionary 240 connected to the text analyzer 202. The phrase dictionary 240 lists notations of the voice-related terms, that is, notations of background sounds, and waveform file names corresponding to such notations as registered information. Accordingly, the phrase dictionary 240 is constituted as a background sound dictionary.

Table 3 shows the registered contents of the background sound dictionary 240 by way of example. In Table 3, 「しとしと」, 「ざあざあ」, (a notation of various states of rainfall), respectively, 「わいわい」, 「がやがや」, notation of clamorous states), respectively, and so forth, and waveform file names corresponding to such notations are listed by way of example.

TABLE 3

| NOTATION | WAVEFORM FILE NAME |
|---|---|
| しとしと | RAIN 1. WAV |
| ざあざあ | RAIN 2. WAV |
| わいわい | LOUD. WAV |
| がやがや | LOUD. WAV |
| . . . | . . . |

The waveform dictionary 250 stores waveform data obtained from actually recorded sounds, corresponding to the voice-related terms listed in the background sound dictionary 240, as waveform files. The waveform files represent original sound data obtained by actually recording sounds and voices. For example, in a waveform file "RAIN 1. WAV" corresponding to a notation 「しとしと」, an actually recorded speech vaveform obtained by recording a sound of rain falling 「しとしと」 (gently) is stored.

Figure 7:
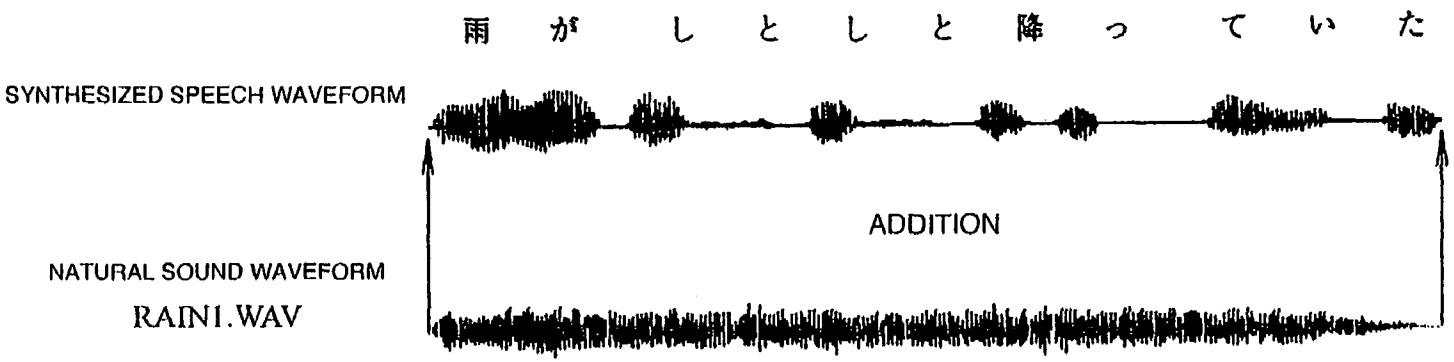
FIG. 7 is a schematic view illustrating an example of superimposing a synthesized speech waveform on the actually recorded speech waveform of a background sound according to the second embodiment.
Figure 8A:
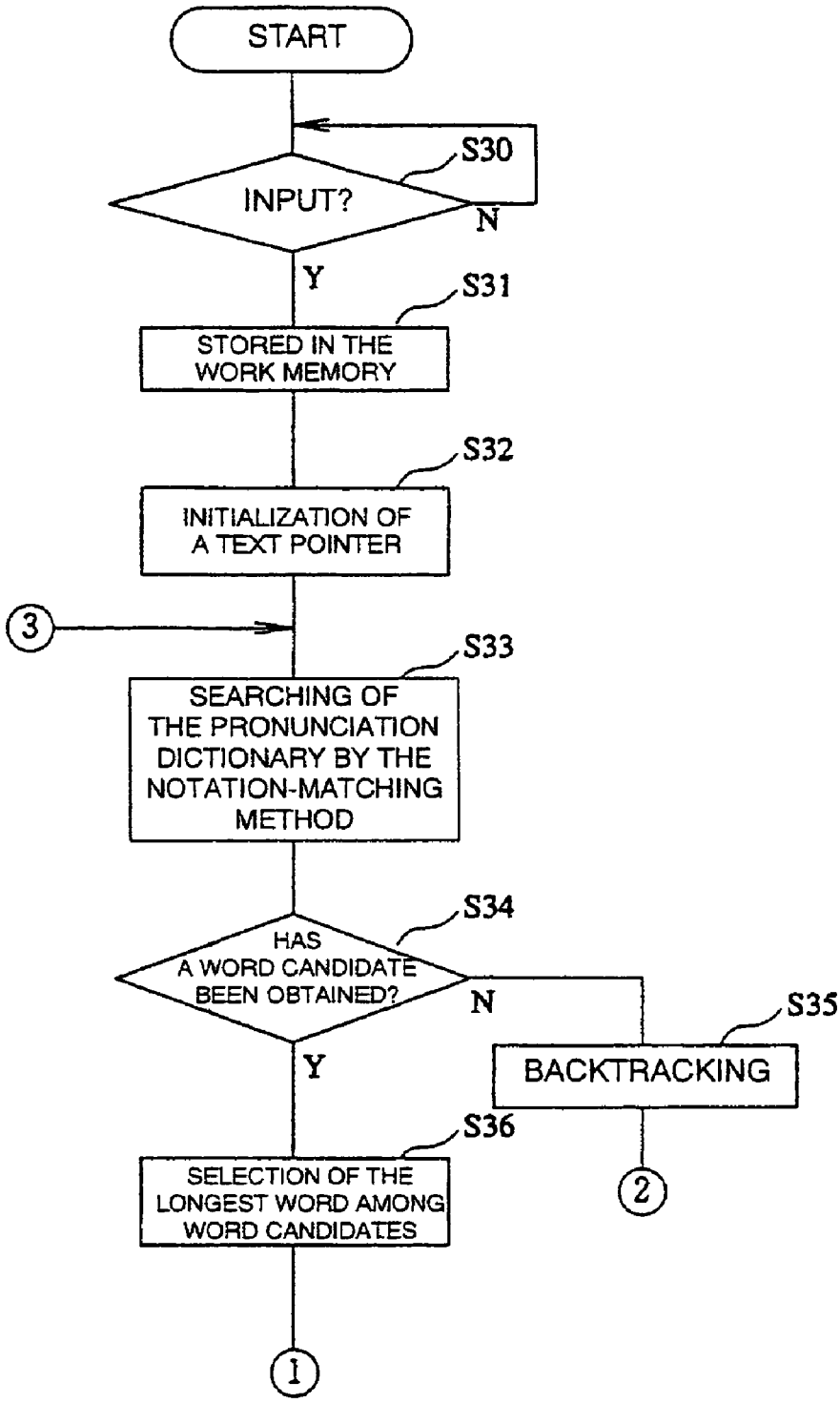
FIGS. 8A, 8B are operation flow charts of a text analyzer according to the second embodiment.
Figure 8B:
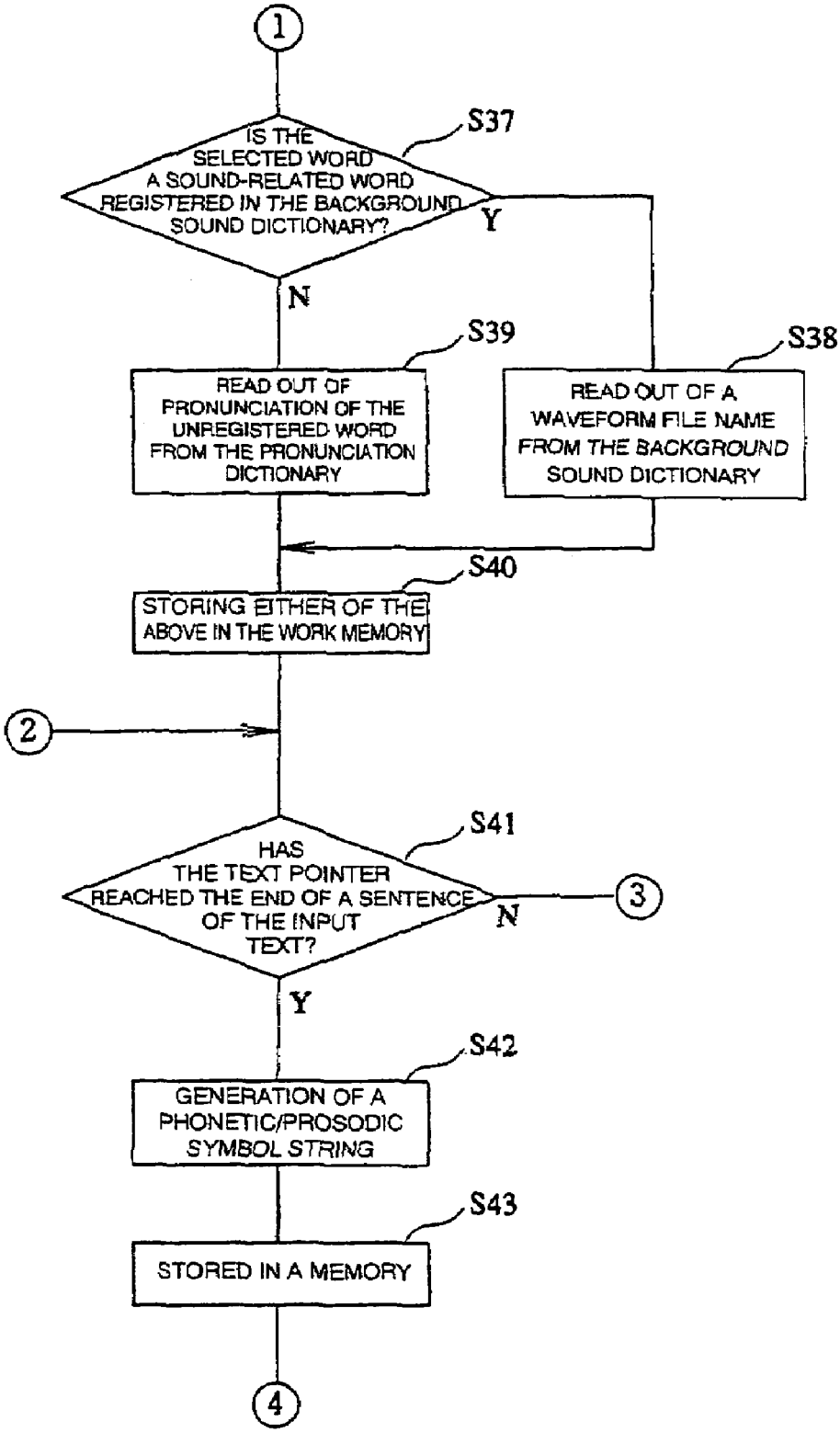

Now, operation of the Japanese-text to speech conversion system constituted as shown in FIG. 6 is described by citing a specific example. FIG. 7 is a schematic view illustrating an example of superimposing a synthesized speech waveform of the text in whole on an actually recorded speech waveform (that is, a natural speech waveform) of a background sound. The figure illustrates an example wherein the synthesized speech waveform of the text in whole and the recorded speech vaveform of the background sound are outputted independently from each other, and concurrently. FIGS. 8A, 8B are operation flow charts of the text analyzer, and FIGS. 9A to 9BC are operation flow charts of the rule-based speech synthesizer.

For example, a case is assumed wherein an input text in Japanese reads 「雨がしとしと降っていた」. The input text is captured by the input unit 220 and inputted to the text analyzer 202, whereupon the input text is divided into respective words by the longest string-matching method in the same manner as described in the first embodiment. Processing for dividing the input text into respective words up to generation of a phoneme rhythm symbol string is executed by taking the same steps as those for the first embodiment described with reference to FIGS. 4A, 4B and FIGS. 5A, 5B. Such processing is described hereinafter.

The text analyzer 202 determines whether or not an input text is inputted (refer to a step S30 in FIG. 8A). Upon verification of input, the input text is stored in the first memory 260 (refer to a step S31 in FIG. 8A).

Subsequently, the input text is divided into respective words by use of the longest string-matching method. Processing by the longest string-matching method is executed as follows:

A text pointer p is initialized by setting the text pointer p at the head of the input text to be analyzed (refer to a step S32 in FIG. 8A).

Subsequently, the phonation dictionary 206 is searched by the text analyzer 202 with the text pointer p set at the head of the input text in order to examine whether or not there exists a word with a notation (heading) matching the input text (the notation-matching method), and satisfying connection conditions (refer to a step S33 in FIG. 8A).

Whether or not there exists words satisfying the connection conditions, that is, whether or not word candidates can be obtained is searched (refer to a step S34 in FIG. 8A). In case that the word candidates can not be found by such searching, the processing backtracks (refer to a step S35 in FIG. 8A), and proceeds to a step S41 as described later on.

Next, in case that the word candidates are obtained, the longest word, that is, term (the term includes various expressions such as a word, locution, and so on) is selected among the word candidates (refer to a step S36 in FIG. 8A). In this case, if there exist a plurality of the word candidates of the same length, auxiliary words are selected preferentially over independent words. Further, in case that there is only one word candidate, such a word is selected as it is.

Subsequently, the background sound dictionary 240 is searched in order to examine whether or not a selected word is among the voice-related terms registered in the background sound dictionary 240 (refer to a step S37 in FIG. 8B). Such searching of the background sound dictionary 240 is executed by the notation-matching method as well.

In the case where the selected word is registered in the background sound dictionary 240, a waveform file name is read out from the background sound dictionary 240, and stored in the first memory 260 together with a notation for the selected word (refer to steps S38 and S40 in FIG. 8B).

On the other hand, in the case where the selected word is an unregistered word which is not registered in the background sound dictionary 240, reading and an accent corresponding to the unregistered word are read out from the phonation dictionary 206, and stored in the first memory 260 (refer to steps S39 and S40 in FIG. 8B).

The text pointer p is advanced by a length of the selected word, and analysis described above is repeated until the text pointer p comes to the end of a sentence of the input text, thereby dividing the input text from the head to the end of a sentence into respective words, that is, respective terms (refer to a step S41 in FIG. 8B).

In case that analysis processing up to the end of the input text is not completed, the processing reverts to the step S33 whereas in case that the analysis processing is completed, reading and an accent of the respective words are read out from the first memory 260, and the input text is rendered into a word-string punctuated by every word, simultaneously reading a waveform file name. In this case, the sentence reading ⌈雨がしとしと降っていた⌋ is punctuated by respective words consisting of ⌈猫|が|ニャー|と|⌋.

Subsequently, in the text analyzer 202, a phoneme rhythm symbol string is generated from the word-string by replacing the background sound in the word-string with a waveform file name while basing other words therein on reading and an accent thereof (refer to a step S42 in FIG. 8B). If the respective words of the input text are expressed in relation to the reading and accent of every word, the input text is turned into a word string of ⌈雨 (a' me)⌋, ⌈が (ga)⌋, ⌈しとしと (shito' shito)⌋, ⌈降っ (fu+ t)⌋, ⌈て (te)⌋, ⌈い (i)⌋, and ⌈た(ta)⌋. What is shown in round brackets is information on the respective words, registered in the phonation dictionary 206, that is, reading and an accent of the respective words.

Thus, by use of the information on the respective words of the word string, registered in the dictionary, that is, the information in the round brackets, the text analyzer 202 generates a phoneme rhythm symbol string of ⌈a' me ga, shito' shito, fu' tte ita⌋. Meanwhile, referring to the background sound dictionary 240, the text analyzer 202 examines whether or not the respective words in the word string are registered in the background sound dictionary 240. Then, as ⌈しとしと (RAIN 1. WAV)⌋ is found registered therein, a waveform file name RAIN 1. WAV:, corresponding thereto, is added to the head of the phoneme rhythm symbol string, thereby converting the same into a phoneme rhythm symbol string of "RAIN 1. WAV: a' me ga, shito' shito, fu' tte ita", and storing the same in the first memory 260 (refer to a step S43 in FIG. 8B). Thereafter, the phoneme rhythm symbol string with the waveform file name attached thereto is sent out to the rule-based speech synthesizer 204.

In the case where a plurality of words representing background sounds registered in the background sound dictionary 240 are found included in the word string, all the waveform file names corresponding thereto are added to the head of the phoneme rhythm symbol string as generated. In the case where none of the words representing background sounds registered in the background sound dictionary 240 is found included in the word string, the phoneme rhythm symbol string as generated is sent out as it is to the rule-based speech synthesizer 204.

On the basis of the phoneme rhythm symbol string of ⌈RAIN 1. WAV: a' me ga, shito' shito, fu' tte ita⌋ as received, the rule-based speech synthesizer 204 reads out relevant speech element data corresponding thereto from the speech waveform memory 208 storing speech element data, thereby generating a synthesized speech waveform. The steps of processing in this case are described hereinafter.

First, reading is executed starting from a symbol string, corresponding to a syllable at the head of the input text. The rule-based speech synthesizer 204 determines whether or not a waveform file name is attached to the head of the phoneme rhythm symbol string representing reading and accents. Since the waveform file name "RAIN 1. WAV" is added to the head of the phoneme rhythm symbol string, a waveform of ⌈a' me ga, shito' shito, fu' tte ita⌋ is generated from the speech waveform memory 208, and subsequently, the waveform of the waveform file "RAIN 1. WAV" is read out from the waveform dictionary 250. The latter waveform, and the waveform of ⌈a' me ga, shito' shito, fu' tte ita⌋ as already generated are outputted concurrently from a starting point of the waveforms, thereby superimposing one of the waveforms on the other before outputting.

In this case, if the waveform of "RAIN 1. WAV" is longer than the waveform of "a' me ga, shito' shito, fu' tte ita", the former is truncated to a length of the latter, and the both are concurrently outputted. In such a case, the synthesized speech waveform can be superimposed on the waveform data on background sounds by such a simple processing as truncation.

Conversely, if the waveform of the waveform file "RAIN 1. WAV" is shorter in length than the waveform of "a' me ga, shito' shito, fu' tte ita", processing is executed such that the former are added up by connecting the same in succession repeatedly until the length of the latter is reached. In this way, it is possible to prevent the waveform data on the background sounds from coming to the end thereof sooner than the synthesized speech waveform comes to the end thereof.

In the case where a plurality of waveform file names are added to the head of the phoneme rhythm symbol string, the same processing as described above, that is, reading of a waveform from waveform files, and addition of the waveform to the waveform already generated, is applied to all of the plurality of the waveform files. For example, in the case where "RAIN 1. WAV: LOUD. WAV:" is added to the head of the phoneme rhythm symbol string, waveforms of both the sound of rainfall and the sound of noises are superimposed on the synthesized speech waveform. In the case where none of the waveform file names is added to the head of the phoneme rhythm symbol string, the operation of the rule-based speech synthesizer 204 is the same as that in the case of the conventional system.

The processing operation described above is executed as follows.

Figure 9A:
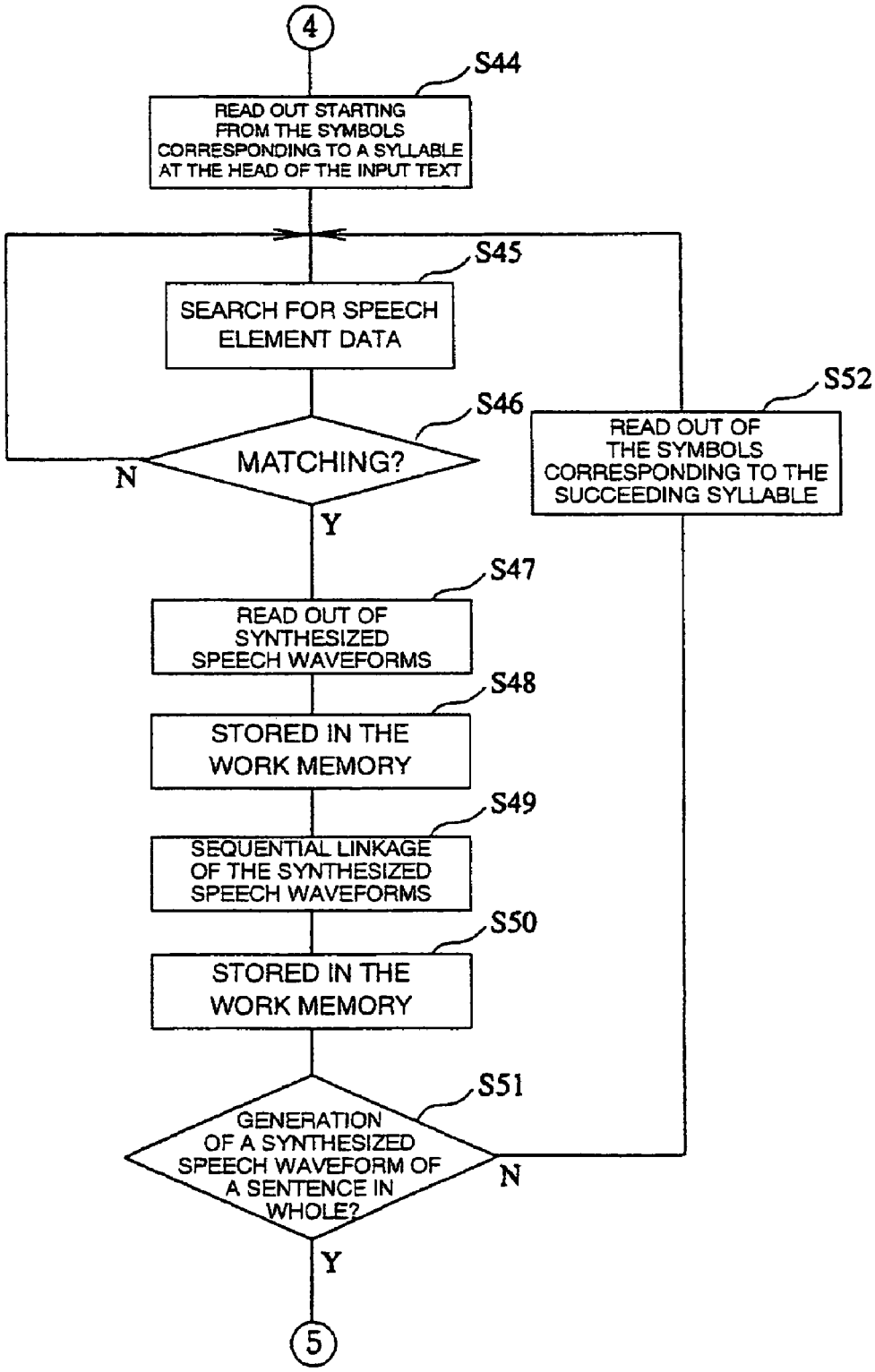
FIGS. 9A to 9C are operation flow charts of a rule-based speech synthesizer according to the second embodiment.

First, read out is executed starting from a symbol string corresponding to a syllable at the head of the input text (refer to a step S44 in FIG. 9A). The rule-based speech synthesizer 204 determines by such reading that a waveform file name is attached to the head of the phoneme rhythm symbol string. As a result, access to the speech waveform memory 208 is made by the rule-based speech synthesizer 204, and speech element data corresponding to respective symbols of the phoneme rhythm symbol string, representing reading and accents, following the waveform file name, are searched for (refer to steps S45 and S46 in FIG. 9A).

In the case where there exist speech element data corresponding to the respective symbols, a synthesized speech waveform corresponding thereto is read out, and stored in the first memory 260 (refer to steps S47 and S48 in FIG. 9A).

The synthesized speech waveforms corresponding to the symbols are linked with each other in the order as read out, the result of which is stored in the first memory 260 (refer to steps S49 and S50 in FIG. 9A).

Subsequently, the rule-based speech synthesizer 204 determines whether or not a synthesized speech waveform of the sentence in whole as represented by the phoneme rhythm symbol string of ⌈a' me ga, shito' shito, fu' tte ita⌋ has been generated (refer to a step S51 in FIG. 9A). In case it is determined as a result that the synthesized speech waveform of the sentence in whole has not been generated as yet, a command to read out a symbol string corresponding to a succeeding syllable is issued (refer to a step S52 in FIG. 9A), and the processing reverts to the step S45.

Figure 9B:
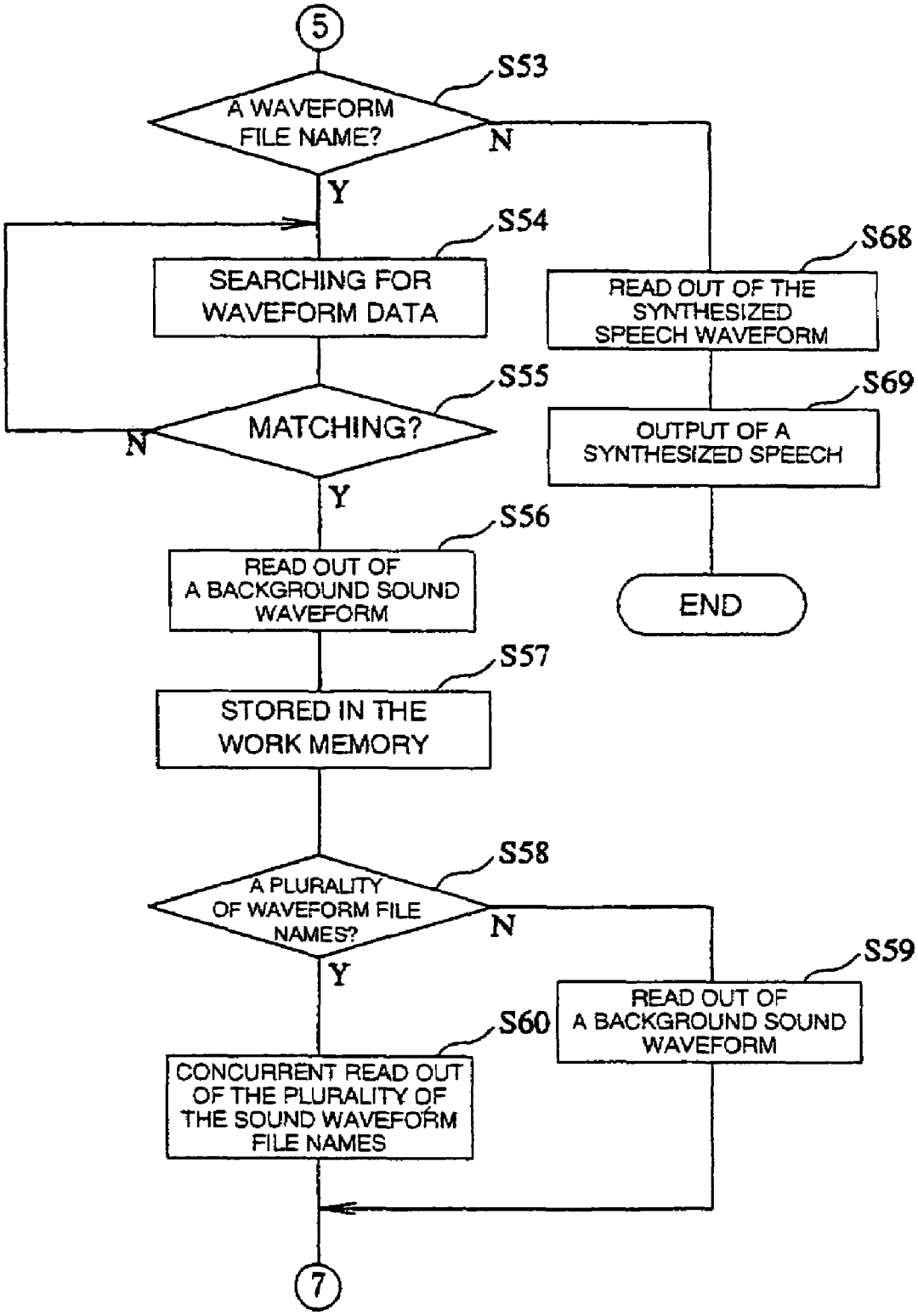

In the case where it is determined that the synthesized speech waveform of the sentence in whole has already been generated, the rule-based speech synthesizer 204 reads out a waveform file name (refer to a step S53 in FIG. 9B). In the case of the embodiment described herein, since there exists a waveform file name, access to the waveform dictionary 250 is made, and waveform data is searched for (refer to steps S54 and S55 in FIG. 9B).

As a result of such searching, a background sound waveform corresponding to a relevant waveform file name is read out from the waveform dictionary 250, and stored in the first memory 260 (refer to steps S56 and S57 in FIG. 9B).

Subsequently, upon completion of read out of the background sound waveform corresponding to the waveform file name, the rule-based speech synthesizer 204 determines whether one waveform file name exists or a plurality of waveform file names exist (refer to a step S58 in FIG. 9B). In the case where only one waveform file name exists, a background sound waveform corresponding thereto is read out from the first memory 260 (refer to a step S59 in FIG. 9B), and in the case where the plurality of the waveform file names exist, all background sound waveforms corresponding thereto are read out from the first memory 260 (refer to a step S60 in FIG. 9B).

Figure 9C:
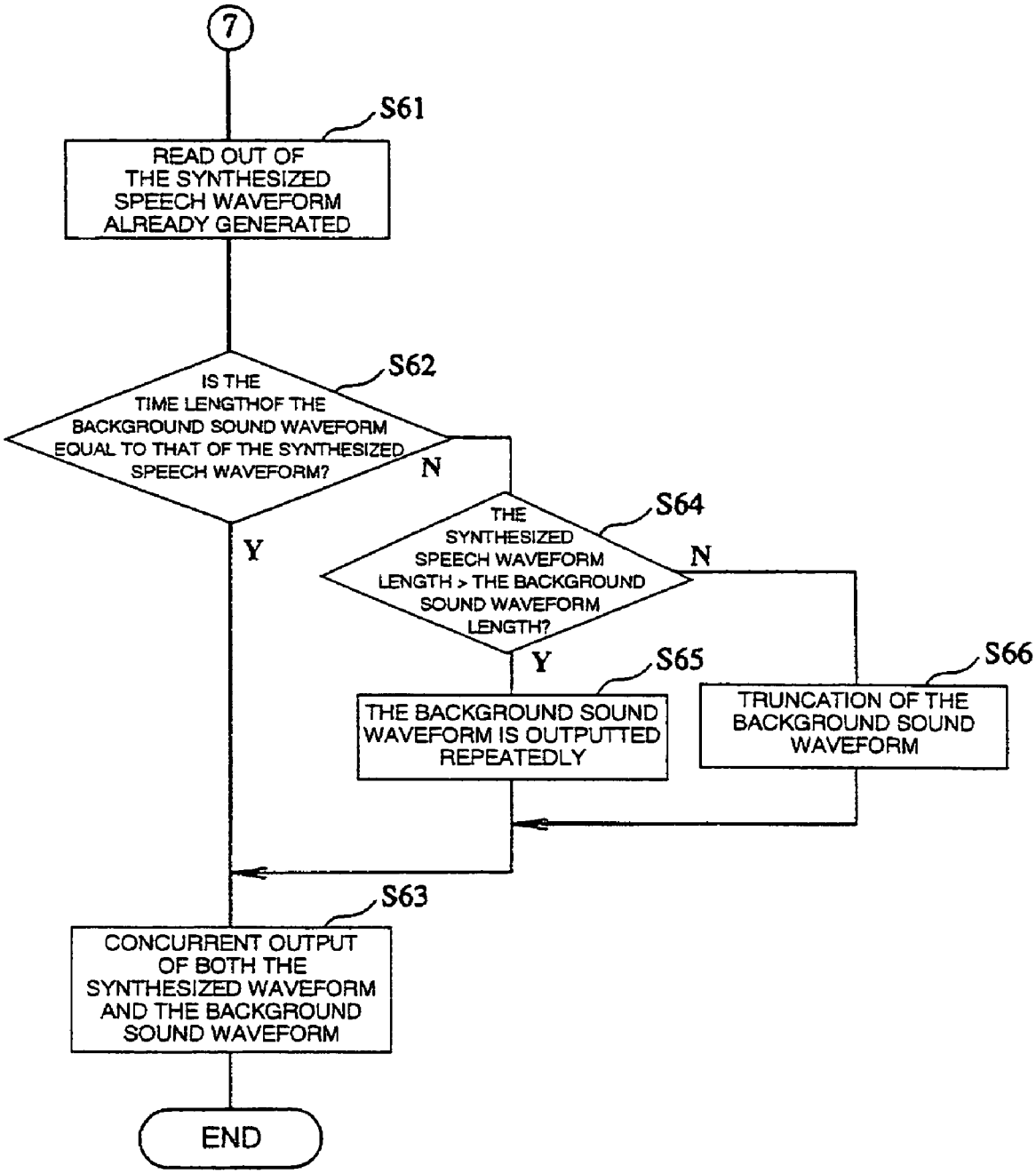

After completion of reading of the background sound waveform (or upon reading of the background sound waveform), the synthesized speech waveform already generated is read out from the first memory 260 (refer to a step S61 in FIG. 9C).

Upon completion of reading of both the background sound waveform and the synthesized speech waveform, a length of the background sound waveforms is compared with that of the synthesized speech waveform (refer to a step S62 in FIG. 9C).

In case that a time length of the background sound waveform is equal to that of the synthesized speech waveform, both the background sound waveform and the synthesized speech waveform are outputted in parallel in time, that is, concurrently from the rule-based speech synthesizer 204.

In case that the time length of the background sound waveform is not equal to that of the synthesized speech waveform, whether or not the synthesized speech waveform is longer than the background sound waveform is determined (refer to a step S64 in FIG. 9C). In case that the background sound waveform is shorter than the synthesized speech waveform, the background sound waveform is outputted repeatedly upon start of outputting the synthesized speech waveform until the time length of the background sound waveform matches that of the synthesized speech waveform (refer to steps S65 and S63 in FIG. 9C).

On the other hand, in case that the background sound waveform is longer than the synthesized speech waveform, the background sound waveform which is truncated to the length of the synthesized speech waveform is outputted upon start of outputting the synthesized speech waveform (refer to steps S66 and S63 in FIG. 9C).

Thus, it is possible to output both the background sound waveform and the synthesized speech waveform that are superimposed on each other from the rule-based speech synthesizer 204 to the speaker 230.

Further, in the case where a waveform file name is not attached to the head of the phoneme rhythm symbol string since the voice-related term concerning the background sound is not included in the input text, the processing proceeds from the step S37 to the step S39. As there exists no waveform file name, the rule-based speech synthesizer 204 reads out the synthesized speech waveform only in the step S53, and outputs a synthesized speech only (refer to steps S68 and S69 in FIG. 9B).

FIG. 7 shows an example of superimposition of waveforms. In the case of this embodiment, there is shown a state wherein the natural speech waveform of the background sound is outputted at the same time the synthesized speech waveform of ⌈雨がしとしと降っていた⌋ is outputted. That is, during an identical time period from the starting point of the synthesized speech waveform to the end point thereof, the natural speech waveform of the background sound is outputted.

A synthesized speech waveform of the input text in whole, thus generated, is outputted from the speaker 230.

With the use of the system 200 according to this embodiment of the invention, an actually recorded sound can be outputted as the background sound against the synthesized speech, and thereby the synthesized speech outputted can give a synthesized sound creating a greater sense of realism as compared with a case wherein the input text in whole is outputted in a synthesized sound, so that a listener will not get bored or tired of listening. Further, with the system 200, it is possible through simple processing to superimpose waveform data of actually recorded sounds such as background sound on the synthesized speech waveform of the input text.

Third Embodiment

Figure 10:
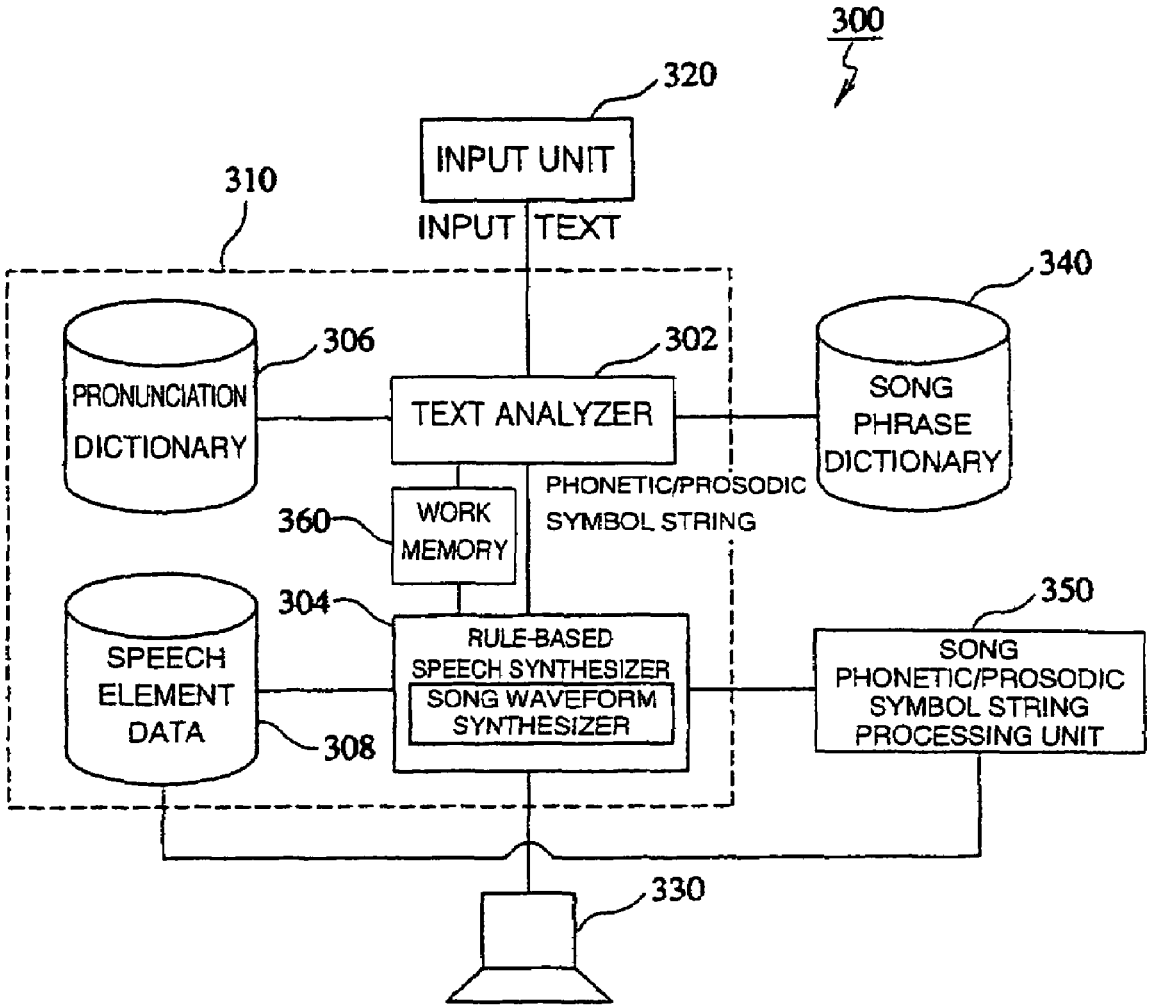
FIG. 10 is a block diagram showing the constitution of a third embodiment of a Japanese-text to speech conversion system according to the invention by way of example.

A third embodiment of a Japanese-text to speech conversion system according to the invention is described hereinafter with reference to FIGS. 10 to 13. FIG. 10 is a block diagram showing the constitution, similar to that shown in FIG. 2, of the system according to this embodiment. The system 300 as well comprises a conversion processing unit 310, an input unit 320, a phrase dictionary 340, and a speaker 330 that are connected in the same way as in the constitution shown in FIG. 2. Further, the conversion processing unit 310 comprises a text analyzer 302, a rule-based speech synthesizer 304, a phonation dictionary 306, a speech waveform memory 308 for storing speech element data, and a first memory 360 for fulfilling the same function as that of the first memory 160 previously described that are connected in the same way as in the constitution shown in FIG. 2.

With the system 300, however, the registered contents of the phrase dictionary 340 differ from that of the part corresponding thereto, in the first and second embodiments, respectively, and further, the function of the text analyzer 302 and the rule-based speech synthesizer 304, composing the conversion processing unit 310, respectively, differs somewhat from that of parts corresponding thereto, in the first and second embodiments, respectively.

In the case of the system 300, a song phrase dictionary is installed as the phrase dictionary 340. In the song phrase dictionary 340 connected to the text analyzer 302, a notation for respective song phrases, and a song phoneme rhythm symbol string, corresponding to each of the respective notations, are listed. The song phoneme rhythm symbol string refers to a character string describing lyrics and a musical score, and, for example, ⌈ア c c 2⌋ indicates generation of a sound "ア" (a) at a pitch c (do) for a duration of a half note.

Further, in the case of the system 300, a song phoneme rhythm symbol string processing unit 350 is installed so as to be connected to the rule-based speech synthesizer 304. The song phoneme rhythm symbol string processing unit 350 is connected to the speech waveform memory 308 as well. The song phoneme rhythm symbol string processing unit 350 is used for generation of a synthesized speech waveform of singing voices from speech element data of the speech waveform memory 308 by analyzing relevant song phoneme rhythm symbol strings.

Table 4 shows the registered contents of the song phrase dictionary 340 by way of example. In Table 4, a notation of songs such as "あんたがたどこさ", "さくらさくら", and "ずいずいずっころばし", and so forth, respectively, and a song phoneme rhythm symbol string corresponding to the respective notations are shown by way of example.

TABLE 4

| NOTATION | song phonetic/prosodic symbol string |
|---|---|
| あんたがたどこさ | ア d16 ン d8 タ d16 ガ d8. タ f16 ド g8. コ f16 サ g4 |
| さくらさくら | サ a4 ク a4 ラ b2 サ a4 ク a4 ラ b2 |
| ずいずいずっころばし | ズ d8. イ e18 ズ f8. イ f16 ズ e8 コ e16 ロ e16 バ d8. シ d16 |
| — | — |

In the song phoneme rhythm symbol string processing unit 350, song phoneme rhythm symbol strings inputted thereto are analyzed. When linking a waveform of, for example, a syllable ⌈ア (a)⌋ of the previously described ⌈ア cc 2⌋ with a waveform of a preceding waveform by such analytical processing, the waveform of the syllable ⌈ア (a)⌋ is linked such that a sound thereof will be at a pitch c (do) and a duration of the sound will be a half note. That is, by use of an identical speech element data, it is possible to form both a waveform of ⌈ア (a)⌋ generated in the normal manner and a waveform of ⌈ア (a)⌋ of a singing voice. In other words, in the song phoneme rhythm symbol strings, a syllable with a symbol such as ⌈c 2⌋ attached thereto forms a speech waveform of a singing voice while a syllable without such a symbol attached thereto forms a speech waveform of a normally generated sound.

The conversion processing unit 310 collates lyrics in a text with registered lyrics as registered in the song phrase dictionary 340, and, in the case where the former matches the latter, outputs a speech waveform converted on the basis of a song phoneme rhythm symbol string paired with the relevant registered lyrics registered in the song phrase dictionary 340 as a waveform of the lyrics.

Figure 11:
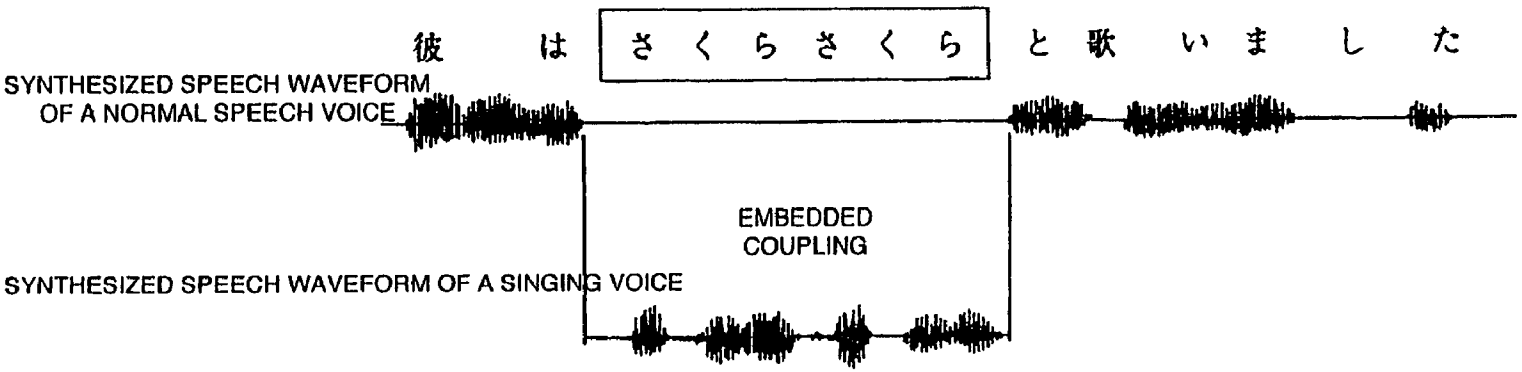
FIG. 11 is a schematic view illustrating an example of coupling a synthesized speech waveform with the synthesized speech waveform of a singing voice according to the third embodiment.
Figure 12A:
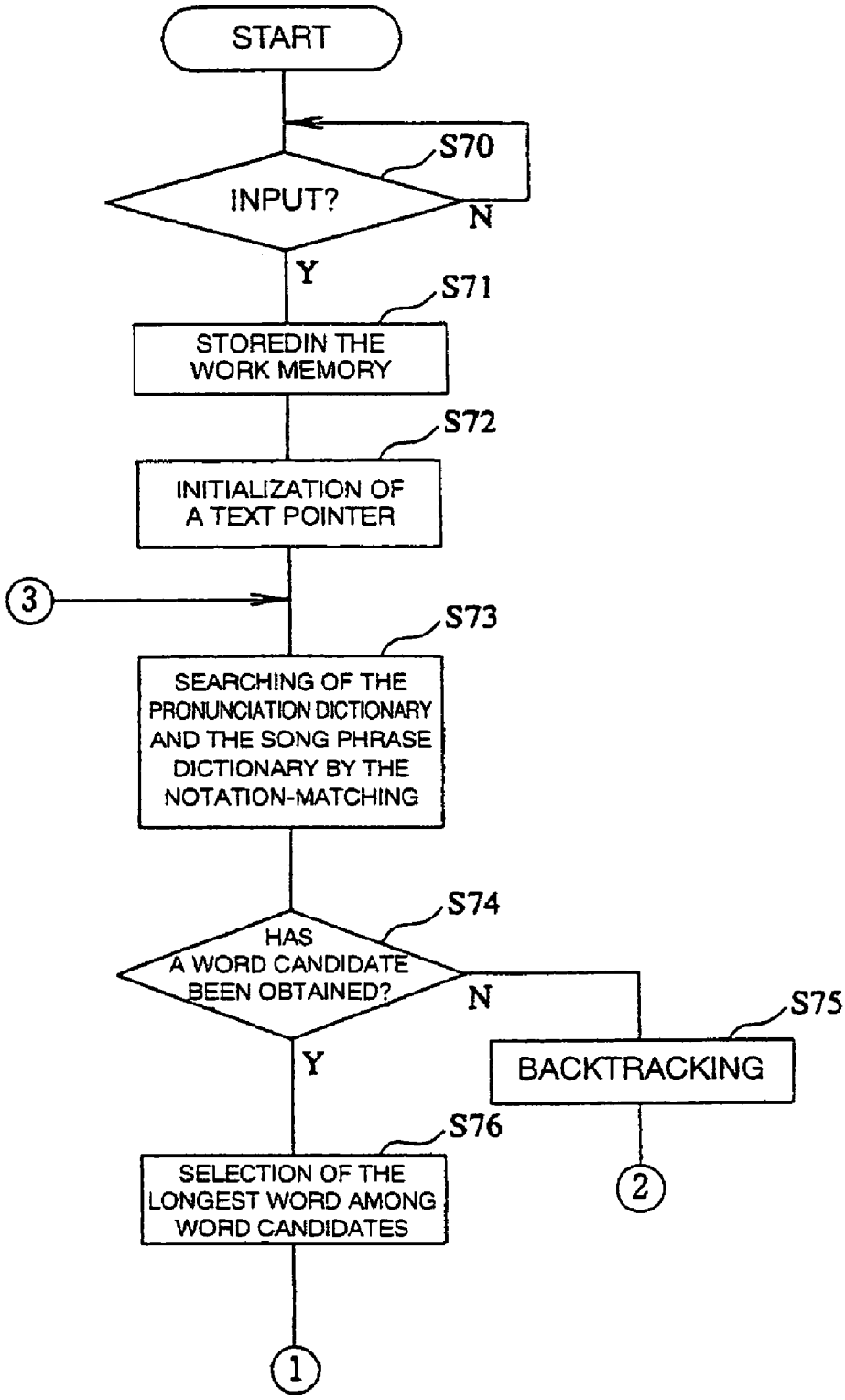
FIGS. 12A, 12B are operation flow charts of a text analyzer according to the third embodiment.
Figure 12B:
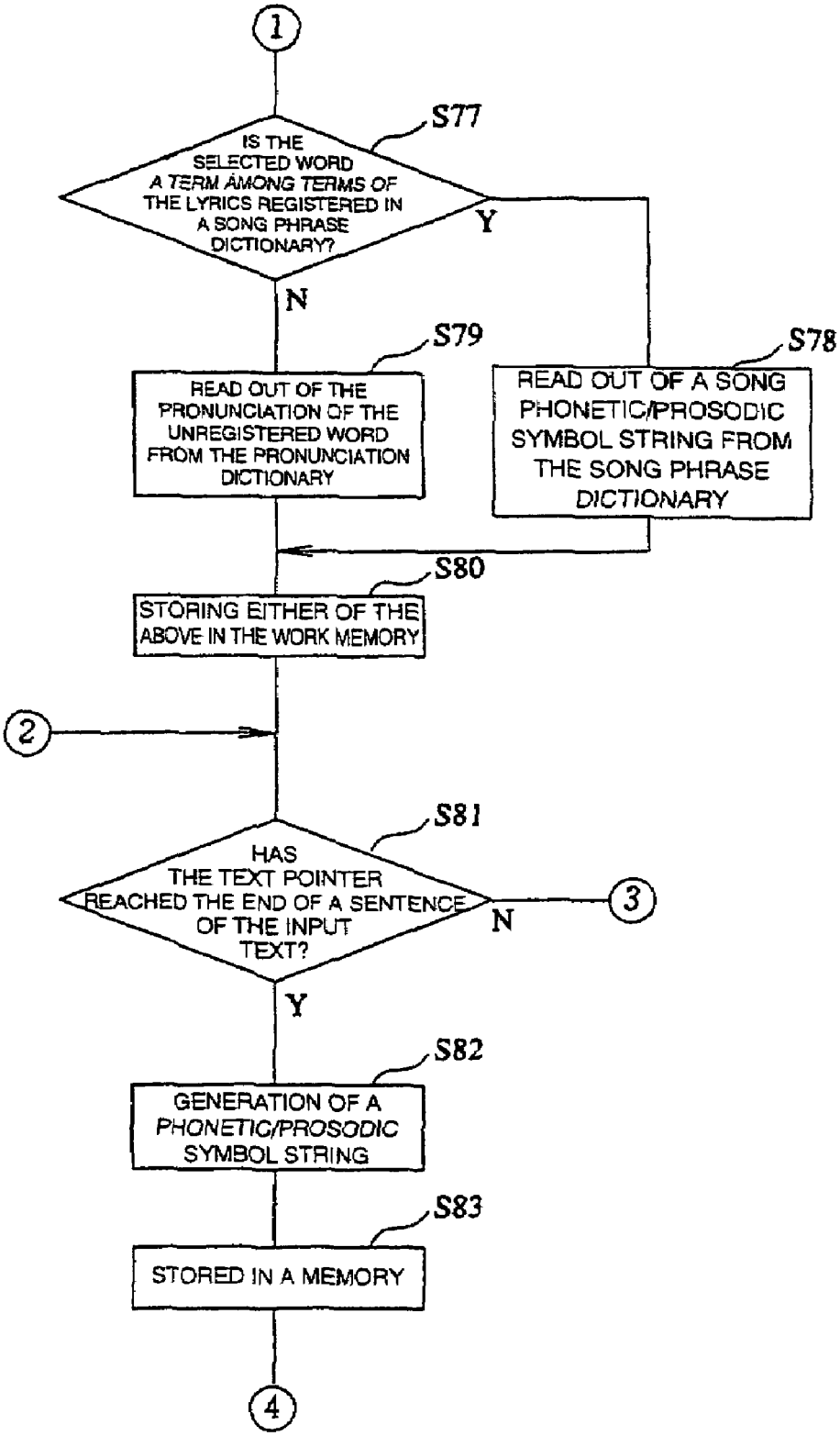
Figure 13:
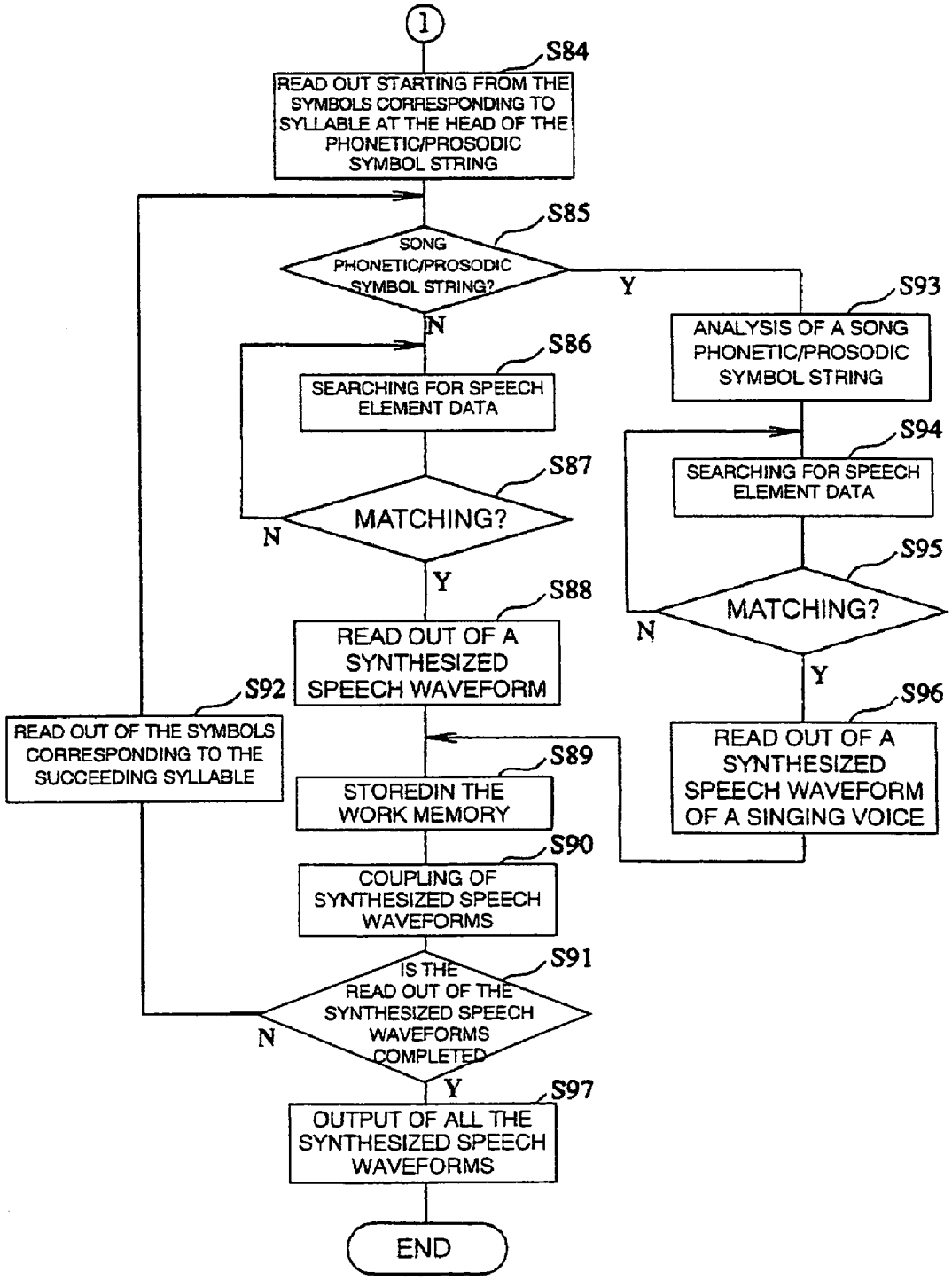
FIG. 13 is operation flow chart of a rule-based speech synthesizer according to the third embodiment.

Now, operation of the Japanese-text to speech conversion system 300 constituted as shown in FIG. 10 is described by citing a specific example. FIG. 11 is a view illustrating an example of coupling a synthesized speech waveform of portions of the text, excluding the lyrics, with a synthesized speech waveform of a singing voice. The figure illustrates an example wherein the synthesized speech waveform of the singing voice in place of a synthesized speech waveform corresponding to the lyrics in the text, is interpolated in the synthesized speech waveform of the portions of the text, and coupled therewith, thereby outputting an integrated synthesized speech waveform. FIGS. 12A, 12B are operation flow charts of the text analyzer 302, and FIG. 13 is an operation flow chart of the rule-based speech synthesizer 304.

For example, a case is assumed wherein an input text in Japanese reads ⌈彼はさくらさくらと歌いました⌋. The input text is captured by the input unit 320 and inputted to the text analyzer 302, whereupon processing of dividing the input text into respective words by the longest string-matching method in the same manner as described in the first embodiment is executed. For processing from dividing the input text into respective words up to generation of a phoneme rhythm symbol string, the same steps as those described with reference to FIGS. 4A, 4B are taken, and these steps are described hereinafter.

The text analyzer 302 determines whether or not an input text is inputted (refer to a step S70 in FIG. 12A). Upon verification of input, the input text is stored in the first memory 360 (refer to a step S71 in FIG. 12A).

Subsequently, the input text is divided into respective words by use of the longest string-matching method. Processing by the longest string-matching method is executed as follows:

A text pointer p is initialized by setting the text pointer p at the head of the input text to be analyzed (refer to a step S72 in FIG. 12A).

Subsequently, the phonation dictionary 306 and the song phrase dictionary 340 are searched by the text analyzer 302 with the text pointer p set at the head of the input text in order to examine whether or not there exists a word with a notation (heading) matching the input text (the notation-matching method), and satisfying connection conditions (refer to a step S73 in FIG. 12A).

Whether or not words satisfying the connection conditions exist in the phonation dictionary 306 or the song phrase dictionary 340, that is, whether or not word candidates can be obtained is searched (refer to a step S74 in FIG. 12A). In case the word candidates can not be found by such searching, the processing backtracks (refer to a step S75 in FIG. 12A), and proceeds to a step S81 as described later on.

Next, in the case where the word candidates are obtained, the longest word, that is, a term (the term includes various expressions such as a word, locution, and so on) is selected among the word candidates (refer to a step S76 in FIG. 12A). In this case, if there exist a plurality of the word candidates of the same length, auxiliary words are selected preferentially over independent words. Further, in case that there is only one word candidate, such a word is selected as it is.

Subsequently, the song phrase dictionary 340 is searched in order to examine whether or not a selected word is among terms of the lyrics registered in the song phrase dictionary 340 (refer to a step S77 in FIG. 12B). Such searching as well is executed against the song phrase dictionary 340 by the notation-matching method.

In the case where a word with an identical notation, that is, a term of the lyrics is registered in both the phonation dictionary 306 and the song phrase dictionary 340, the word, that is, the term of the lyrics, registered in the song phrase dictionary 340 is selected for use.

In the case where the selected word is registered in the song phrase dictionary 340, a song phoneme rhythm symbol string corresponding to the selected word is read out from the song phrase dictionary 340, and stored in the first memory 360 together with a notation of the selected word (refer to steps S78 and S80 in FIG. 12B).

On the other hand, in the case where the selected word is an unregistered word which is not registered in the song phrase dictionary 340, reading and an accent corresponding to the unregistered word are read out from the phonation dictionary 306, and stored in the first memory 360 (refer to steps S79 and S80 in FIG. 12B).

The text pointer p is advanced by a length of the selected word, and analysis described above is repeated until the text pointer p comes to the end of a sentence of the input text, thereby dividing the input text from the head of the sentence to the end thereof into respective words, that is, respective terms (refer to a step S81 in FIG. 12B).

In case that analysis processing up to the end of the input text is not completed, the processing reverts to the step S73 whereas in case that the analysis processing is completed, reading and an accent of the respective words are read out from the first memory 360, and the input text is rendered into a word-string punctuated by every word, simultaneously reading out a song phoneme rhythm symbol string. In this case, the sentence reading 「彼はさくらさくらと歌いました」 is punctuated by respective words consisting of 「彼はさくらさくらと歌いました」.

Subsequently, in the text analyzer 302, a phoneme rhythm symbol string is generated from the word-string by replacing the lyrics in the word-string with the song phoneme rhythm symbol string while basing other words therein on reading and an accent thereof, and stored in the first memory 360 (refer to steps S82 and S83 in FIG. 12B).

If the respective words of the input text are expressed in relation to the reading and an accent of every word, the input text is divided into word strings of 「彼 (ka' re)」, 「は (wa)」, 「さくらさくら (sa a4 ku a4 ra b2 sa a4 ku a4 ra b2)」, 「と (to)」, 「歌い(utai)」 「まし (ma' shi)」, and 「た (ta)」. What is shown in round brackets is information on the respective words, registered in the dictionaries, representing reading and an accent in the case of words in the phonation dictionary 306, and a song phoneme rhythm symbol string in the case of words in the song phrase dictionary 340. By use of the information on the respective words of the word string, registered in the dictionaries, that is, the information in the round brackets, the text analyzer 302 generates a phoneme rhythm symbol string of 「ka' re wa, sa a4 ku a4 ra b2 sa a4 ku a4 ra b2 to, utaima' shita」, and sends the same to the rule-based speech synthesizer 304.

The rule-based speech synthesizer 304 reads out the phoneme rhythm symbol string of 「ka' re wa, sa a4 ku a4 ra b2 sa a4 ku a4 ra b2 to, utaima' shita」 from the first memory 360, starting in sequence from a symbol string corresponding to a syllable at the head of the phoneme rhythm symbol string (refer to a step S84 in FIG. 13).

The rule-based speech synthesizer 304 determines whether or not a symbol string as read out is a song phoneme rhythm symbol string, that is, a phoneme rhythm symbol string corresponding to the lyrics (refer to a step S85 in FIG. 13). If it is determined as a result that the symbol string as read out is not the song phoneme rhythm symbol string, access to the speech waveform memory 308 is made by the rule-based speech synthesizer 304, and speech element data corresponding to the relevant symbol string are searched for, which is continued until relevant speech element data are found (refer to steps S86 and S87 in FIG. 13).

Upon retrieval of the speech element data corresponding to the relevant symbol string, a synthesized speech waveform corresponding to respective speech element data is read out from the speech waveform memory 308, and stored in the first memory 360 (refer to steps 88 and S89 in FIG. 13).

In the case where synthesized speech waveforms corresponding to syllables have already been stored in the first memory 360, synthesized speech waveforms are coupled one after another (refer to a step S90 in FIG. 13).

In case that read out of synthesized speech waveforms for the whole sentence of the text is incomplete (refer to a step S91 in FIG. 13), a symbol string corresponding to a succeeding syllable is read out (refer to a step S92 in FIG. 13), and the processing reverts to the step S85.

By executing such processing as described above with respect to the symbol strings of 「彼 (ka' re)」, and 「は (wa)」, respectively, a synthesized speech waveform in a conventional declamation style is formed as for 「ka' re wa」. The synthesized speech waveform as formed is delivered to the rule-based speech synthesizer 304, and stored in the first memory 360.

Subsequently, with respect to the symbol strings of 「sa a4 ku a4 ra b2 sa a4 ku a4 ra b2」, read out is executed (refer to a step S92 in FIG. 13).

If it is determined that the phoneme rhythm symbol string of 「sa a4 ku a4 ra b2 sa a4 ku a4 ra b2」 is a song phoneme rhythm symbol string as a result of the determination on whether or not the symbol string as read out is the song phoneme rhythm symbol string, which is made in the step S85, the song phoneme rhythm symbol string is sent out to the song phoneme rhythm symbol string processing unit 350 for analysis of the same (refer to a step S93 in FIG. 13).

In the song phoneme rhythm symbol string processing unit 350, the song phoneme rhythm symbol string of 「sa a4 ku a4 ra b2 sa a4 ku a4 ra b2」 is analyzed. In the processing unit 350, analysis is executed with respect to the respective symbol strings. For example, since 「sa a4」 has a syllable 「sa」 with a symbol 「a4」 attached thereto, a synthesized speech waveform is generated for the syllable as a singing voice, and a pitch and a duration of a sound thereof will be those as specified by 「a4」.

Based on the result of such analysis of the respective symbol strings, access to the speech waveform memory 308 is made by the rule-based speech synthesizer 304, and speech element data corresponding to the result of the analysis are searched for (refer to steps S94 and S95 in FIG. 13). As a result, a synthesized speech waveform of the singing voice is formed from speech element data corresponding to the respective symbols (refer to a step S96 in FIG. 13).

The synthesized speech waveform of the singing voice is delivered to the rule-based speech synthesizer 304, and stored in the first memory 360 (refer to a step S89 in FIG. 13). The rule-based speech synthesizer 304 couples the synthesized speech waveform of the singing voice as received with the synthesized speech waveform of ⌈ka' re wa⌋ (refer to a step S90 in FIG. 13).

Thereafter, processing from the above-described step S85 to the step S90 is executed in sequence with respect to the symbol strings of ⌈to, utai ma' shi ta⌋. As a result of such processing, a synthesized speech waveform in a conventional declamation style can be generated from speech element data of the speech waveform memory 308. The synthesized speech waveform is coupled with the synthesized speech waveform of ⌈ka' re wa, sa a4 ku a4 ra b2 sa a4 ku a4 ra b2⌋.

In this connection, in case that a plurality of song phoneme rhythm symbol strings are interpolated in the phoneme rhythm symbol strings, the same processing, that is, generation of a synthesized speech waveform for every singing voice, and coupling thereof with synthesized speech waveforms already generated, is executed at every spot of interpolation.

In case that none of the song phoneme rhythm symbol strings is interpolated in the phoneme rhythm symbol strings, the operation of the rule-based speech synthesizer 304 is the same as that in the case of the conventional system.

An example of synthesized speech waveforms obtained as a result of the processing described in the foregoing is as shown in FIG. 11.

In FIG. 11, portions of the text reading ⌈彼はさくらさくらと歌いました⌋, corresponding to ⌈彼は⌋ and と歌いました⌋, are outputted in the form of a synthesized speech waveform in the conventional declamation style while a portion thereof, corresponding to ⌈さくらさくら⌋, represents the lyrics, and consequently, the portion corresponding to the lyrics is outputted in the form of a synthesized speech waveform of a singing voice. That is, the portion of the synthesized speech waveform, representing the singing voice of ⌈さくらさくら⌋, is embedded between the portions of the synthesized speech waveform, in the conventional declamation style, for ⌈彼は⌋ and ⌈と歌いました⌋, respectively, before outputted to the speaker 330 (refer to a step S97 in FIG. 13).

Synthesized speech waveforms for the input text in whole, formed in this way, are outputted from the speaker 330.

With the use of the system 300 according to the invention, it is possible to cause song phrase portions of the input text to be actually sung so as to be heard by a listener, and consequently, a synthesized speech becomes more appealing to the listener as compared with a case wherein the input text in whole is read in the conventional declamation style, preventing the listener from getting bored or tired of listening to the synthesized speech.

Fourth Embodiment

Figure 14:
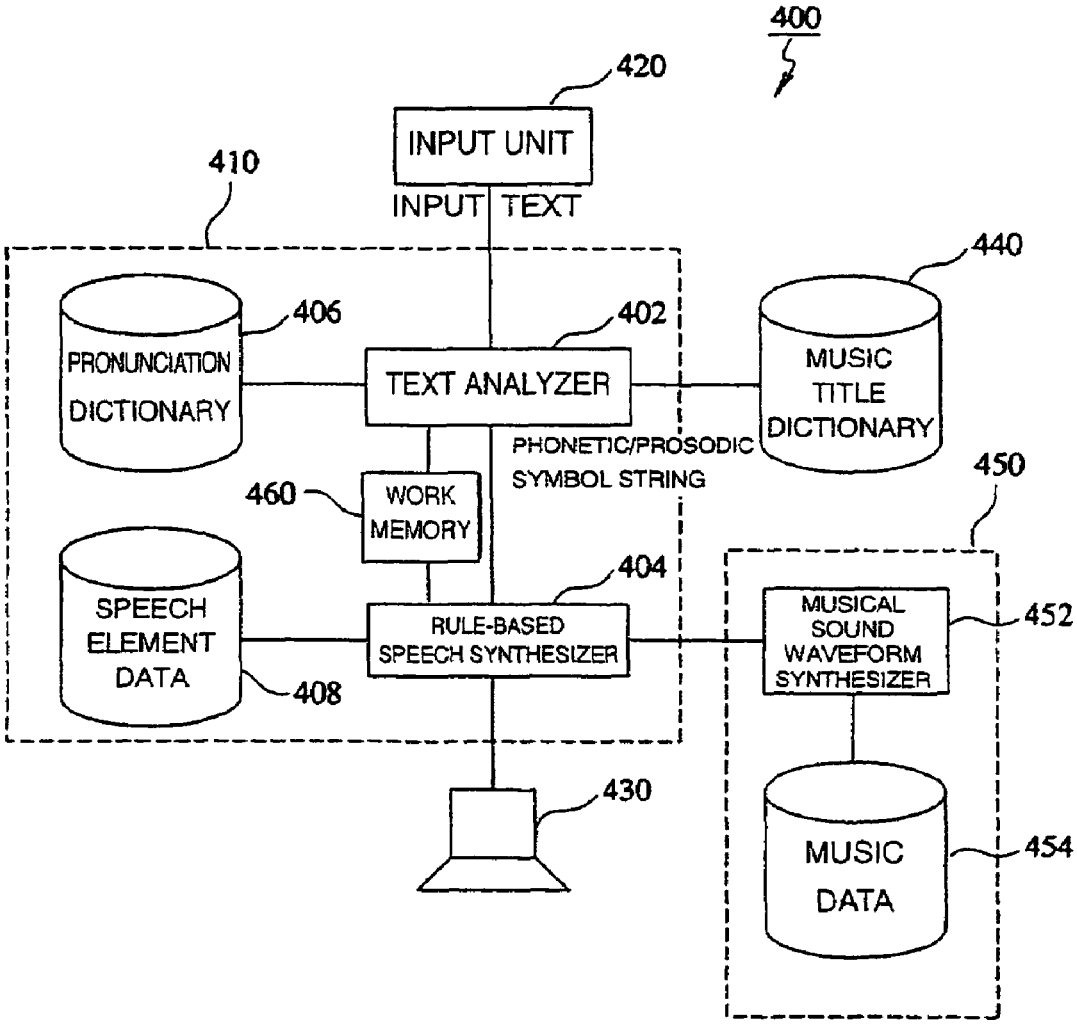
FIG. 14 is a block diagram showing the constitution of a fourth embodiment of a Japanese-text to speech conversion system according to the invention by way of example.

A fourth embodiment of a Japanese-text to speech conversion system according to the invention is described hereinafter with reference to FIGS. 14 to 17C. FIG. 14 is a block diagram showing the constitution of the system according to this embodiment by way of example. The system 400 as well comprises a conversion processing unit 410, an input unit 420, and a speaker 430 that are connected in the same way as in the constitution shown in FIG. 2.

Further, the conversion processing unit 410 comprises a text analyzer 402, a rule-based speech synthesizer 404, a phonation dictionary 406, a speech waveform memory 408 for storing speech element data, and a first memory 460 for fulfilling the same function as that of the first memory 160 previously described that are connected in the same way as in the constitution shown in FIG. 2.

In the case of the system 400, however, a music title dictionary 440 connected to the text analyzer 402, and a musical sound waveform generator 450 connected to the rule-based speech synthesizer 404 are installed.

Music titles are previously registered in the music title dictionary 440. That is, the music title dictionary 440 lists a notation of music titles, and a music file name corresponding to the respective notations. Table 5 is a table showing the registered contents of the music title dictionary 440 by way of example. In Table 5, a notation of music titles such as ⌈仰げば尊し⌋, and ⌈七つの子⌋, and so forth, respectively, and a music file name corresponding to the respective notations are shown by way of example.

TABLE 5

| NOTATION | MUSIC FILE NAME |
|---|---|
| 仰げば尊し | AOGEBA. MID |
| 君が代 | KIMIGAYO. MID |
| 七つの子 | NANATSU. MID |
| . . . | . . . |

The musical sound waveform generator 450 has a function of generating a musical sound waveform corresponding to respective music titles, and comprises a musical sound converter 452, and a music dictionary 454 connected to the musical sound converter 452.

Music data for use in performance, corresponding to respective music titles registered in the music title dictionary 440, are previously registered in the music dictionary 454. That is, an actual music file corresponding to the respective music titles listed in the music title dictionary 440 is stored in the music dictionary 454. The music files represent standardized music data in a form like MIDI (Musical Instrument Digital Interface). That is, MIDI is the communication protocol common throughout the world with the aim of communication among electronic musical instruments. For example, MIDI data for playing ⌈君が代⌋ are stored in ⌈KIMIGAYO. MID⌋. The musical sound converter 452 has a function of converting music data (MIDI data) into musical sound waveforms and delivering the same to the rule-based speech synthesizer 404.

The text analyzer 402, and the rule-based speech synthesizer 404, composing the conversion processing unit 410, have a function, respectively, somewhat different from that of those parts in the first to third embodiments, respectively, corresponding thereto. That is, the conversion processing unit 410 has a function of converting music titles in a text into speech waveforms. The conversion processing unit 410 has a function such that in the case where a music title in the text matches a registered music title as registered in the music title dictionary 440 upon correlation of the former with the latter, a speech waveform obtained by converting music data corresponding to a relevant music title, registered in the musical sound waveform generator 450, into a musical sound waveform, is superimposed on a speech waveform of the text before outputted.

Figure 15:
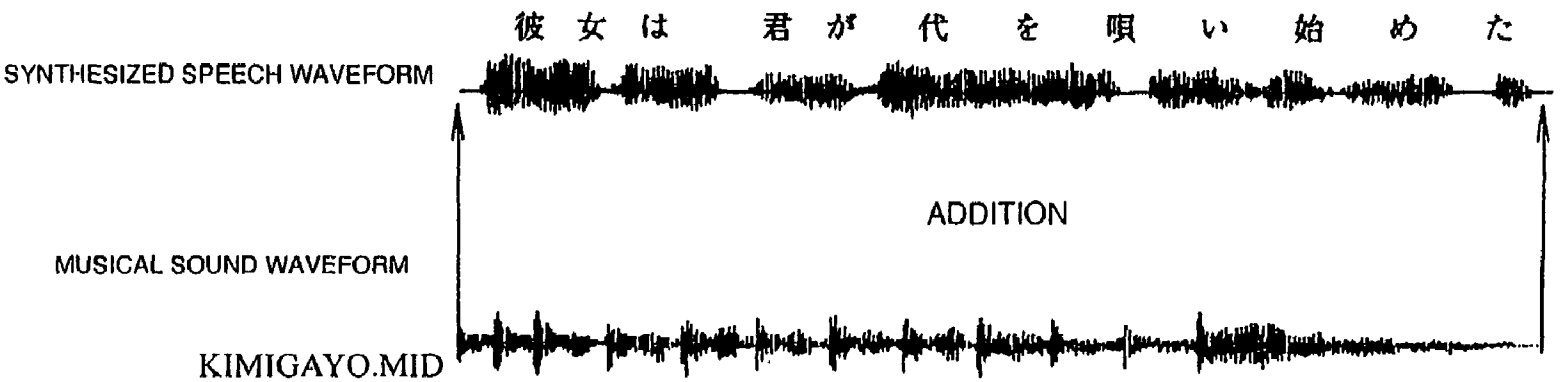
FIG. 15 is a schematic view illustrating an example of superimposing a synthesized speech waveform on a musical sound waveform according to the fourth embodiment.
Figure 16A:
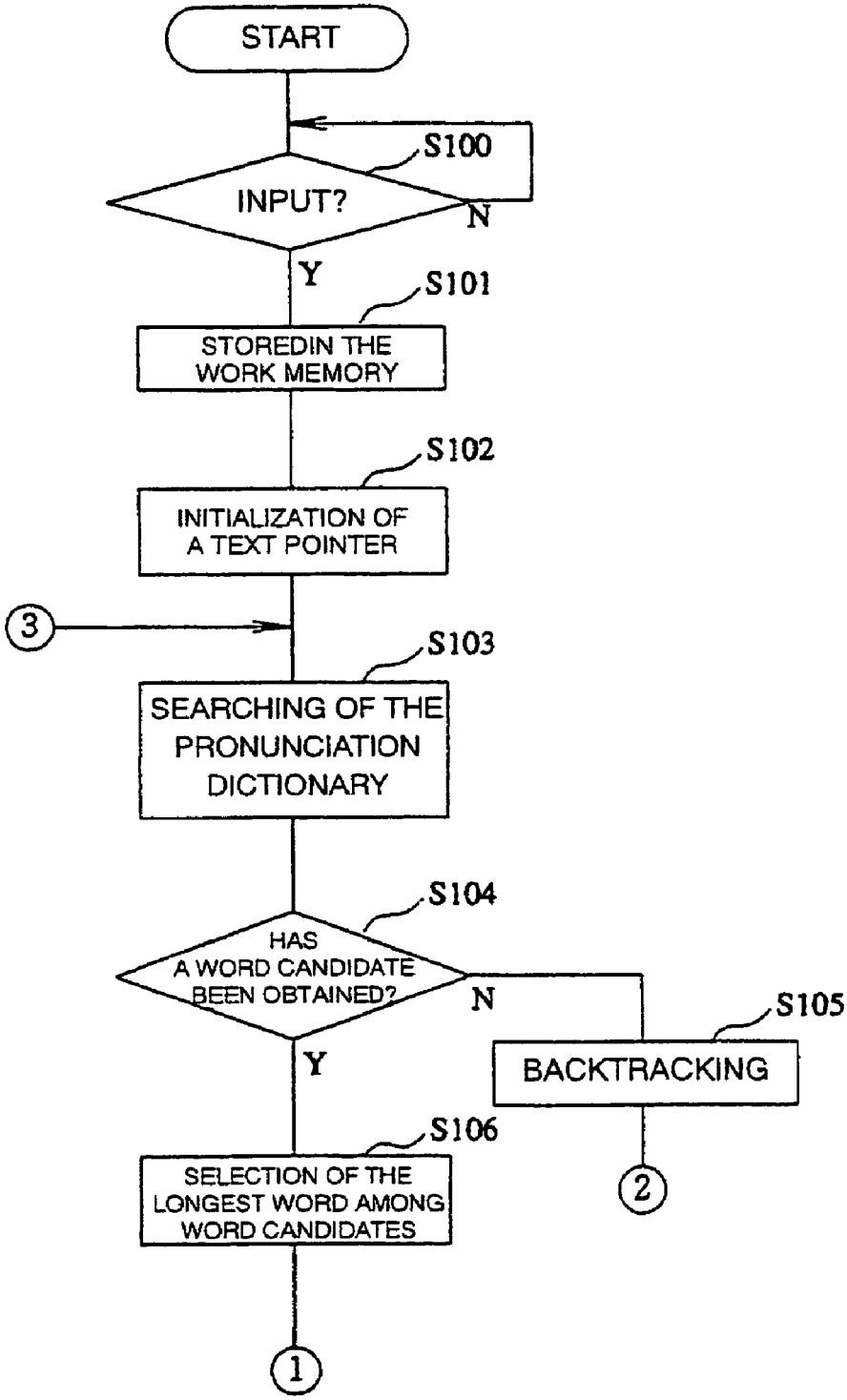
FIGS. 16A, 16B are operation flow charts of a text analyzer according to the fourth embodiment.
Figure 16B:
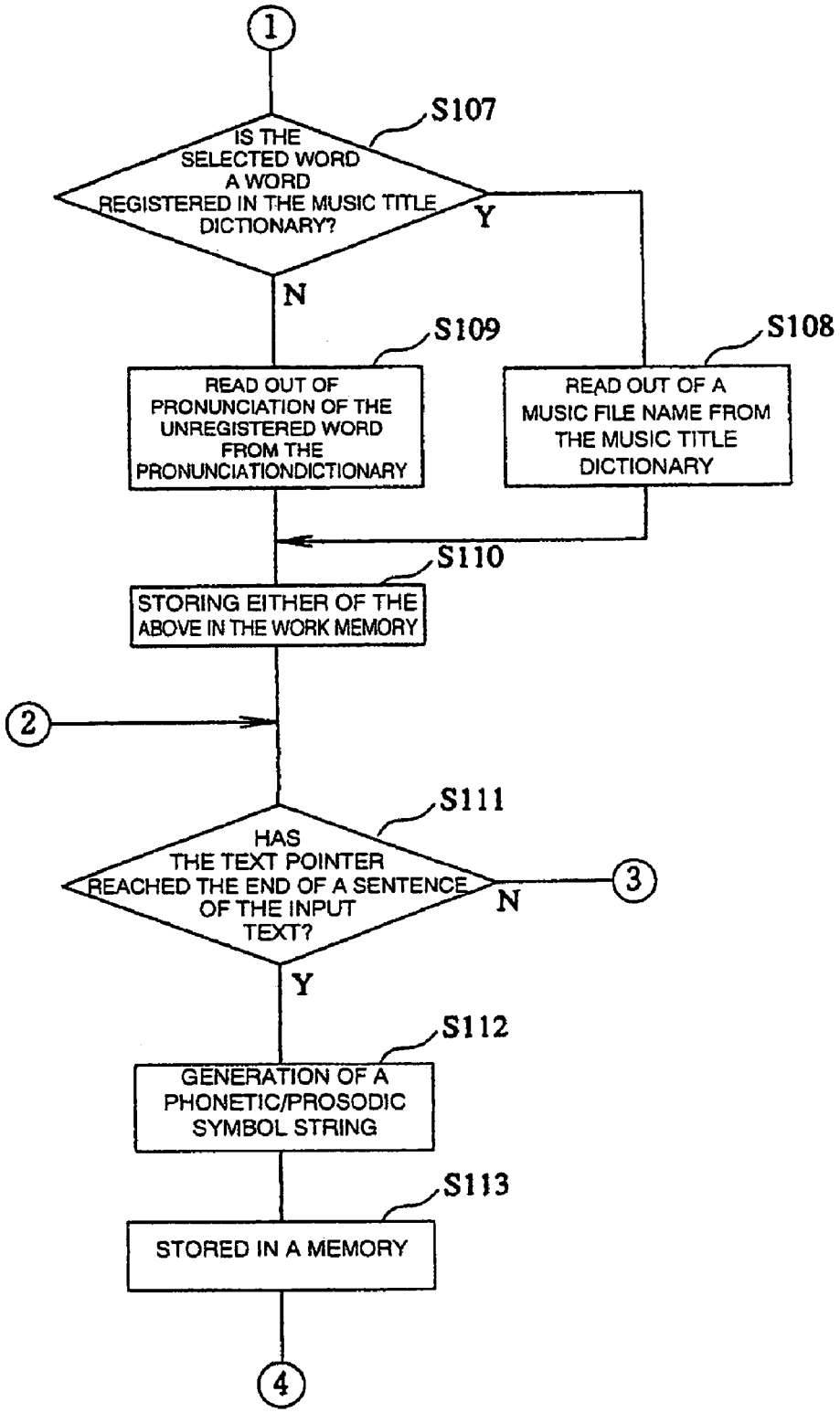
Figure 17A:
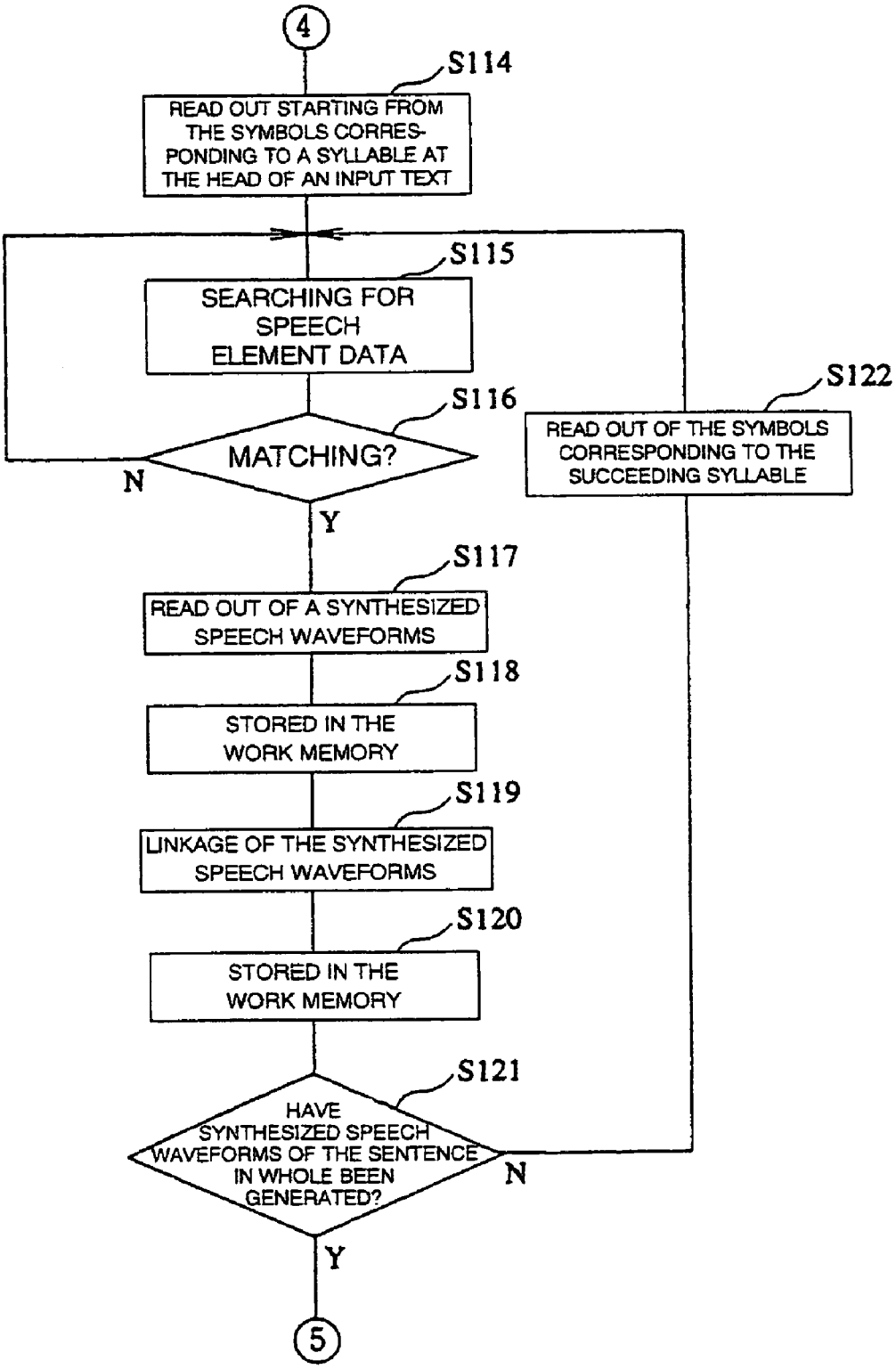
FIGS. 17A to 17C are operation flow charts of a rule-based speech synthesizer according to the fourth embodiment.
Figure 17B:
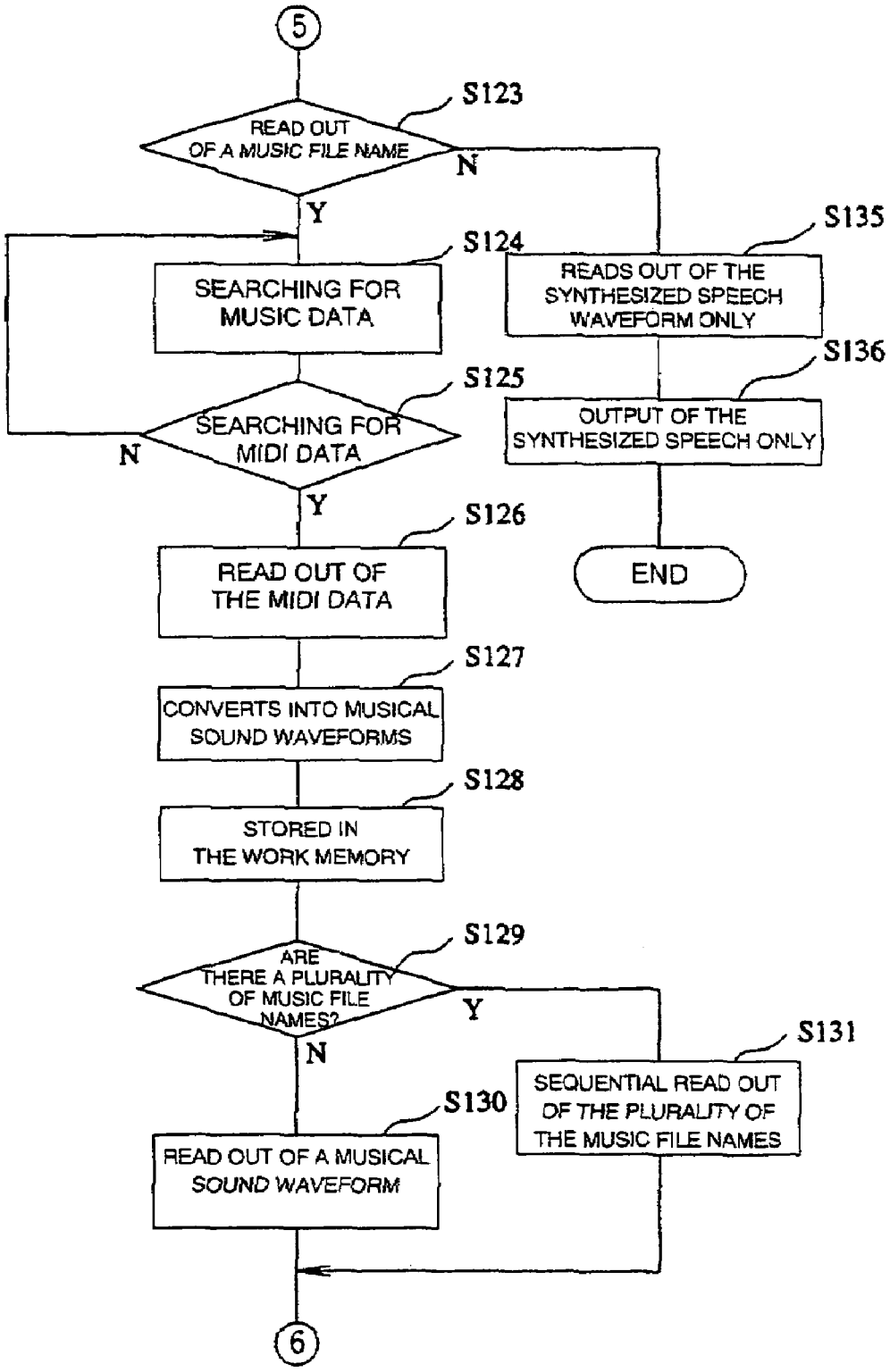
Figure 17C:
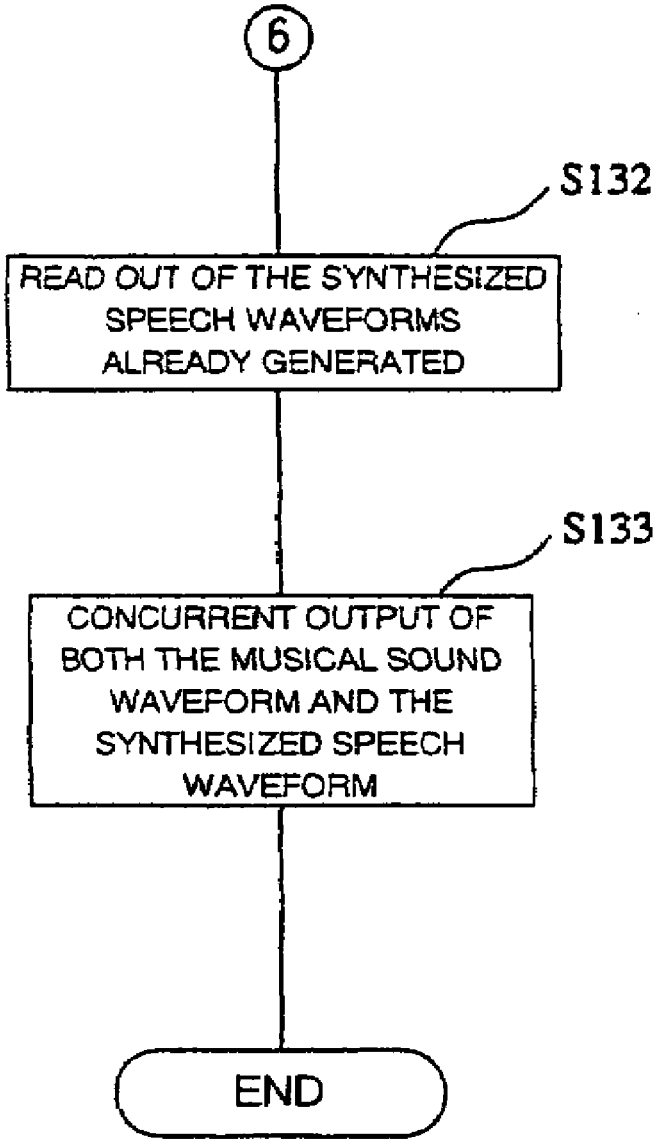

Now, operation of the Japanese-text to speech conversion system constituted as shown in FIG. 14 is described by citing a specific example. FIG. 15 is a view illustrating an example of superimposing a musical sound waveform on a synthesized speech waveform of the text in whole. The figure illustrates an example wherein the synthesized speech waveform of the text in whole and the musical sound waveform are outputted independently from each other, and concurrently. FIGS. 16A, 16B are operation flow charts of the text analyzer, and FIGS. 17A to 17C are operation flow charts of the rule-based speech synthesizer.

For example, a case is assumed wherein an input text in Japanese reads 「彼女は君が代を唄い始めた」. The input text is captured by the input unit 420 and inputted to the text analyzer 402, whereupon the input text is divided into respective words by the longest string-matching method in the dividing the input text into respective words up to generation of a phoneme rhythm symbol string is executed by taking the same steps as those described with reference to FIGS. 4A, 4B, and these steps are described hereinafter.

The text analyzer 402 determines whether or not an input text is inputted (refer to a step S100 in FIG. 16A). Upon verification of input, the input text is stored in the first memory 460 (refer to a step S101 in FIG. 16A).

Subsequently, the input text is divided into respective words by use of the longest string-matching method. Processing by the longest string-matching method is executed as follows:

A text pointer p is initialized by setting the text pointer p at the head of the input text to be analyzed (refer to a step S102 in FIG. 16A).

Subsequently, the phonation dictionary 406 is searched by the text analyzer 402 with the text pointer p set at the head of the input text in order to examine whether or not there exists a word with a notation (heading) matching the input text (the notation-matching method), and satisfying connection conditions (refer to a step S103 in FIG. 16A).

Whether or not there exist words satisfying the connection conditions, that is, whether or not word candidates can be obtained is searched (refer to a step S104 in FIG. 16A). In case the word candidates can not be found by such searching, the processing backtracks (refer to a step S105 in FIG. 16A), and proceeds to a step as described later on (refer to a step S111 in FIG. 16B).

Next, in case that the word candidates are obtained, the longest word, that is, a term (the term includes various expressions such as a word, locution, and so on) is selected among the word candidates (refer to a step S106 in FIG. 16A). In this case, if there exist a plurality of the word candidates of the same length, auxiliary words are selected preferentially over independent words. Further, in case that there is only one word candidate, such a word is selected as it is.

Subsequently, the music title dictionary 440 is searched in order to examine whether or not a selected word is a voice-related term registered in the music title dictionary 440, that is, a music title (refer to a step S107 in FIG. 16B). Such searching as well is executed against the music title dictionary 440 by the notation-matching method.

In the case where the selected word is registered in the music title dictionary 440, a music file name is read out from the music title dictionary 440, and stored in the first memory 460 together with a notation of the selected word (refer to steps S108 and S110 in FIG. 16B).

On the other hand, in the case where the selected word is an unregistered word which is not registered in the music title dictionary 440, On the other hand, in the case where the selected word is an unregistered word which is not registered in the music title dictionary 440, reading and an accent corresponding to the unregistered word are read out from the phonation dictionary 406, and stored in the first memory 460 (refer to steps S109 and S110 in FIG. 16B).

The text pointer p is advanced by a length of the selected word, and analysis described above is repeated until the text pointer p comes to the end of a sentence of the input text, thereby dividing the input text from the head of the sentence to the end thereof into respective words, that is, respective terms (refer to a step S111 in FIG. 16B).

In case that analysis processing up to the end of the input text is not completed, the processing reverts to the step S103 whereas in case that the analysis processing is completed, reading and an accent of the respective words are read out from the first memory 460, and the input text is rendered into a word-string punctuated by every word, simultaneously reading a music file name. In this case, the sentence reading 「彼女は君が代を唄い始めた」 is divided into words consisting of 「彼女|は|君が代|を|唄い|始め|た」.

Subsequently, in the text analyzer 402, a phoneme rhythm symbol string is generated based on the reading and accent of the respective words of the word string, and stored in the first memory 460 (refer to a step S113 in FIG. 16B).

If the respective words of the input text are expressed in relation to the reading and accent of every word, the input text is divided into word strings of 「彼女 (ka' nojo)」, 「は (wa)」, 「君が代 (kimigayo)」, 「を (wo)」, 「唄い (utai)」, 「始め (haji' me)」, and 「た (ta)」. What is shown in round brackets is information on the respective words, registered in the phonation dictionary 406, that is, reading and an accent of the respective words.

Thus, by use of the information on the respective words of the word string, registered in the dictionary, that is, the information in the round brackets, the text analyzer 402 generates the phoneme rhythm symbol string of 「ka' nojo wa, kimigayo wo, utai haji' me ta」.

Meanwhile, as described hereinbefore, the text analyzer 402 has examined in the step S107 whether or not the respective words in the word string are registered in the music title dictionary 440 by referring to the music title dictionary 440. In this embodiment, as the music title 「君が代 (KIMIGAYO. MID)」 (refer to Table 5) is registered therein, the music file name KIMIGAYO. MID: corresponding thereto is added to the head of the phoneme rhythm symbol string, thereby converting the same into a phoneme rhythm symbol string of 「KIMIGAYO. MID: ka' nojo wa, kimigayo wo, utai haji' me ta」, and storing the same in the first memory rhythm symbol string with the music file name attached thereto is sent out to the rule-based speech synthesizer 404.

In case that a plurality of music titles registered in the music title dictionary 440 are included in the word string, all the music file names corresponding thereto are added to the head of the phoneme rhythm symbol string as generated. In case that none of the music titles registered in the music title dictionary 440 is included in the word string, the phoneme rhythm symbol string as previously generated is sent out as it is to the rule-based speech synthesizer 404.

On the basis of the phoneme rhythm symbol string of ⌈KIMIGAYO. MID: ka' nojo wa, kimigayo wo, utai haji' me ta⌋ as received, the rule-based speech synthesizer 404 reads out relevant speech element data from the speech waveform memory 408 storing speech element data, thereby generating a synthesized speech waveform. The steps of processing in this case are described hereinafter.

First, read out is executed starting from a symbol string corresponding to a syllable at the head of the text. The rule-based speech synthesizer 404 determines whether or not a music file name is attached to the head of the phoneme rhythm symbol string representing reading and accent. Since the music file name "KIMIGAYO. MID" is added to the head of the phoneme rhythm symbol string in the case of this embodiment, a waveform of ⌈ka' nojo wa, kimigayo wo, utai haji' me ta⌋ is generated from speech element data of the speech waveform memory 408. Simultaneously, a musical sound waveform corresponding to the music file name "KIMIGAYO. MID" is read out from the musical sound waveform generator 450. The musical sound waveform and the previously-generated synthesized waveform of ⌈ka' nojo wa, kimigayo wo, utai haji' me ta⌋ are superimposed on each other from the rising edge of the waveforms, and outputted.

In this case, if a time length of the waveform of "KIMIGAYO. MID" differs from that of the waveform of ⌈ka' nojo wa, kimigayo wo, utai haji' me ta⌋, a time length of a waveform after superimposed becomes equal to that of the longer one between the time length of the former and that of the latter. However, if the waveform of the former is shorter in length than that of the latter, the former is repeated in succession until the length of the latter is reached before superimposed on the latter.

In the case where a plurality of music file names are added to the head of the phoneme rhythm symbol string, the musical sound waveform generator 450 generates all musical sound waveforms corresponding thereto, and combines the musical sound waveforms in sequence before delivering the same to the rule-based speech synthesizer 404. In the case where none of the music file names is added to the head of the phoneme rhythm symbol string, the operation of the rule-based speech synthesizer 404 is the same as that in the case of the conventional system.

The processing operation of the rule-based speech synthesizer 404 as described in the foregoing is executed as follows.

First, read out is executed starting from a symbol string corresponding to a syllable at the head of an input text (refer to a step S114 in FIG. 17A).

The rule-based speech synthesizer 404 determines by such reading that a music file name is attached to the head of the symbol string. As a result, access to the speech waveform memory 408 is made by the rule-based speech synthesizer 404, and speech element data corresponding to respective symbols of the phoneme rhythm symbol string following the music file name, representing reading and an accent, are searched for (refer to steps S115 and S116 in FIG. 17A).

In case that there exist speech element data corresponding to the respective symbols, synthesized speech waveforms corresponding thereto are read out, and stored in the first memory 460 (refer to steps S117 and S118 in FIG. 17A).

The synthesized speech waveforms corresponding to the respective symbols are linked with each other in the order as read out, the result of which is stored in the first memory 460 (refer to steps S119 and S120 in FIG. 17A).

Subsequently, the rule-based speech synthesizer 404 determines whether or not synthesized speech waveforms of the sentence in whole as represented by the phoneme rhythm symbol string of ⌈ka' nojo wa, kimigayo wo, utai haji' me ta⌋ are generated (refer to a step S121 in FIG. 17A). In case that it is determined as a result that the synthesized speech waveforms of the sentence in whole have not been generated as yet, a command to read out a symbol string corresponding to the succeeding syllable is issued (refer to a step S122 in FIG. 17A), and the processing reverts to the step S115.

In the case where the synthesized speech waveforms of the sentence in whole have already been generated, the rule-based speech synthesizer 404 reads out a music file name (refer to a step S123 in FIG. 17B). In the case of the embodiment described herein, since there exists the music file name, access to the music dictionary 454 of the musical sound waveform generator 450 is made, thereby searching for music data (refer to steps S124 and S125 in FIG. 17B).

In the case of this embodiment, the rule-based speech synthesizer 404 delivers the music file name "KIMIGAYO. MID" to the musical sound converter 452. In response thereto, the musical sound converter 452 executes searching of the music dictionary 454 for MIDI data on the music file "KIMIGAYO. MID", thereby retrieving the MIDI data (refer to steps S125 and S126 in FIG. 17B).

The musical sound converter 452 converts the MIDI data into a musical sound waveform, delivers the musical sound waveform to the rule-based speech synthesizer 404, and stores the same in the first memory 460 (refer to steps S127 and S128 in FIG. 17B).

Subsequently, upon completion of retrieval of the musical sound waveform corresponding to the music file name, the rule-based speech synthesizer 404 determines whether one music file name exists or a plurality of music file names exist (refer to a step S129 in FIG. 17B). In the case where only one music file name exists, a musical sound waveform corresponding thereto is read out from the first memory 460 (refer to a step S130 in FIG. 17B), and in the case where the plurality of the music file names exist, all musical sound waveforms corresponding thereto are read out in sequence from the first memory 460 (refer to a step S131 in FIG. 17B).

After read out of the musical sound waveforms (or upon read out of the musical sound waveforms), the synthesized speech waveform as already generated is read out from the first memory 460 (refer to a step S132 in FIG. 17C).

Upon completion of read out of both the musical sound waveforms and the synthesized speech waveform, both the musical sound waveforms and the synthesized speech waveform are concurrently outputted to the speaker 430 (refer to a step S133 in FIG. 17C).

Further, in case a music file name is not attached to the head of the phoneme rhythm symbol string since a voice-related term concerning a music title is not included in the input text, the processing proceeds from the step S107 to the step S109. Then, in the step S123, as there exists no music file name, the rule-based speech synthesizer 404 reads out the synthesized speech waveform only and outputs synthesized speech only (refer to steps S135 and S136 in FIG. 17B).

FIG. 15 shows an example of superimposition of the waveforms. This constitution example shows a state wherein the musical sound waveform of music under the title "君が代", that is, a sound waveform of a playing music, is outputted at the same time the synthesized speech waveform of "彼女は君が代を唄い始めた" is outputted. That is, during an identical time period from the starting point of the synthesized speech waveform to the endpoint thereof, the sound waveform of the playing music is outputted.

Superimposed speech waveforms for the input text in whole, thus generated, is outputted from the speaker 430.

With the use of the system 400 according to this embodiment of the invention, a music as referred to in the input text can be outputted as BGM in the form of a synthesized sound, and as a result, the synthesized speech outputted can be more appealing to a listener as compared with a case wherein the input text in whole is outputted in the synthesized speech only, thereby preventing the listener from getting bored or tired of listening.

Fifth Embodiment

Subsequently, the constitution of a fifth embodiment of a Japanese-text to speech conversion system according to the invention is described hereinafter with reference to FIGS. 18 to 19B by way of example.

There are cases where terms in a Japanese text include a term surrounded by quotation marks. In particular, in the case of terms such as onomatopoeic words, lyrics, music titles, and so forth, there are cases where the terms are surrounded by quotation marks, for example, 「 」, ' ', and " ", in order to stress the terms, or specific symbols such as ♪ are attached before or after the terms. Accordingly, the fifth embodiment of the invention is constituted such that only a term surrounded by the quotation marks or only a term with a specific symbol attached preceding thereto or succeeding thereto is replaced with a speech waveform of an actually recorded sound in place of a synthesized speech waveform before outputted.

Figure 18:
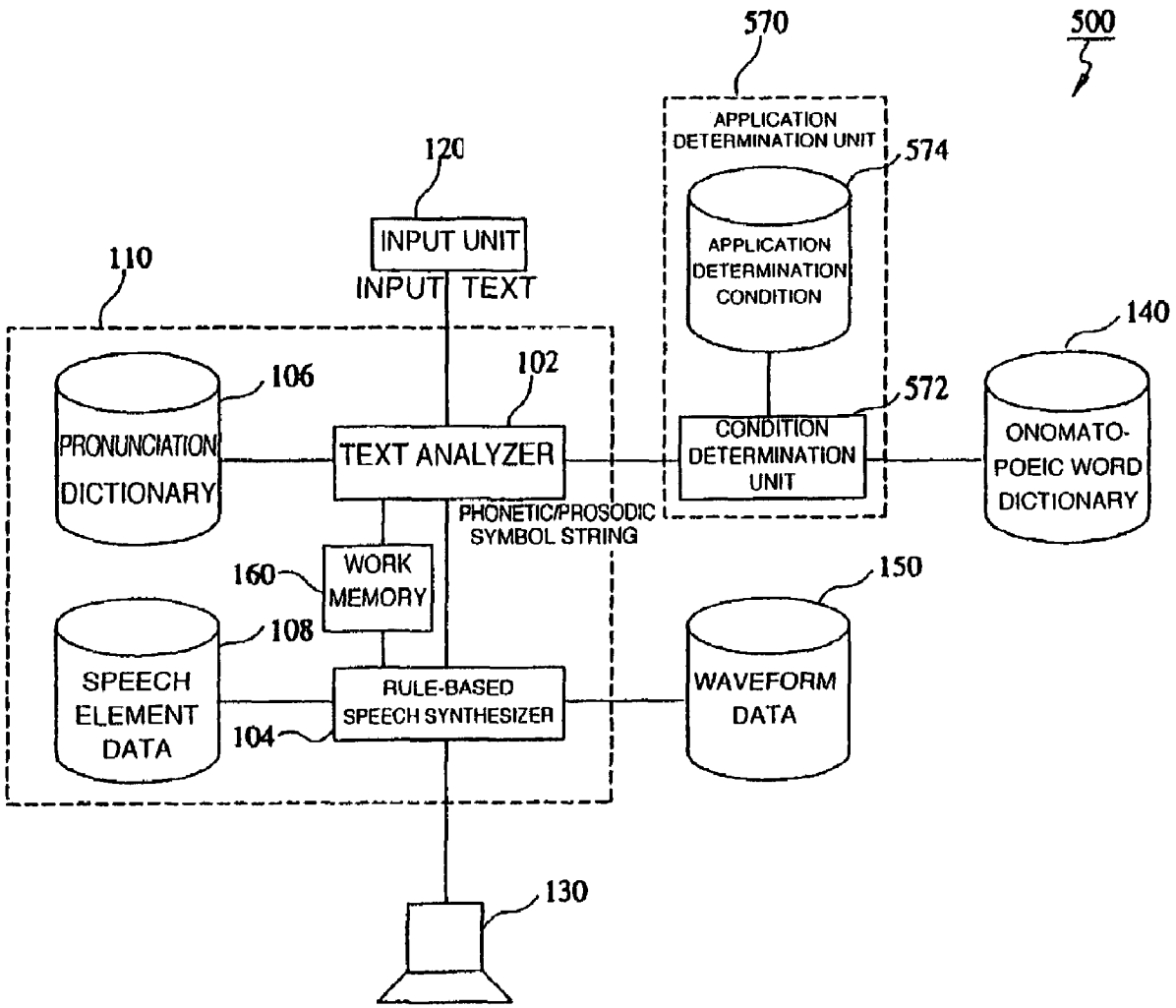
FIG. 18 is a block diagram showing the constitution of a fifth embodiment of a Japanese-text to speech conversion system according to the invention by way of example.

FIG. 18 is a block diagram showing the constitution of the fifth embodiment of the Japanese-text to speech conversion system according to the invention by way of example. The system 500 has the constitution wherein an application determination unit 570 is added to the constitution of the first embodiment previously described with reference to FIG. 2. More specifically, the system 500 differs in constitution from the system shown in FIG. 2 in that an application determination unit 570 is installed between the text analyzer 102 and the onomatopoeic word dictionary 140 as shown in FIG. 2. The system 500 according to the fifth embodiment has the same constitution, and executes the same operation, as described with reference to the first embodiment except for the constitution and the operation of the application determination unit 570. Accordingly, constituting elements of the system 500, corresponding to those of the first embodiment, are denoted by like reference numerals, and detailed description thereof is omitted, describing points of difference only.

The application determination unit 570 determines whether or not a term in a text satisfies application conditions for correlation of the term with terms registered in a phrase dictionary 140, that is, the onomatopoeic word dictionary 140 in the case of this example. Further, the application the application determination unit 570 has a function of reading out only a voice-related term matching a term satisfying the application conditions from the onomatopoeic word dictionary 140 to a conversion processing unit 110.

The application determination unit 570 comprises a condition determination unit 572 interconnecting a text analyzer 102 and the onomatopoeic word dictionary 140, and a rules dictionary 574 connected to the condition determination unit 572 for previously registering application determination conditions as the application conditions.

The application determination conditions describe conditions as to whether or not the onomatopoeic word dictionary 140 is to be used when onomatopoeic words registered in the phrase dictionary, that is, the onomatopoeic word dictionary 140, appear in an input text.

In Table 6, determination rules, that is, determination conditions, are listed such that the onomatopoeic word dictionary 140 is used only if an onomatopoeic word is surrounded by specific quotation marks. For example, 「 」, ' ', " ", or specific symbols such as ♪, and so forth are cited.

TABLE 6

| |
|---|
| a term surrounded by 「」 |
| a term surrounded by "" |
| a term surrounded by '' |
| ♪ attached before a term |
| ♪ attached after a term |

Figure 19A:
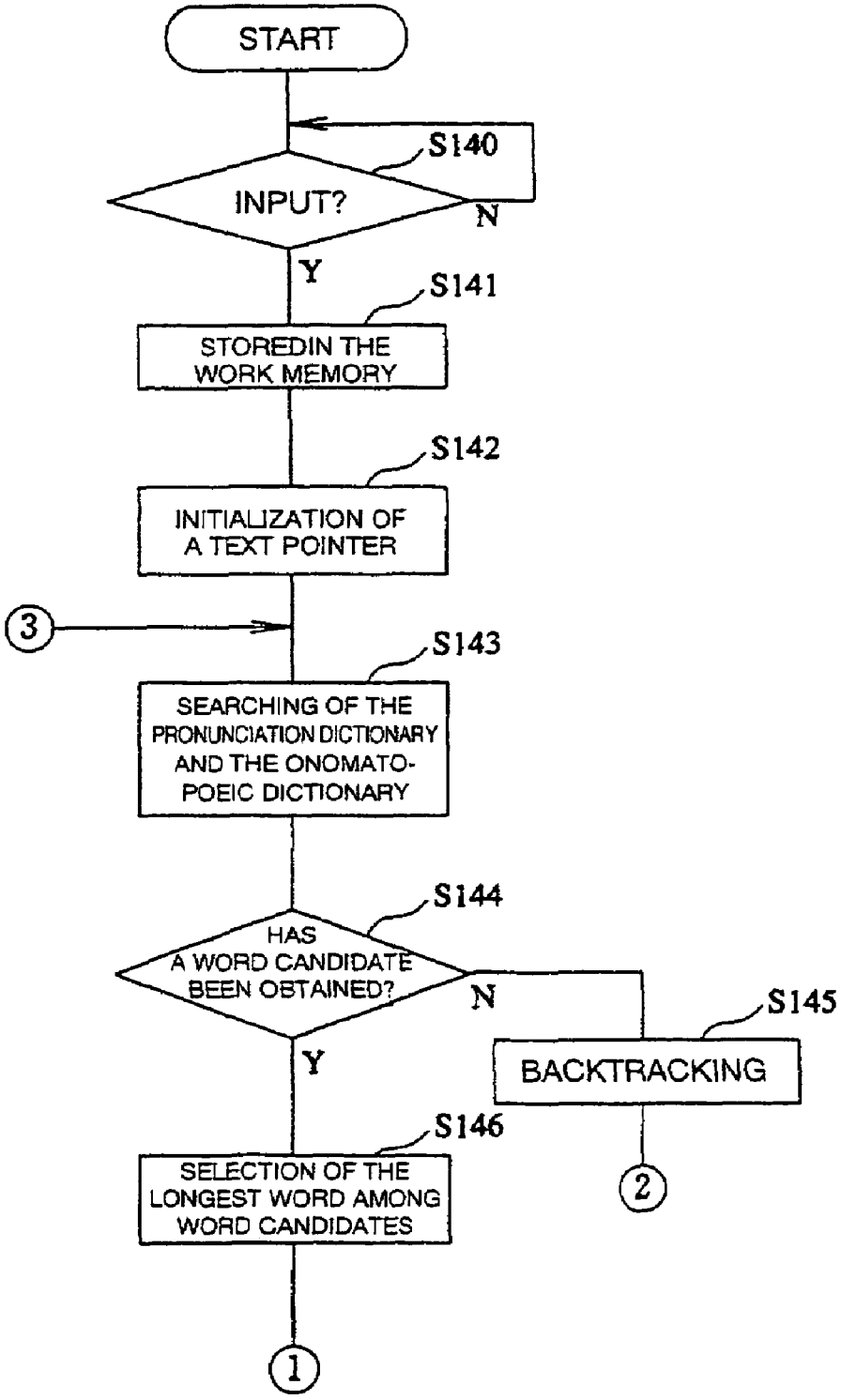
FIGS. 19A, 19B are operation flow charts of a text analyzer according to the fifth embodiment.

Now, operation of the Japanese-text to speech conversion system constituted as shown in FIG. 18 is described by giving a specific example. FIGS. 19A, 19B are operation flow charts of the text analyzer.

For example, an input text in Japanese is assumed to read 「猫が'ニャー'と鳴いた」. The input text is captured by an input unit 120 and inputted to a text analyzer 102.

The text analyzer 102 determines whether or not an input text is inputted (refer to a step S140 in FIG. 19A). Upon verification of input, the input text is stored in a first memory 160 (refer to a step S141 in FIG. 19A).

Subsequently, the input text is divided into respective words by use of the longest string-matching method. Processing by the longest string-matching method is executed as follows:

A text pointer p is initialized by setting the text pointer p at the head of the input text to be analyzed (refer to a step S142 in FIG. 19A).

Subsequently, a phonation dictionary 106 and an onomatopoeic word dictionary 140 are searched by the text analyzer 102 with the text pointer p set at the head of the input text in order to examine whether or not there notation-matching method), and satisfying connection conditions (refer to a step S143 in FIG. 19A).

Subsequently, whether or not there exists a word satisfying the connection conditions in the phonation dictionary or the onomatopoeic word dictionary is searched (refer to a step S144 in FIG. 19A). In case that word candidates can not be found by such searching, the processing backtracks (refer to a step S145 in FIG. 19A), and proceeds to a step described later on (refer to a step S151 in FIG. 19B).

Next, in the case where the word candidates are obtained, the longest word, that is, a term (the term includes various expressions such as locution of words, and so on) is selected among the word candidates (refer to a step S146 in FIG. 19A). In this case, as with the case of the first embodiment, auxiliary words are preferably selected among word candidates of the same length, taking precedence over independent words if there exist a plurality of the word candidates of the same length while in case there exists only one word candidate, such a word is selected as it is.

Subsequently, the onomatopoeic word dictionary 140 is searched for every selected word by sequential processing from the head of a sentence in order to examine whether or not the selected word is among the voice-related terms registered in the onomatopoeic word dictionary 140 (refer to a step S147 in FIG. 19B). Such searching as well is executed by the notation-matching method. In this case, the searching is executed via the condition determination unit 572 of the application determination unit 570.

Figure 19B:
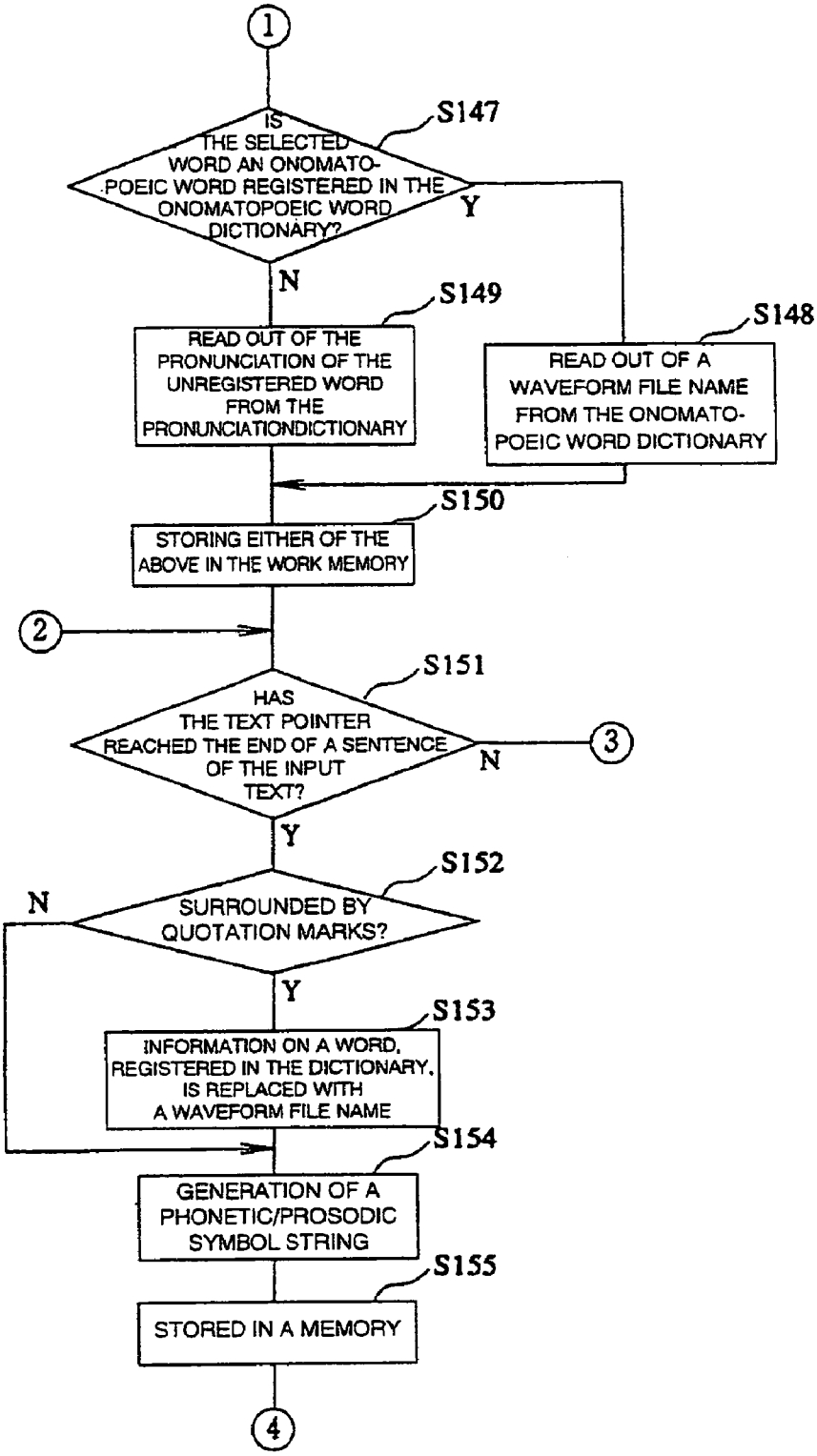

In the case where the selected word is registered in the onomatopoeic word dictionary 140, a waveform file name is read out from the onomatopoeic word dictionary 140, and stored in the first memory 160 together with a notation of the selected word (refer to steps S148 and S150 in FIG. 19B).

On the other hand, in the case where the selected word is an unregistered word which is not registered in the onomatopoeic word dictionary 140, reading and an accent corresponding to the unregistered word are read out from the phonation dictionary 106, and stored in the first memory 160 (refer to steps S149 and S150 in FIG. 19B).

Then, the text pointer p is advanced by a length of the selected word, and analysis described above is repeated until the text pointer p comes to the end of a sentence of the input text, thereby dividing the input text from the head of the sentence to the end thereof into respective words, that is, respective terms (refer to a step S151 in FIG. 19B).

In case analysis processing up to the end of the input text is not completed, the processing reverts to the step S143 whereas in case the analysis processing is completed, reading and an accent of the respective words are read out from the first memory 160, and the input text is words are read out from the first memory 160, and the input text is rendered into a word-string punctuated by every word. In this case, the sentence 「猫がニャーと鳴いた」 is divided into words consisting of 「猫|が|ニャ-|と|鳴い|た」.

In the case of this embodiment, as a result of processing the sentence of the text reading 「猫が ‘ニャ-と鳴いた」 up to the end thereof, there is obtained a word-string consisting of 「猫(ne' ko)」, 「が (ga)」, 「‘」, 「ニャ- (nya'-)」, 「'」, 「と (to)」, 「鳴い (nai)」, and 「た (ta)」. What is shown in round brackets is information on the words, registered in the phonation dictionary 106, that is, reading and an accent of the respective words.

Subsequently, the text analyzer 102 conveys the word-string to the condition determination unit 572 of the application determination unit 570. Referring to the onomatopoeic word dictionary 140, the condition determination unit 572 examines whether or not words in the word-string are registered in the onomatopoeic word dictionary 140.

Thereupon, as 「ニャ- ("CAT. WAV)"」 is registered, the condition determination unit 572 executes an application determination processing of the onomatopoeic word while referring to the rules dictionary 574 (refer to a step S152 in FIG. 19B). As shown in Table 6, the application determination conditions are specified in the rules dictionary 574. In the case of this embodiment, the onomatopoeic word 「ニャ-」 is surrounded by quotation marks 「‘」 「'」 in the word-string, and consequently, the onomatopoeic word satisfies application determination rules, stating 「surrounded by quotation marks ‘ '」. Accordingly, the condition determination unit 572 gives a notification to the text analyzer 102 for permission of application of the onomatopoeic word 「ニャ- ("CAT. WAV")」.

Upon receiving the notification, the text analyzer 102 substitutes a word 「ニャ- ("CAT. WAV")」 in the onomatopoeic word dictionary 140 for the word 「ニャ- (nya'-)」 in the word-string, thereby changing the word-string into a word-string of 「猫 (ne' ko)」, 「が (ga)」, 「ニャ- ("CAT. WAV")」, 「と (to)」, 「鳴い (nai)」, and 「た (ta)」 (refer to a step S153 in FIG. 19B). At this point in time, the quotation marks 「‘」 「'」 are deleted from the words-string as formed since the quotation marks have no information on reading of words.

By use of the information on the respective words of the word string, registered in the dictionaries, that is, the information in the round brackets, the text analyzer 102 generates a phoneme rhythm symbol string of 「ne' ko ga, "CAT. WAV" to, nai ta」, and stores the same in the first memory 160 (refer to a step S155 in FIG. 19B).

Meanwhile, a case where an input text reads 「犬がワンワン吠えた」 is assumed. Referring to the phonation dictionary 106, the text analyzer 102 divides the input text into word-strings of 「犬 (inu')」, 「が (ga)」, 「ワンワン (wa' n wan」 「吠え(ho' e」, and 「た (ta)」 to form a word-string (refer to the steps S140 to S151).

The text analyzer 102 conveys the word-strings to the condition determination unit 572 of the application determination unit 570, and the condition determination unit 572 examines whether or not words in the word-strings are registered in the onomatopoeic word dictionary 140 by use of the longest string-matching method while referring to the onomatopoeic word dictionary 140. Thereupon, as 「ワンワン ("DOG.WAV")」 is registered therein, the condition determination unit 572 executes the application determination processing of the onomatopoeic word (refer to the step S152 in FIG. 19B). As the onomatopoeic word 「ワンワン」 is neither surrounded by the quotation marks 「‘」 「'」 in the word-strings nor attached with a specific symbol such as ♪ and so forth, the onomatopoeic word does not satisfies any of the application determination conditions, specified in the rules dictionary 574. Accordingly, the condition determination unit 572 gives a notification to the text analyzer 102 for non-permission of application of the onomatopoeic word 「ワンワン("DOG.WAV")」.

As a result, the text analyzer 102 does not change the word-string of 「犬 (inu')」, 「が (ga)」, 「ワンワン (wa' n wan)」, 「吠え(ho' e)」, 「た (ta)」, and generates a phoneme rhythm symbol string of 「inu' ga, wa' n wan, ho' e ta」 by use of information on the respective words of the word string, registered in the dictionaries, that is, information in the round brackets, storing the phoneme rhythm symbol string in the first memory 160 (refer to a step S154 and the step S155 in FIG. 19B).

The phoneme rhythm symbol string thus stored is read out from the first memory 160, sent out to a rule-based speech synthesizer 104, and processed in the same way as in the case of the first embodiment, so that waveforms of the input text in whole are outputted to a speaker 130.

Further, in case a plurality of onomatopoeic words registered in the onomatopoeic word dictionary 140 are included in the word-string, the condition determination unit 572 of the application determination unit 570 makes a determination on all the onomatopoeic words according to the application determination conditions specified in the rules dictionary 574, giving a notification to the text analyzer 102 as to which of the onomatopoeic words satisfies the determination conditions. Accordingly, it follows that waveform file names corresponding to only the onomatopoeic words meeting the determination conditions are interposed in the phoneme rhythm symbol string.

Further, in the case where none of the onomatopoeic words registered in the onomatopoeic word dictionary 140 is included in the word string, application determination is not executed, and the phoneme rhythm symbol string as generated from the word string is sent out as it is to the rule-based speech synthesizer 104.

The advantageous effect obtained by use of the system 500 according to the invention is basically the same as that for the first embodiment. However, the system 500 is not constituted such that processing for outputting a portion of an input text, corresponding to an onomatopoeic word, in the form of the waveform of an actually recorded voice, is executed all the time. The system 500 is suitable for use in the case where a portion of the input text, corresponding to an onomatopoeic word, is outputted in the form of a actually recorded speech waveform only when certain conditions are satisfied. In contrast, for the case where such processing is to be executed all the time, the example as shown in the first embodiment is more suitable.

Sixth Embodiment

Figure 20:
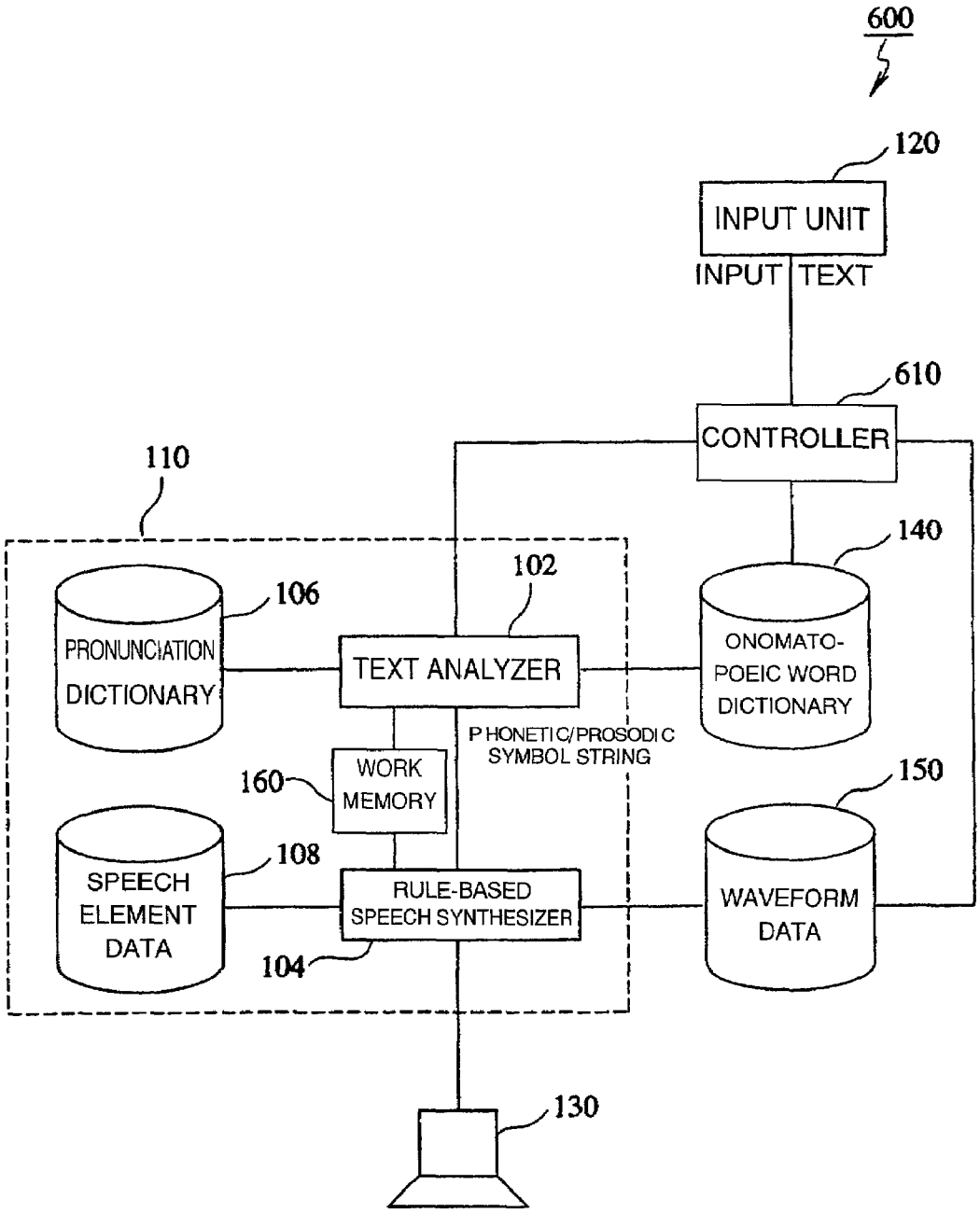
FIG. 20 is a block diagram showing the constitution of a sixth embodiment of a Japanese-text to speech conversion system according to the invention by way of example.

FIG. 20 is a block diagram showing the constitution of a sixth embodiment of the Japanese-text to speech conversion system according to the invention by way of example. The constitution of a system 600 is characterized in that a controller 610 is added to the constitution of the first embodiment described with reference to FIG. 2. The system 600 is capable of executing operation in two operation modes, that is, a normal mode, and an edit mode, by the agency of the controller 610.

When the system 600 operates in the normal mode, the controller 610 is connected to a text analyzer 102 only, so that exchange of data is not executed between the controller 610 and an onomatopoeic word dictionary 140 as well as a waveform dictionary 150.

On the other hand, when the system 600 operates in the edit mode, the controller 610 is connected to the onomatopoeic word dictionary 140 as well as the waveform dictionary 150, so that exchange of data is not executed between the controller 610 and the text analyzer 102.

That is, in the normal mode, the system 600 can execute the same operation as in the constitution of the first embodiment while, in the edit mode, the system 600 can execute editing of the onomatopoeic word dictionary 140 as well as the waveform dictionary 150. Such operation modes as described are designated by sending a command for designation of an operation mode from outside to the controller 610 via an input unit 120.

In the constitution of the sixth embodiment, detailed description of constituting element corresponding to those for the constitution of the first embodiment is omitted unless particular description is required.

In the constitution of the sixth embodiment, detailed description of constituting element corresponding to those for the constitution of the first embodiment is omitted unless particular description is required.

Figure 21A:
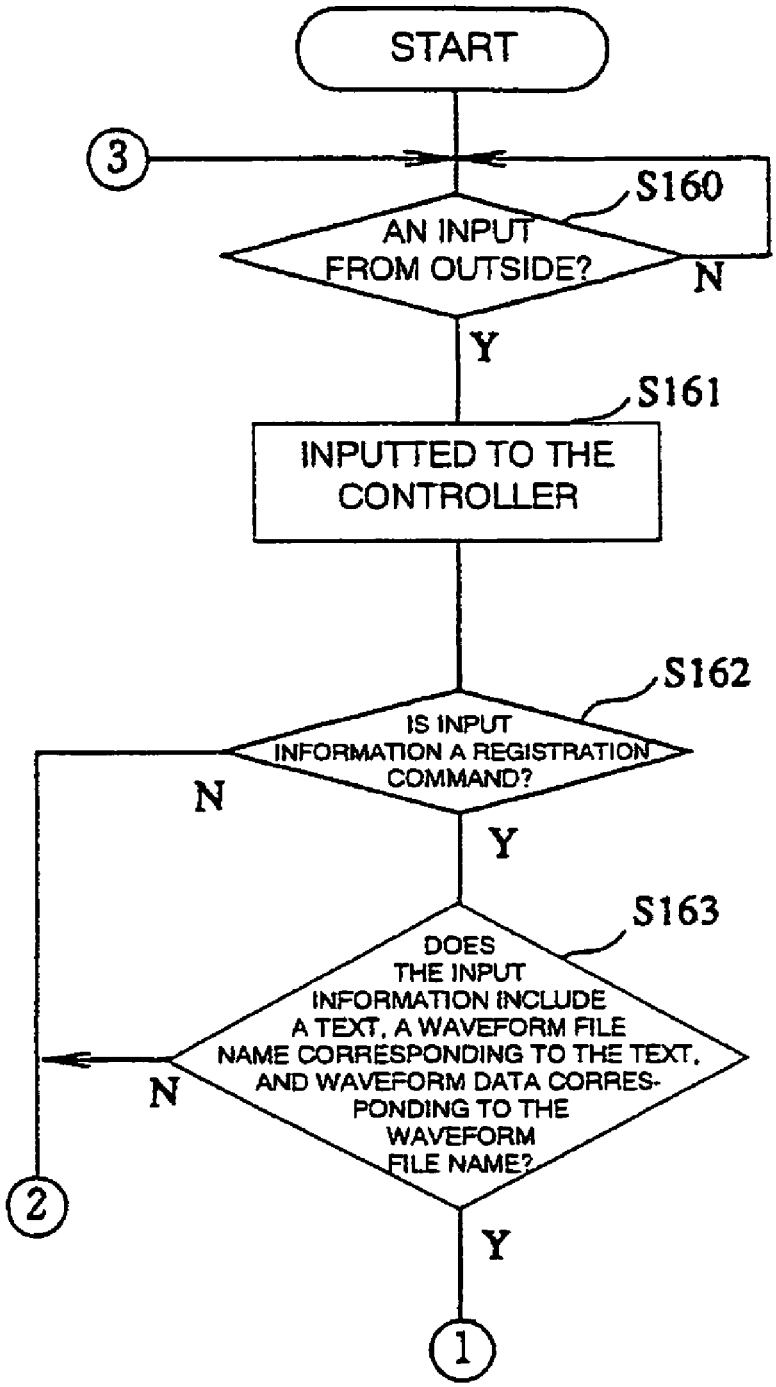
FIGS. 21A, 21B are operation flow charts of a controller according to the sixth embodiment.
Figure 21B:
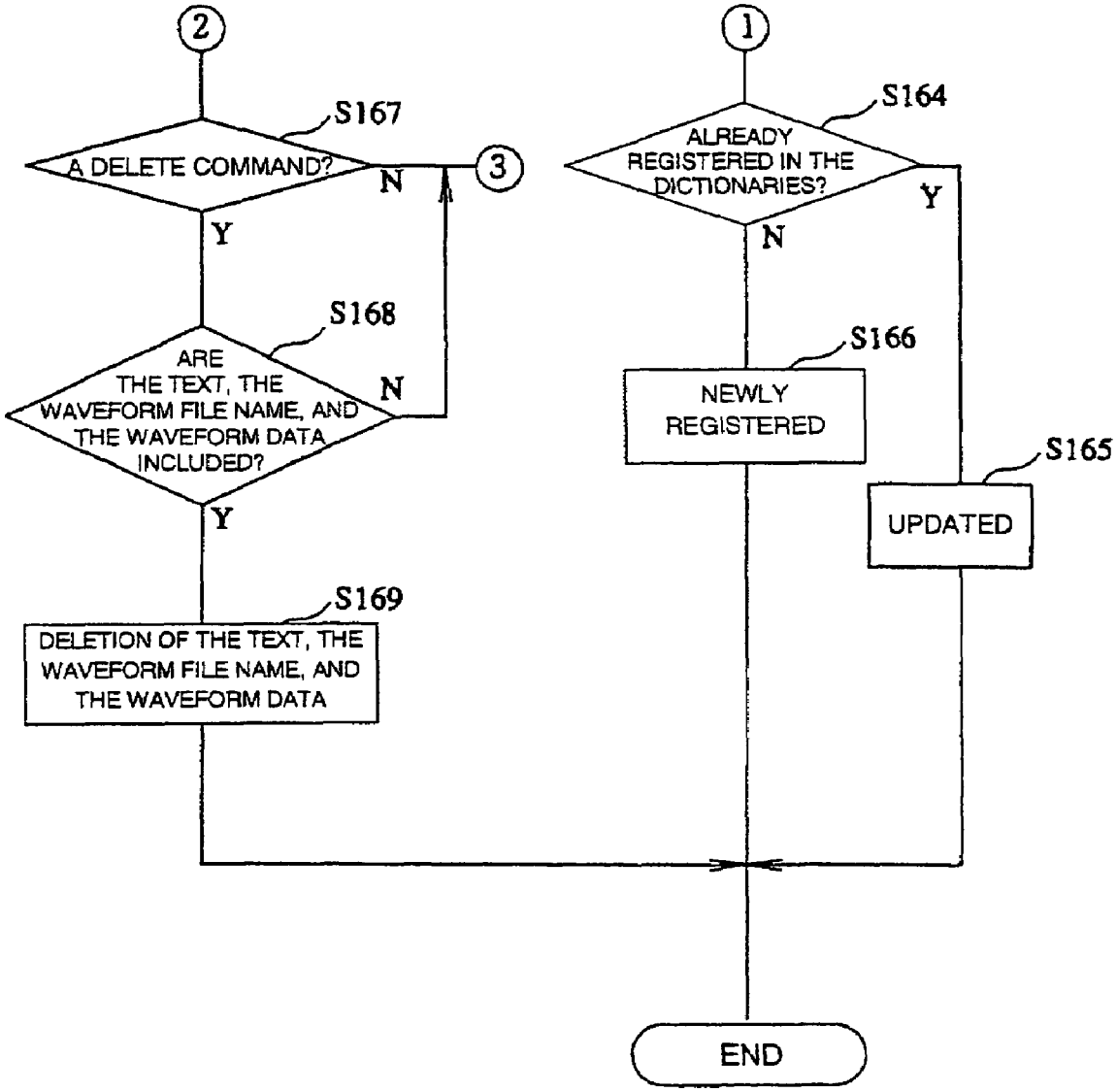

Next, referring to FIGS. 20 to 21B, operation of the Japanese-text to speech conversion system 600 is described hereinafter. FIGS. 21A, 21B are operation flow charts of the controller 610 in the constitution of the sixth embodiment.

First, a case where the system 600 operates in the edit mode by a command from outside is described hereinafter.

For example, a case is described wherein a user of the system 600 registers a waveform file "DUCK. WAV" of recorded quacking of a duck in the onomatopoeic word dictionary 140 as an onomatopoeic word such as 「ガアガア」. Following a registration command, input information such as a notation in a text, reading 「ガアガア」, and the waveform file "DUCK. WAV" is inputted from outside to the controller 610 via the input unit 120. The controller 610 determines whether or not there is an input from outside, and receives the input information if there is one, storing the same in an internal memory thereof (refer to steps S160 and S161 in FIG. 21A).

If the input information is the registration command (refer to a step S162 in FIG. 21A), the controller 610 determines whether or not the input information from outside includes a text, a waveform file name corresponding to the text, and waveform data corresponding to the waveform file name (refer to a step S163 in FIG. 21A).

Subsequently, the controller 610 makes inquiries about whether or not information on an onomatopoeic word under a notation 「ガアガア」 and corresponding to the waveform file name "DUCK. WAV" within the input information has already been registered in the onomatopoeic word dictionary 140, and whether or not waveform data corresponding to the input information has already been registered in the waveform dictionary 150 (refer to a step S1164 in FIG. 21B).

In case the input information is found already registered in the onomatopoeic word dictionary 140 as a result of such inquiries, the information on the onomatopoeic word under the notation 「ガアガア」 and corresponding to the waveform file name "DUCK. WAV" is updated, and similarly, in case the waveform data corresponding to the input information is found already registered in the waveform dictionary 150, the waveform data corresponding to the relevant waveform file name "DUCK. WAV" is updated (refer to a step S165 in FIG. 21B).

In case the input information described above to be registered in the onomatopoeic word dictionary 140 and the waveform dictionary 150, respectively, is found unregistered, the notation 「ガアガア」 and the waveform file name "DUCK. WAV" are newly registered in the onomatopoeic word dictionary 140, and waveform data obtained from an actually recorded sound, corresponding to the relevant waveform file name is newly registered (refer to a step S166 in FIG. 21B).

Meanwhile, for example, in the case where a user of the system 600 deletes an onomatopoeic word for ニャー」 from the onomatopoeic word dictionary 140, there may be a case where a delete command, and subsequent thereto, input information on a portion of the text, corresponding to 「ニャー」, are inputted to the controller 610 via the steps S160 and S161, respectively.

In order to cope with such a case, if the input information is not the registration command, or the input information does not include information on the text, the waveform file name, and the waveform data, the controller 610 determines further whether or not the input information includes a delete command (refer to the steps S162 and S163 in FIG. 21A, and a step S167 in FIG. 21B).

If the input information includes the delete command, the controller 610 makes inquiries to the onomatopoeic word dictionary 140 and the waveform dictionary 150, respectively, about whether or not information as an object of deletion has already been registered in the respective dictionaries (refer to a step S168 in FIG. 21B). If it is found in these steps of processing that neither the delete command is included nor the information as the object of deletion is registered, the processing reverts to the step 160. If it is found in these steps of processing that the delete command is included and the information as the object of deletion is registered, the information described above, that is, the information on the notation in the text, the waveform file name, and the waveform data is deleted (refer to a step S169 in FIG. 21B).

More specifically, after confirming that the onomatopoeic word under the notation ⌈ニャ–⌋ and corresponding to the waveform file name "CAT. WAV" is registered in the onomatopoeic word dictionary 140, the controller 610 deletes the onomatopoeic word from the onomatopoeic word dictionary 140. Then, the waveform file "CAT. WAV" is also deleted from the waveform dictionary 150. In the case where an onomatopoeic word inputted following the delete command is not registered in the onomatopoeic word dictionary 140 from the outset, the processing is completed without taking any step.

Thus, in the edit mode, editing of the onomatopoeic word dictionary 140 and the waveform dictionary 150, respectively, can be executed.

In the normal mode, the controller 610 receives the input text, and sends out the same to the text analyzer 102. Since the processing thereafter is executed in the same way as with the first embodiment, description thereof is omitted.

In the final step, a synthesized speech waveform for the input text in whole is outputted from a conversion processing unit 110 to a speaker 130, so that a synthesized voice is outputted from the speaker 130.

Although the advantageous effect obtained by use of the system 600 according to the invention is basically the same as that for the first embodiment, the constitution example of the sixth embodiment is more suitable for a case where onomatopoeic words outputted in actually recorded sounds are added to, or deleted from the onomatopoeic word dictionary. That is, with this embodiment, it is possible to amend a phrase dictionary and waveform data corresponding thereto. On the other hand, the constitution of the first embodiment, shown by way of example, is more suitable for a case where neither addition nor deletion is made.

EXAMPLES OF MODIFICATIONS AND CHANGES

It is to be understood that the scope of the invention is not limited in constitution to the above-described embodiments, and various modifications and changes may be made in the invention. By way of example, other embodiments of the invention will be described hereinafter.

(a) With the constitution of the second embodiment, if the waveform of the background sound is longer than the waveform of the input text, the former can be superimposed on the latter after gradually attenuating a sound volume of the former so as to become zero at a position matching the length of the latter instead of truncating the former to the length of the latter before superimposition.

(b) With the constitution of the fourth embodiment, if the musical sound waveform is longer than the waveform of the input text, the former can be superimposed on the latter after gradually attenuating a sound volume of the former so as to become zero at a position matching the length of the latter.

(c) With the constitution of the fifth embodiment, application of the onomatopoeic word dictionary 140 can also be executed by adding generic information such as ⌈the subject⌋ as registered information on respective words to the onomatopoeic word dictionary 140, and by providing a condition of ⌈there is a match in the subject⌋ as the application determination conditions of the rules dictionary 574. For example, in the case where an onomatopoeic word represented by ⌈notation: ガオ–, waveform file: "LION. WAV", the subject: ライオン⌋ and an onomatopoeic word represented by ⌈notation: ガオ–⌈notation ガオ–, waveform file: "LION. WAV", the subject: 猫⌋ a dictionary 140, the condition determination unit 572 can be set such that, if the input text reads ⌈熊がガオ–と吠えた⌋, the latter meeting the condition of ⌈there is a match in the subject⌋, that is, the onomatopoeic word ⌈ガオ––⌋ of a bear is applied because the subject of the input text is ⌈猫⌋, but the onomatopoeic word of a lion is not applied. That is, proper use of the waveform data can be made depending on the subject of the input text.

(d) The constitution of the fifth embodiment is based on that of the first embodiment, but can be similarly based on that of the second embodiment as well. That is, by adding a condition determination unit for determining application of the background sound dictionary, and a rules dictionary storing application determination conditions to the constitution of the second embodiment, the background sound dictionary 240 can also be rendered applicable only when the application determination conditions are met. Accordingly, instead of always using the waveform data corresponding to the phrase dictionary, use can be made of the waveform data only when certain application determination conditions are met.

(e) The constitution of the fifth embodiment is based on that of the first embodiment, but can be similarly based on that of the third embodiment as well. That is, by adding a condition determination unit for determining application of the song phrase dictionary, and a rules dictionary storing application determination conditions to the constitution of the third embodiment, the song phrase dictionary 340 can also be rendered applicable only when the application determination conditions are met. Accordingly, instead of always using the synthesized speech waveform of a singing voice, corresponding to the song phrase dictionary, use can be made of the synthesized speech waveform of a singing voice only when certain application determination conditions are met.

(f) The constitution of the fifth embodiment is based on that of the first embodiment, but can be similarly based on that of the fourth embodiment as well. That is, by adding a condition determination unit for determining application of the music title dictionary, and a rules dictionary storing application determination conditions to the constitution of the fourth embodiment, the music title dictionary 440 can also be rendered applicable only when the application determination conditions are met. Accordingly, instead of always using a playing music waveform, corresponding to the music title dictionary, use can be made of a playing music waveform only when certain application determination conditions are met.

(g) The constitution of the sixth embodiment is based on that of the first embodiment, but can be similarly based on that of the second embodiment as well. That is, by adding a controller to the constitution of the second embodiment, the sixth embodiment in the normal mode is enabled to operate in the same way as the second embodiment while the sixth embodiment in the edit mode is enabled to execute editing of the background sound dictionary 240 and waveform dictionary 250.

(h) The constitution of the sixth embodiment is based on that of the first embodiment, but can be similarly based on that of the third embodiment as well. That is, by adding a controller to the constitution of the third embodiment, the sixth embodiment in the normal mode is enabled to operate in the same way as the third embodiment while the sixth embodiment in the edit mode is enabled to execute editing of the song phrase dictionary 340. Accordingly, in this case, the registered contents of the song phrase dictionary can be changed.

(i) The constitution of the sixth embodiment is based on that of the first embodiment, but can be similarly based on that of the fourth embodiment as well. That is, by adding a controller to the constitution of the fourth embodiment, the sixth embodiment in the normal mode is enabled to operate in the same way as the fourth embodiment while the sixth embodiment in the edit mode is enabled to execute editing of the music title dictionary 440 and the music dictionary 454 storing music data. In this case, the registered contents of the music title dictionary and the music dictionary can be changed.

(j) The constitution of the sixth embodiment is based on that of the first embodiment, but can be similarly based on that of the fifth embodiment as well. That is, by adding a controller to the constitution of the fifth embodiment, the sixth embodiment in the normal mode is enabled to operate in the same way as the fifth embodiment while the sixth embodiment in the edit mode is enabled to execute editing of the onomatopoeic word dictionary 140, the waveform dictionary 150, and the rules dictionary 574 storing the application determination conditions. Thus, the determination conditions can be changed by use of waveform data.

(k) Any of the first to sixth embodiments may be constituted by combining several thereof with each other.

What is claimed is:

1. A text-to-speech conversion system comprising:

a conversion processing unit for converting inputted text into a synthesized speech waveform;

a phrase dictionary containing a plurality of sound-related terms that correspond to a plurality of waveform data generated from recorded sounds; and a waveform dictionary containing the waveform data generated from the sound-related terms, wherein said conversion system outputs just the speech waveform synthesized in the conversion processing unit from the inputted text, except in a case where a term in the inputted text matches one of the terms registered in said phrase dictionary, whereupon said conversion system substitutes the waveform from the waveform dictionary based on the waveform data corresponding to the one matching sound-related term, and outputs just the waveform without any overlap with the synthesized speech waveform.

2. A text-to-speech conversion system according to claim 1, further comprising an application determination unit for determining whether or not the term in the inputted text satisfies application conditions for correlation thereof with said phrase dictionary, and reading out only the sound-related term matching the term in the inputted text satisfying the application conditions from said phrase dictionary to said conversion processing unit.

3. A text-to-speech conversion system according to claim 2, wherein said application conditions include a condition that the term in the text is surrounded by quotation marks.

4. A text-to-speech conversion system according to claim 2, wherein said application conditions include a condition that a specific symbol is provided at least one of before and after the term in the text.

5. A text-to-speech conversion system according to claim 2, wherein said application conditions include a condition such that in the case where the sound related terms together with information on the subject thereof are registered in said phrase dictionary, there is a match between the information on the subject and the grammatical subject of the text.

6. A text-to-speech conversion system according to claim 2, further comprising application conditions change means capable of changing said application conditions.

7. A text-to-speech conversion system according to claim 2, wherein said application determination unit comprises a rules dictionary for storing the application conditions, and a condition determination unit for determining whether or not said phrase dictionary is to be applied, interconnecting said conversion processing unit and said phrase dictionary.

8. A text-to-speech conversion system according to claim 1, further comprising a controller for editing the registered contents of the sound-related terms registered in said phrase dictionary, and the corresponding waveform data registered in said waveform dictionary.

9. A text-to-speech conversion system according to claim 1, wherein said phrase dictionary is an onomatopoeic word dictionary for registering onomatopoeic words.

10. A text-to-speech conversion system according to claim 1, wherein the sound-related terms registered in said phrase dictionary include a notation of the relevant sound-related term, and a waveform file name corresponding to the notation, while the waveform data registered in said waveform dictionary are natural sound data of recorded sounds, and stored as waveform files.

11. A text-to-speech conversion system according to claim 1, wherein the sound-related terms registered in said phrase dictionary include a notation of the relevant sound-related term, and a waveform file name corresponding to the notation, while the waveform data registered in said waveform dictionary are natural sound data of recorded sounds, and stored as waveform files, said conversion processing unit comprising;

an input unit to which the text is inputted;

a pronunciation dictionary for registering pronunciation of respective words;

a text analyzer connected to said input unit, said pronunciation dictionary, and said phrase dictionary, for generating a phonetic/prosodic symbol string of the text by using the waveform file name of the sound-related term registered in said phrase dictionary against a term registered in both said pronunciation dictionary and said phrase dictionary among terms in the text inputted from said input unit, and by using the pronunciation of the respective words registered in said pronunciation dictionary against other terms;

a speech waveform memory for storing speech element data; and a rule-based speech synthesizer connected to said speech waveform memory, said waveform dictionary, and said text analyzer, for converting respective symbols except said waveform file name, in said phonetic/prosodic symbol string, into a speech waveform with the use of said speech element data while reading out waveform data corresponding to said waveform file name from said waveform dictionary, thereby outputting a synthesized waveform consisting of the speech waveform and the waveform data.

12. A text-to-speech conversion system comprising:

a conversion processing unit for converting inputted text into a synthesized speech waveform;

a phrase dictionary containing a plurality of sound-related terms that correspond to a plurality of waveform data generated from recorded sounds; and a waveform dictionary containing the waveform data generated from the sound-related terms, wherein said conversion system outputs just the speech waveform synthesized in the conversion processing unit from the inputted text, except in the case where there is a match between a term in the inputted text and one of the sound-related terms registered in said phrase dictionary, whereupon said conversion system overlaps the waveform based on the recorded waveform data corresponding to the one matching sound-related term and the speech waveform synthesized from the inputted text.

13. A text-to-speech conversion system according to claim 12, further comprising an application determination unit for determining whether or not the term in the inputted text satisfies application conditions for correlation thereof with said phrase dictionary, and reading out only the sound-related term matching the term in the inputted text satisfying the application conditions from said phrase dictionary to said conversion processing unit.

14. A text-to-speech conversion system according to claim 13, wherein said application conditions include a condition that the term in the text is surrounded by quotation marks.

15. A text-to-speech conversion system according to claim 13, wherein said application conditions include a condition that a specific symbol is provided at least one of before and after the term in the text.

16. A text-to-speech conversion system according to claim 13, wherein said application conditions include a condition that in the case where the sound-related terms together with information on the subject thereof are registered in said phrase dictionary, there is a match between the information on the subject and the grammatical subject of the inputted text.

17. A text-to-speech conversion system according to claim 13, further comprising application conditions change means capable of changing said application conditions.

18. A text-to-speech conversion system according to claim 13, wherein the sound-related terms registered in said phrase dictionary include a notation of the relevant sound-related term, and a waveform file name corresponding to the notation, while the waveform data registered in said waveform dictionary are natural sound data of recorded sounds, and stored as waveform files.

19. A text-to-speech conversion system according to claim 13, wherein the sound-related terms registered in said phrase dictionary include a notation of the relevant sound-related term, and a waveform file name corresponding to the notation, while the waveform data registered in said waveform dictionary are natural sound data of recorded sounds, and stored as waveform files, said conversion processing unit comprising;

an input unit to which the text is inputted;

a pronunciation dictionary for registering pronunciation of respective words;

a text analyzer connected to said input unit, said pronunciation dictionary, and said phrase dictionary, for generating a phonetic/prosodic symbol string of the text by using the waveform file name of the relevant sound-related term registered in said phrase dictionary against a term registered in both said pronunciation dictionary and said phrase dictionary among terms in the text inputted from said input unit, and by using the pronunciation of the respective words registered in said pronunciation dictionary against other terms;

a speech waveform memory for storing speech element data; and a rule-based speech synthesizer connected to said speech waveform memory, said waveform dictionary, and said text analyzer, for converting respective symbols except said waveform file name, in said phonetic/prosodic symbol string, into a speech waveform with the use of said speech element data while reading out waveform data corresponding to said waveform file name from said waveform dictionary, thereby outputting the speech waveform and the waveform data concurrently.

20. A text-to-speech conversion system according to claim 13, wherein said application determination unit comprises a rules dictionary for storing the application conditions, and a condition determination unit for determining whether or not said phrase dictionary is to be applied, interconnecting said conversion processing unit and said phrase dictionary.

21. A text-to-speech conversion system according to claim 13, wherein said phrase dictionary is a background sound dictionary for registering notations of respective background sounds, with a waveform file name corresponding to each of the registered notations.

22. A text-to-speech conversion system according to claim 12, wherein said conversion processing unit has a function of adjusting the time length of the waveform data read out from said waveform dictionary.

23. A text-to-speech conversion system according to claim 12, further comprising a controller for editing the registered contents of the sound-related terms registered in said phrase dictionary, and the corresponding waveform data registered in said waveform dictionary.

24. A text-to-speech conversion system according to claim 12, wherein said phrase dictionary is a background sound dictionary for registering background sounds.

25. A text-to-speech conversion system according to claim 12, wherein the sound-related terms registered in said phrase dictionary include a notation of the relevant sound-related term, and a waveform file name corresponding to the notation, while the waveform data registered in said waveform dictionary are natural sound data of recorded sounds, and stored as waveform files.

26. A text-to-speech conversion system according to claim 12, wherein the sound-related terms registered in said phrase dictionary include a notation of the relevant sound-related term, and a waveform file name corresponding to the notation, while the waveform data registered in said waveform dictionary are natural sound data of recorded sounds, and stored as waveform files, said conversion processing unit comprising;

an input unit to which the text is inputted;

a pronunciation dictionary for registering pronunciation of respective words;

a text analyzer connected to said input unit, said pronunciation dictionary, and said phrase dictionary, for generating a phonetic/prosodic symbol string of the text by using the waveform file name of the relevant sound-related term registered in said phrase dictionary against a term registered in both said pronunciation dictionary and said phrase dictionary among terms in the text inputted from said input unit, and by using the pronunciation of the respective words registered in said pronunciation dictionary against other terms;

a speech waveform memory for storing speech element data; and a rule-based speech synthesizer connected to said speech waveform memory, said waveform dictionary, and said text analyzer, for converting respective symbols except said waveform file name, in said phonetic/prosodic symbol string, into a speech waveform with the use of said speech element data while reading out waveform data corresponding to said waveform file name from said waveform dictionary, thereby outputting the speech waveform and the waveform data concurrently.

27. A text-to-speech conversion system according to claim 12, wherein said phrase dictionary is a background sound dictionary for registering notations of respective background sounds, with a waveform file name corresponding to each of the registered notations.

28. A text-to-speech conversion system comprising:

a conversion processing unit for converting a text inputted into a speech waveform;

a phrase dictionary for registering a plurality of voice-related terms that correspond to a plurality of actual waveform data generated from actually recorded voices; and a waveform dictionary for registering the actual waveform data corresponding to the voice-related terms, wherein said conversion processing unit has a function such that in the case where there is a match between a term in the inputted text and one of the voice-related terms registered in said phrase dictionary, said conversion processing unit outputs an overlapped speech waveform including the speech waveform based on the actual waveform data corresponding to the one matching voice-related term and the speech waveform synthesized therein from the inputted text, and otherwise said conversion processing unit outputs the speech waveform synthesized therein from the inputted text;

wherein said conversion processing unit has a function of adjusting the time length of the waveform data read out from said waveform dictionary; and wherein in case the time length of the read-out waveform data is longer than that of the speech waveform synthesized from the inputted text, the time length of the read-out waveform data is adjusted by truncating said waveform data at a time when said speech waveform comes to an end.

29. A text-to-speech conversion system comprising:

a conversion processing unit for converting a text inputted into a speech waveform;

a phrase dictionary for registering a plurality of voice-related terms that correspond to a plurality of actual waveform data generated from actually recorded voices; and a waveform dictionary for registering the actual waveform data corresponding to the voice-related terms, wherein said conversion processing unit has a function such that in the case where there is a match between a term in the inputted text and one of the voice-related terms registered in said phrase dictionary, said conversion processing unit outputs an overlapped speech waveform including the speech waveform based on the actual waveform data corresponding to the one matching voice-related term and the speech waveform synthesized therein from the inputted text, and otherwise said conversion processing unit outputs the speech waveform synthesized therein from the inputted text;

wherein said conversion processing unit has a function of adjusting the time length of the waveform data read out from said waveform dictionary; and wherein in case the time length of the read-out waveform data is longer than that of the speech waveform synthesized from the inputted text, said time length is adjusted by gradually attenuating the sound volume of said waveform data so as to become zero at a time when said speech waveform comes to an end.

30. A text-to-speech conversion system comprising:

a conversion processing unit for converting a text inputted into a speech waveform;

a phrase dictionary for registering a plurality of voice-related terms that correspond to a plurality of actual waveform data generated from actually recorded voices; and a waveform dictionary for registering the actual waveform data corresponding to the voice-related terms, wherein said conversion processing unit has a function such that in the case where there is a match between a term in the inputted text and one of the voice-related terms registered in said phrase dictionary, said conversion processing unit outputs an overlapped speech waveform including the speech waveform based on the actual waveform data corresponding to the one matching voice-related term and the speech waveform synthesized therein from the inputted text, and otherwise said conversion processing unit outputs the speech waveform synthesized therein from the inputted text;

wherein said conversion processing unit has a function of adjusting the time length of the waveform data read out from said waveform dictionary; and wherein in case the time length of the read-out waveform data is shorter than that of the speech waveform synthesized from the inputted text, said time length is adjusted by coupling together successive repetitions of said waveform data.

31. A text-to-speech conversion system comprising:

a conversion processing unit for converting inputted text, containing lyrics, into a synthesized speech and song waveform;

a song phrase dictionary containing a plurality of pairs of lyrics or lyric phrases and song phoneme rhythm symbol strings corresponding thereto; and a song phoneme rhythm symbol string processing unit for analyzing the song phoneme rhythm symbol strings in order to convert said song phoneme rhythm symbol strings into a plurality of synthesized song/speech waveforms, wherein said conversion processing unit outputs just the speech waveform synthesized therein from the inputted text, except in a case where one of the lyrics in the inputted text matches with one of the lyrics registered in said song phrase dictionary, whereupon said conversion processing unit outputs just the synthesized song/speech waveforms, without overlapping said speech waveform.

32. A text-to-speech conversion system according to claim 31, further comprising an application determination unit for determining whether or not the lyric phrases in the inputted text satisfy application conditions for the correlation thereof with said song phrase dictionary, and reading out the song phoneme rhythm symbol string paired off with the registered lyrics matching the inputted lyrics satisfying the application conditions from said song phrase dictionary to said conversion processing unit.

33. A text-to-speech conversion system according to claim 32, wherein said application conditions include a condition that the lyrics in the inputted text are surrounded by quotation marks.

34. A text-to-speech conversion system according to claim 32, wherein said application conditions include a condition that a specific symbol is provided at least one of before and after the lyrics in the inputted text.

35. A text-to-speech conversion system according to claim 32, further comprising application conditions change means capable of changing said application conditions.

36. A text-to-speech conversion system according to claim 32, wherein said application determination unit comprises a rules dictionary for storing the application conditions, and a condition determination unit for determining whether or not said song phrase dictionary is to be applied, interconnecting said conversion processing unit and said song phrase dictionary.

37. A text-to-speech conversion system according to claim 31, further comprising a controller for editing the registered contents of the lyrics, and the song phoneme rhythm symbol string, paired off with the registered lyrics, respectively.

38. A text-to-speech conversion system according to claim 31, wherein said conversion processing unit comprises:

an input unit to which the text is inputted;

a pronunciation dictionary for registering pronunciation of respective words;

a text analyzer connected to said input unit, said pronunciation dictionary, and said phrase dictionary, for generating a phonetic/prosodic symbol string of the text by using said song phoneme rhythm symbol string registered in said song phrase dictionary against the lyrics among terms in the text inputted from said input unit, and by using the pronunciation of the respective words registered in said pronunciation dictionary against other terms;

a speech waveform memory for storing speech element data; and a rule-based speech synthesizer connected to said speech waveform memory, said song phoneme rhythm symbol string processing unit, and said text analyzer, for converting respective symbols except said song phoneme rhythm symbol string, in the phonetic/prosodic symbol string, into a speech waveform with the use of said speech element data while collaborating with said song phoneme rhythm symbol string processing unit and said speech waveform memory for causing said song phoneme rhythm symbol string processing unit to generate waveform data corresponding to said song phoneme rhythm symbol string, thereby outputting a synthesized waveform consisting of the speech waveform and the waveform data.

39. A text-to-speech conversion system comprising:

a conversion processing unit for converting inputted text containing a music title into a synthesized speech waveform;

a music title dictionary containing a plurality of music titles; and a musical sound waveform generator for generating a musical sound waveform corresponding to one of the music titles, said musical sound waveform generator including a music dictionary for registering music data corresponding to the music titles, and a musical sound synthesizer for converting one of the music data into a musical sound waveform, wherein said conversion processing unit outputs just the speech waveform synthesized therein from the inputted text, except in a case where the music title in the inputted text matches one of the registered music titles, whereupon the musical sound waveform corresponding to the one matching registered music title is superimposed on the speech waveform of the text before being outputted.

40. A text-to-speech conversion system according to claim 39, further comprising an application determination unit for determining whether or not the music title in the inputted text satisfies application conditions for the correlation thereof with said music title dictionary, and reading out only the registered music title matching the inputted music title satisfying the application conditions from said music title dictionary to said conversion processing unit.

41. A text-to-speech conversion system according to claim 40, wherein said application conditions include a condition that the music title in the inputted text is surrounded by quotation marks.

42. A text-to-speech conversion system according to claim 40, wherein said application conditions include a condition that a specific symbol is provided at least one of before and after the music title in the text.

43. A text-to-speech conversion system according to claim 40, further comprising application conditions change means capable of changing said application conditions.

44. A text-to-speech conversion system according to claim 40, wherein said application determination unit comprises a rules dictionary for storing the application conditions, and a condition determination unit for determining whether or not said music title dictionary is to be applied, interconnecting said conversion processing unit and said music title dictionary.

45. A text-to-speech conversion system according to claim 39, wherein said conversion processing unit has a function of adjusting the time length of the musical sound waveform sent from said musical sound synthesizer.

46. A text-to-speech conversion system according to claim 39, further comprising a controller for editing the contents of music titles registered in said music title dictionary, and the corresponding music data registered in said music dictionary.

47. A text-to-speech conversion system according to claim 39, wherein the music titles registered in said music title dictionary include the notation of the relevant music title, and the music file name corresponding to the notation, while the music data registered in said music dictionary, are stored as waveform files, said conversion processing unit comprising;

an input unit to which the text is inputted;

a pronunciation dictionary for registering pronunciation of respective words;

a text analyzer connected to said input unit, said pronunciation dictionary, and said phrase dictionary, for generating a phonetic/prosodic symbol string of the text by using the music file name against the relevant music title among terms in the text inputted from said input unit, and by using the pronunciation of the respective words registered in said pronunciation dictionary against all other terms;

a speech waveform memory for storing speech element data; and a rule-based speech synthesizer connected to said speech waveform memory, said musical sound waveform generator, and said text analyzer, for converting respective symbols of the phonetic/prosodic symbol string into a speech waveform with the use of said speech element data while reading out the music data corresponding to said music file name from said musical sound waveform generator, thereby concurrently outputting the speech waveform and the music data.

48. A text-to-speech conversion system comprising:

a conversion processing unit for converting inputted text containing a music title into a speech waveform;

a music title dictionary for registering a plurality of music titles; and a musical sound waveform generator for generating a musical sound waveform corresponding to one of the music titles, said musical sound waveform generator including a music dictionary for registering music data corresponding to the music titles, and a musical sound synthesizer for converting one of the music data into a musical sound waveform, wherein said conversion processing unit has a function such that in a case where the music title in the inputted text matches one of the registered music titles, the musical sound waveform corresponding to the one matching registered music title is superimposed on the speech waveform of the text before being outputted;

wherein said conversion processing unit has a function of adjusting the time length of the musical sound waveform sent from said musical sound synthesizer; and wherein in case the time length of the musical sound waveform differs from the time length of the speech waveform of the text, the time length of the superimposed output is adjusted to be the longer of both the waveform time lengths.

49. A text-to-speech conversion system comprising:

a conversion processing unit for converting inputted text containing a music title into a speech waveform;

a music title dictionary for registering a plurality of music titles; and a musical sound waveform generator for generating a musical sound waveform corresponding to one of the music titles, said musical sound waveform generator including a music dictionary for registering music data corresponding to the music titles, and a musical sound synthesizer for converting one of the music data into a musical sound waveform, wherein said conversion processing unit has a function such that in a case where the music title in the inputted text matches one of the registered music titles, the musical sound waveform corresponding to the one matching registered music title is superimposed on the speech waveform of the text before being outputted;

wherein said conversion processing unit has a function of adjusting the time length of the musical sound waveform sent from said musical sound synthesizer; and wherein in case the time length of the musical sound waveform is shorter than that of the speech waveform of the inputted text, said time length of the musical sound waveform is adjusted by coupling together successive repetitions of said musical sound waveform data.

* * * * *